US010905607B2

(12) United States Patent
Moore

(10) Patent No.: US 10,905,607 B2
(45) Date of Patent: Feb. 2, 2021

(54) MODULAR POWER BASE ARRANGEMENT

(71) Applicant: TOYOTA MOTOR NORTH AMERICA, INC., Plano, TX (US)

(72) Inventor: Douglas A. Moore, Fairview, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 78 days.

(21) Appl. No.: 16/261,188

(22) Filed: Jan. 29, 2019

(65) Prior Publication Data

US 2020/0237588 A1 Jul. 30, 2020

(51) Int. Cl.

| | |
|---|---|
| ***A61G 5/06*** | (2006.01) |
| ***A61G 5/04*** | (2013.01) |
| ***A61G 5/10*** | (2006.01) |

(52) U.S. Cl.

CPC ..... *A61G 5/06* (2013.01); *A61G 5/041* (2013.01); *A61G 5/042* (2013.01); *A61G 5/043* (2013.01); *A61G 5/061* (2013.01); *A61G 5/1059* (2013.01)

(58) Field of Classification Search

CPC ..... A61G 5/06; A61G 5/061; A61G 5/041; A61G 5/043; A61G 5/1059; A61G 5/042

See application file for complete search history.

(56) References Cited

U.S. PATENT DOCUMENTS

| | | | | |
|---|---|---|---|---|
| 4,790,548 A * | 12/1988 | Decelles | ..... | A61G 5/061 280/5.26 |
| 5,701,965 A * | 12/1997 | Kamen | ..... | A61G 5/04 180/7.1 |
| 6,062,600 A * | 5/2000 | Kamen | ..... | A61G 5/04 280/755 |
| 9,039,018 B1 | 5/2015 | Lin | | |

(Continued)

FOREIGN PATENT DOCUMENTS

| | | |
|---|---|---|
| CN | 2387891 | 7/2000 |
| CN | 101357093 | 2/2009 |

(Continued)

OTHER PUBLICATIONS

Lalwani, Mona. "Whill's all-terrain wheelchair is built for rough surfaces." Engadget, Jan. 6, 2017, https://www.engadget.com/2017/01/06/all-terrain-wheelchair-for-rough-surfaces/. Accessed Nov. 5, 2018.

(Continued)

*Primary Examiner* — Drew J Brown

(74) *Attorney, Agent, or Firm* — Dinsmore & Shohl LLP

(57) ABSTRACT

A wheelchair assembly including a control device, a power base, and a plurality of leg modules coupled to the power base is disclosed. Each of a first, a second, and a third leg module may include an upper leg assembly and a lower leg assembly. Each lower leg assembly may include a knee joint and a foot joint and each lower leg assembly may rotatably couple to each upper leg assembly at the knee joint. A knee (Continued)

wheel located at the knee joint of each lower leg assembly, may include an omni-directional wheel, and may be selectively drivable. A foot wheel located at the foot joint of each lower leg assembly may be selectively drivable. The control device, based on a selectable mode of operation, may selectively position at least one of the knee wheel or the foot wheel associated with each respective leg module relative to a surface.

19 Claims, 16 Drawing Sheets

(56) References Cited

U.S. PATENT DOCUMENTS

| | | | | |
|---|---|---|---|---|
| 2004/0007425 | A1* | 1/2004 | Kamen | B60L 15/20 182/141 |
| 2008/0202837 | A1 | 8/2008 | Macedo Ribeiro et al. | |
| 2015/0374564 | A1* | 12/2015 | Sutton | A61G 5/1075 280/657 |
| 2017/0172823 | A1* | 6/2017 | Ishikawa | A61G 5/042 |
| 2017/0217514 | A1 | 8/2017 | Chan et al. | |
| 2018/0042797 | A1* | 2/2018 | Richter | A61G 5/04 |
| 2018/0178706 | A1* | 6/2018 | Takahata | G05D 1/024 |
| 2019/0231617 | A1* | 8/2019 | Cazali | A61G 5/06 |
| 2020/0085654 | A1* | 3/2020 | Moore | A61G 5/06 |

FOREIGN PATENT DOCUMENTS

| | | |
|---|---|---|
| JP | 4038645 | 1/2008 |
| JP | 2016002182 | 1/2016 |
| WO | 2016110317 | 7/2016 |

OTHER PUBLICATIONS

Hislop, Martin. "The scewo electric wheelchair can climb stairs independently." designboom, Mar. 28, 2017, https://www.designboom.com/technology/scewo-electric-wheelchair-climb-stairs-independently-03-28-2017/. Accessed Nov. 5, 2018.

* cited by examiner

MODULAR POWER BASE ARRANGEMENT

BACKGROUND

The present disclosure generally relates to systems and/or methods for transitioning a wheelchair assembly, including a plurality of leg modules, between various modes of operation.

Everyday obstacles (e.g., steps, changes in terrain, changes in surface materials, static/dynamic objects within a path of travel, tight spaces, and/or the like) constantly inhibit the travel of conventional wheelchairs. Conventional wheelchairs, even if powered, are often not adaptable to such constantly changing environmental obstacles.

SUMMARY

In one embodiment, a wheelchair assembly including a control device, a power base, and a plurality of leg modules coupled to the power base is disclosed. The plurality of leg modules may include a first leg module, a second leg module, and a third leg module. Each of the first leg module, the second leg module, and the third leg module may include an upper leg assembly, a lower leg assembly, a knee wheel, and a foot wheel. Each lower leg assembly may include a knee joint and a foot joint and each lower leg assembly may rotatably couple to each upper leg assembly at the knee joint. The knee wheel may be located at the knee joint of each lower leg assembly, may include an omni-directional wheel, and may be selectively drivable. The foot wheel may be located at the foot joint of each lower leg assembly and may be selectively drivable. The control device, based on a selectable mode of operation, may control at least one of the upper leg assembly or the lower leg assembly associated with each respective leg module to selectively position at least one of the knee wheel or the foot wheel associated with each respective leg module relative to a surface.

In another embodiment, a leg module of a wheelchair assembly including an upper leg assembly, a lower leg assembly, a knee wheel, and a foot wheel is disclosed. The lower leg assembly may include a knee joint and a foot joint and may rotatably couple to the upper leg assembly at the knee joint. The knee wheel may be located at the knee joint of the lower leg assembly, may include an omni-directional wheel, and may be selectively drivable. The foot wheel may be located at the foot joint of the lower leg assembly and may be selectively drivable. At least one of the upper leg assembly or the lower leg assembly associated with the leg module may be controllable, based on a selectable mode of operation, to selectively position at least one of the omni-directional knee wheel or the foot wheel associated with the leg module relative to a surface.

In yet another embodiment, a system including a control device, a power base, and a plurality of leg modules coupled to the power base is disclosed. The plurality of leg modules may include a first leg module, a second leg module, and a third leg module. Each of the first leg module, the second leg module, and the third leg module may include an upper leg assembly, a lower leg assembly, a knee wheel, and a foot wheel. Each lower leg assembly may include a knee joint and a foot joint and each lower leg assembly may rotatably coupled to each upper leg assembly at the knee joint. The knee wheel may be located at the knee joint of each lower leg assembly, may include an omni-directional wheel, and may be selectively drivable. The foot wheel may be located at the foot joint of each lower leg assembly and may be selectively drivable. The control device may control at least one of the first leg module, the second leg module or the third leg module, either independently or simultaneously, to transition the system between a front-wheel drive mode configuration, a mid-wheel drive mode configuration, and an omni-drive mode configuration.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, wherein like structure is indicated with like reference numerals and in which:

DETAILED DESCRIPTION

The present disclosure relates to a system including a wheelchair assembly having a modular power base including various arrangements of driven and/or non-driven wheels selectively positioned in or out of contact with the ground based on a selected mode of operation. The driven and/or non-driven wheels may include standard wheels and/or omni-directional wheels. According to aspects described herein, the various modes of operation may increase the efficiency and the maneuverability of the wheelchair assembly. In addition, operating the wheelchair assembly in a particular mode of operation may assist a user of the wheelchair assembly during activities of daily living.

Figure 1A:
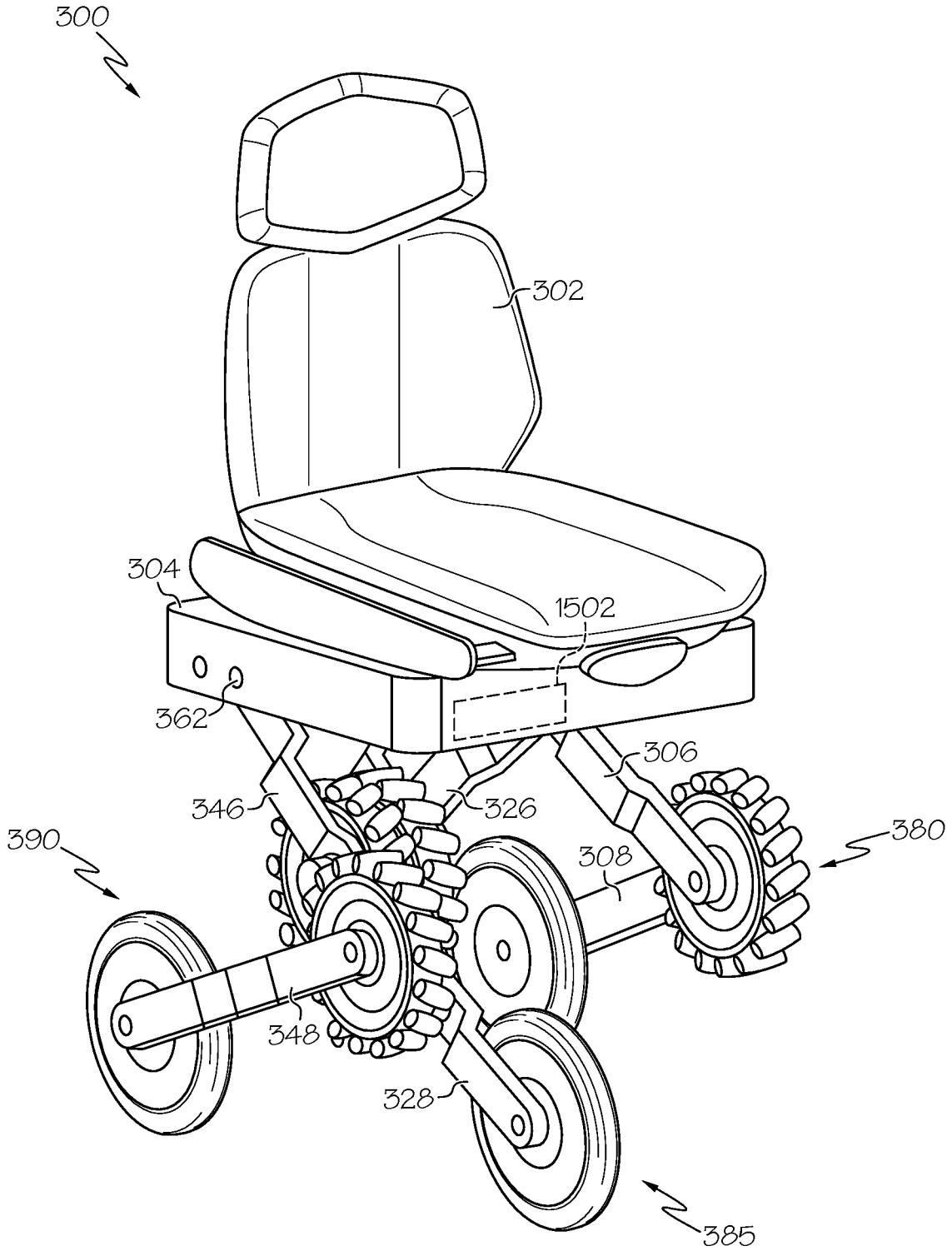
FIG. 1A depicts an illustrative perspective view of a wheelchair assembly having a plurality of leg modules each including an upper leg assembly and a lower leg assembly according to one or more embodiments shown and described herein.
Figure 1B:
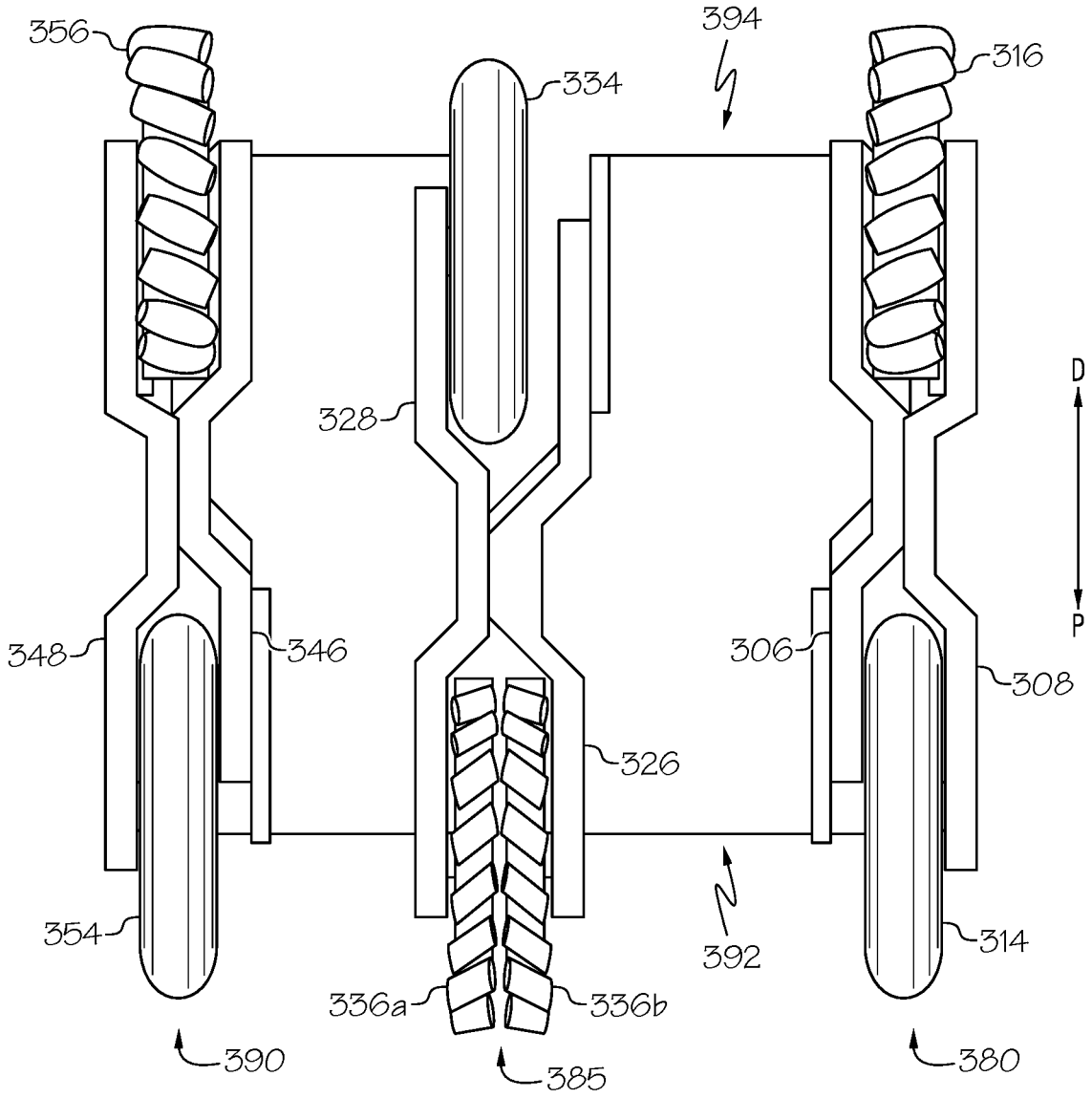
FIG. 1B depicts an illustrative bottom-up view of the plurality of leg modules of FIG. 1A according to one or more embodiments shown and described herein.

FIG. 1A depicts an illustrative wheelchair assembly 300 having a plurality of leg modules (e.g., a first leg module 380, a second leg module 385, and a third leg module 390) according to one or more embodiments described herein. The wheelchair assembly 300 may further include a seat 302 and a power base 304. The power base 304 may include a control device 1502 (shown in phantom, e.g., a processor and/or the like) to control movement of the leg modules 380, 385, 390 and components thereof and/or to transition the leg modules 380, 385, 390 between various modes of operation, as described herein. FIG. 1B depicts an illustrative bottom-up view of the plurality of leg modules of FIG. 1A according to one or more embodiments shown and described herein. In view of FIGS. 1A and 1B, the first leg module 380 may include an upper leg assembly 306 rotatably coupled to a lower leg assembly 308. The lower leg assembly 308 may include at least two wheels 314, 316. According to various aspects of the present disclosure, the wheels 314, 316 may be omni-directional wheels or standard wheels. As described herein, a standard wheel may include any wheel configured to move in a forward or distal "D" direction and/or a reverse or proximal "P" direction (e.g., uni-directional or bi-directional) and an omni-directional wheel may include any wheel that enables omni-directional movement (e.g., a mecanum wheel, an omni-wheel, a caster, and/or the like). In FIG. 1B, wheel 314 is a standard wheel and wheel 316 is a mecanum wheel. In a similar manner, the second leg module 385 may include an upper leg assembly 326 rotatably coupled to a lower leg assembly 328. The lower leg assembly 328 may include at least two wheels 334, 336*a*, 336*b*. According to various aspects of the present disclosure, the wheels 334, 336*a*, 336*b* may be omni-directional wheels or standard wheels. In FIG. 1B, wheel 334 is a standard wheel and wheels 336*a* and 336*b* are mecanum wheels. Further, in a similar manner, the third leg module 390 may include an upper leg assembly 346 rotatably coupled to a lower leg assembly 348. The lower leg assembly 348 may include at least two wheels 354, 356. According to various aspects of the present disclosure, the wheels 354, 356 may be omni-directional wheels or standard wheels. In FIG. 1B, wheel 354 is a standard wheel and the wheels 356 is a mecanum wheel.

Although the wheelchair assembly 300 of FIGS. 1A and 1B includes three leg modules, it should be understood that the wheelchair assembly 300 may alternatively include more than three leg modules (e.g., four leg modules, five leg modules, and/or the like). However, the wheelchair assembly 300 of FIGS. 1A and 1B does not include few than three leg modules The leg modules 380, 385, 390 of FIGS. 1A and 1B may realize multiple functionalities of the wheelchair assembly 300. According to various aspects, the leg modules 380, 385, 390 may drive the wheelchair assembly 300, may raise and/or lower various components (e.g., seat 302, power base 304, and/or the like) of the wheelchair assembly 300, may balance or support or stabilize the various components of the wheelchair assembly 300, may steer the wheelchair assembly 300, and/or the like.

According to various aspects, each leg module 380, 385, 390 may be coupled to the power base 304 via each respective upper leg assembly 306, 326, 346. Viewing FIG. 1B in light of FIG. 1A, each of the upper leg assembly 306 of the first leg module 380 and the upper leg assembly 346 of the third leg module 390, respectively may rotatably couple to a proximal portion 392 of the power base 304 and extend distally at an angle relative to the power base 304. Further, viewing FIG. 1B in light of FIG. 1A, the upper leg assembly 326 of the second leg module 385 may rotatably couple to a distal portion 394 of the power base 304 and extend proximally at an angle relative to the power base 304. According to an alternative aspect (not shown), each respective upper leg assembly 306, 326, 346 may couple to a proximal portion of the power base 304 and extend distally at an angle relative to the power base 304. According to another alternative aspect (not shown), each respective upper leg assembly 306, 326, 346 may couple to a distal portion of the power base 304 and extend proximally at an angle relative to the power base 304.

Each upper leg assembly 306, 326, 346 may be actuated independently, consecutively, or simultaneously (e.g., in synchronization with) as another upper leg assembly. According to various embodiments, each upper leg assembly 306, 326, 346 may be actuated independently, consecutively, or simultaneously as another upper leg assembly based on a selected mode of operation associated with the wheelchair assembly 300 (e.g., rear-wheel drive (RWD) mode, front-wheel drive (FWD) mode, mid-wheel drive (MWD) mode, and/or omni-wheel drive (OWD) mode), as discussed herein. Similarly, each lower leg assembly 308, 328, 348 may be actuated independently, consecutively, or simultaneously (e.g., in synchronization with) as another lower leg assembly. According to various embodiments, each lower leg assembly 308, 328, 348 may be actuated independently, consecutively, or simultaneously as another lower leg assembly based on a selected mode of operation associated with the wheelchair assembly 300 (e.g., rear-wheel drive (RWD) mode, front-wheel drive (FWD) mode, mid-wheel drive (MWD) mode, and/or omni-wheel drive (OWD) mode), as discussed herein.

Figure 2A:
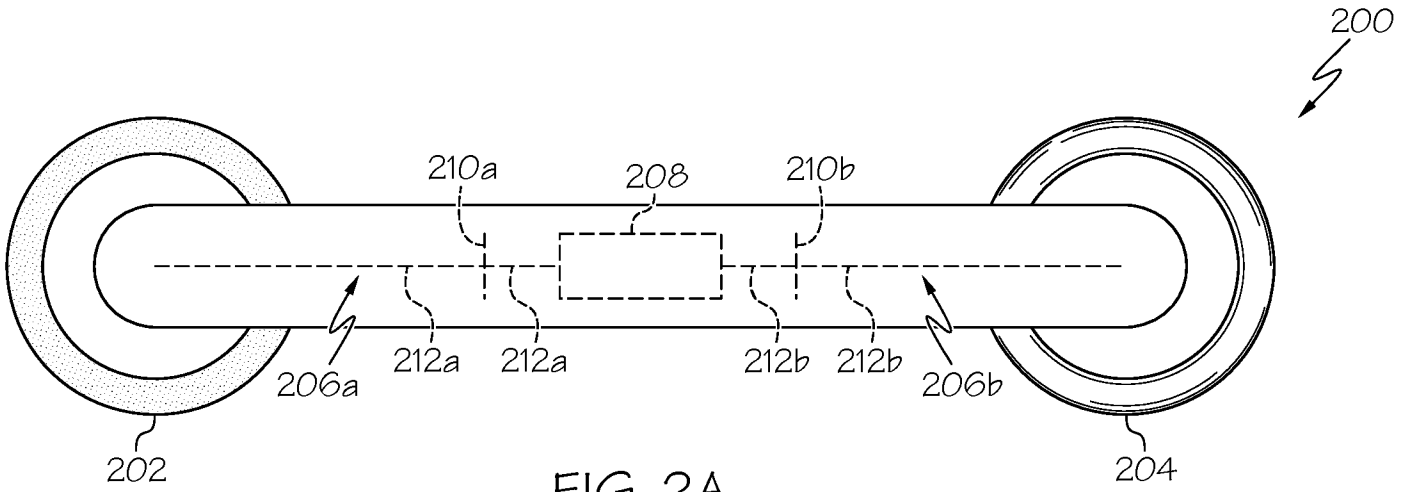
FIG. 2A depicts an illustrative lower leg assembly of a leg module having a drive train arrangement according to one or more embodiments shown and described herein.

Referring to FIG. 2A, according to various aspects, each leg module as described herein may include a lower leg assembly 200 having at least two wheels 202, 204 and at least one drive train 206*a*, 206*b* for selectively applying rotary motion from a motor 208 of the lower leg assembly 200 to either or both of the wheels 202, 204. According to various aspects, the drive train 206*a* may include one or more of a clutch 210*a* and a drive element 212*a* (e.g., a drive belt, a drive shaft, gears, and/or the like). Similarly, the drive train 206*b* may include one or more of a clutch 210*b* and a drive element 212*b* (e.g., a drive belt, a drive shaft, gears, and/or the like). According to various aspects, the clutch may shift between a plurality of modes, including, but not limited to, a neutral mode, a knee-wheel powered mode, a foot-wheel powered mode, and a bi-wheel powered mode (e.g., a knee-wheel and foot-wheel powered mode). According to some aspects, either or both of the wheels 202, 204 may be an omni-directional wheel. According to other aspects, either or both of the wheels 202, 204 may be a standard (e.g., bi-directional) wheel. In the example aspect of FIG. 2A, wheel 202 is an omni-directional wheel (e.g., stipple shaded) and wheel 204 is a standard (e.g., bi-directional) wheel (e.g., lined, not stipple shaded).

Figure 2B:
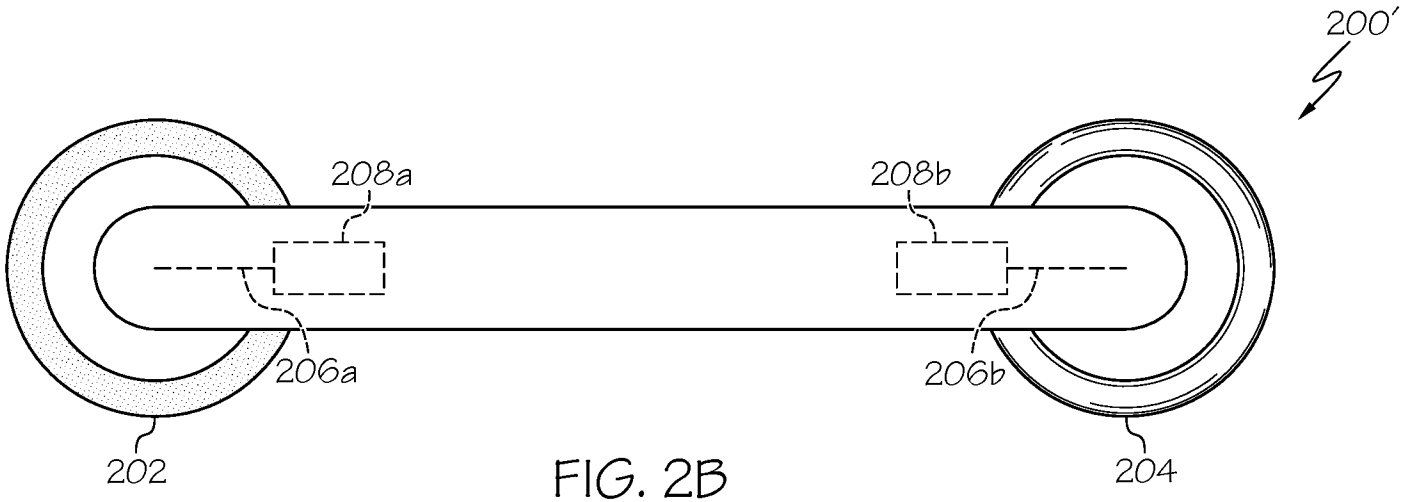
FIG. 2B depicts an illustrative lower leg assembly of a leg module having an alternative drive train arrangement according to one or more embodiments shown and described herein.

Referring to FIG. 2B, according to an alternative aspect, a motor 208*a*, 208*b* may be positioned at or proximate to each wheel 202, 204 of a lower leg assembly 200'. According to such an aspect, a drive train 206*a*, 206*b* (e.g., similar to as described in FIG. 2A) coupled to each respective wheel 202, 204 may selectively apply rotary motion from each respective motor 208*a*, 208*b* to each respective wheel 202, 204. According to an alternative aspect (not shown) each motor 208*a*, 208*b* may directly drive each wheel 202, 204 without a drive train. According to some aspects, either or both of the wheels 202, 204 may be an omni-directional wheel. According to other aspects, either or both of the wheels 202, 204 may be a standard (e.g., bi-directional) wheel. In the example aspect of FIG. 2B, wheel 202 is an omni-directional wheel (e.g., stipple shaded) and wheel 204 is a standard (e.g., bi-directional) wheel (e.g., lined, not stipple shaded).

Figure 3B:
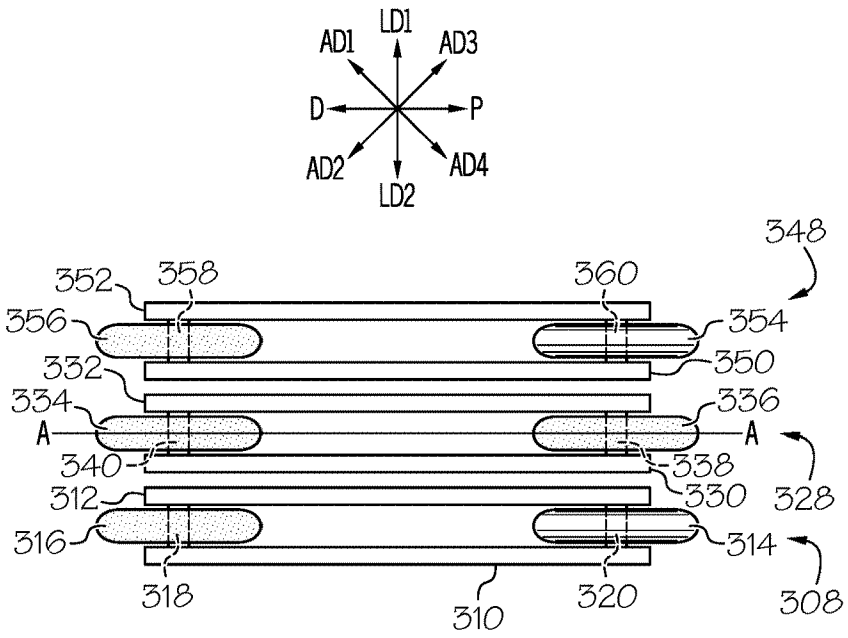
FIG. 3B depicts an illustrative top-down view (e.g., along axis B-B of FIG. 3A) of respective lower leg assemblies associated with a first leg module, a second leg module, and a third leg module in the front-wheel drive mode or the rear wheel drive mode configuration according to one or more embodiments shown and described herein.
Figure 3A:
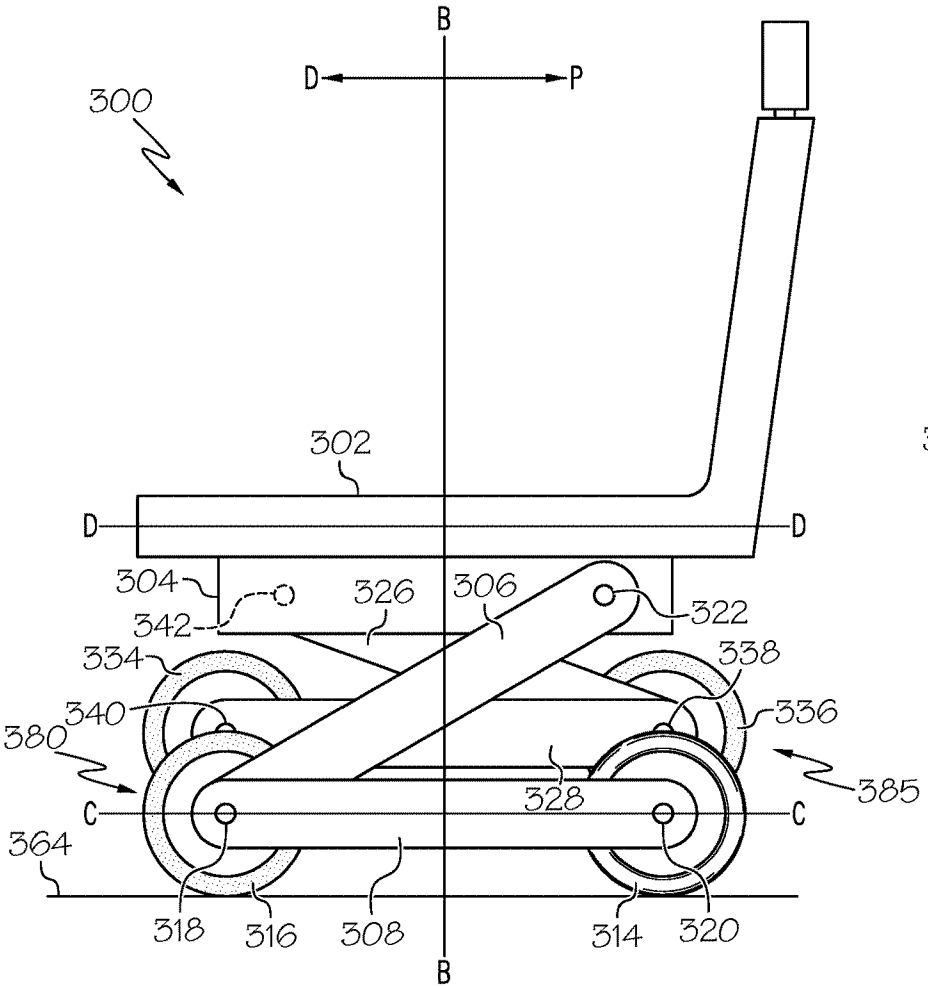
FIG. 3A depicts an illustrative wheelchair assembly having a plurality of leg modules in a front-wheel drive mode or a rear wheel drive mode configuration according to one or more embodiments shown and described herein.

While FIG. 1B illustrates a bottom view of the leg modules 380, 385, 390, according to various aspects of the present disclosure, FIG. 3B illustrates a top view of the various leg modules when the wheelchair assembly 300 is oriented as illustrated in FIG. 3A. Furthermore, FIG. 3B illustrates an alternative embodiment (e.g., a two-bracket embodiment) of the lower leg assembly 308, the lower leg assembly 328, and the lower leg assembly 348. The one-bracket lower leg assembly embodiments of FIGS. 1A and 1B and the two-bracket lower leg assembly embodiments of FIG. 3B are non-limiting in the present disclosure.

In view of FIG. 3B, the lower leg assembly 308 of first leg module 380 may include a first leg bracket 310 (e.g., outer, laterally-facing bracket relative to central axis A-A) and a second leg bracket 312 (e.g., inner, laterally-facing bracket relative to the central axis A-A) A foot wheel 314 and a knee wheel 316 may each be positioned between and rotatably coupled to the first leg bracket 310 and the second leg bracket 312. According to alternative aspects, the foot wheel 314 and the knee wheel 316 may each be rotatably coupled to one side of the first leg bracket 310 or the second leg bracket 312. In such alternative aspects, the first leg module 380 may include only one of the first leg bracket 310 or the second leg bracket 312 (e.g., see FIGS. 1A and 1B). In view of FIG. 3B, according to various aspects, the knee wheel 316 may be referenced as the "knee" wheel as it is positioned at a distal portion (e.g., in the "D" direction of the coordinate axes of FIG. 3B) of the lower leg assembly 308 at pivotable knee joint 318. Similarly, the foot wheel 314 may be referenced as the "foot" wheel as it is positioned at a proximal portion (e.g., in the "P" direction of the coordinate axes of FIG. 3B) of the lower leg assembly 308 at foot joint 320. According to various aspects described herein, the knee wheel 316 associated with first leg module 380 may be an omni-directional wheel (e.g., stipple shaded) and the foot wheel 314 associated with first leg module 380 may be a standard wheel (e.g., lined, not stipple shaded).

Similarly, referring again to FIG. 3B, the lower leg assembly 328 of second leg module 385 may include a first leg bracket 330 (e.g., outer, laterally-facing bracket relative to central axis A-A) and a second leg bracket 332 (e.g., outer, laterally-facing bracket relative to central axis A-A). A foot wheel 334 and a knee wheel 336 may each be positioned between and rotatably coupled to the first leg bracket 330 and the second leg bracket 332. According to alternative aspects, the foot wheel 334 and the knee wheel 336 may each be rotatably coupled to one side of the first leg bracket 330 or the second leg bracket 332. In such alternative aspects, the second leg module 385 may include only one of the first leg bracket 330 or the second leg bracket 332 (e.g. see FIGS. 1A and 1B). Referring to FIG. 3A, as discussed herein, the upper leg assembly 326 of the second leg module 385 may couple to a distal portion of the power base 304 and may extend proximally at an angle relative to the power base 304. In such an aspect, the knee wheel 336 may be referenced as the "knee" wheel as it is positioned at a proximal portion (e.g., in the "P" direction of the coordinate axes of FIG. 3B) of the lower leg assembly 328 at pivotable knee joint 338. Similarly, the foot wheel 334 may be referenced as the "foot" wheel as it is positioned at a distal portion (e.g., in the "D" direction of the coordinate axes of FIG. 3B) of the lower leg assembly 328 at foot joint 340. According to various aspects described herein, the knee wheel 336 associated with second leg module 385 may be an omni-directional wheel (e.g., stipple shaded) and the foot wheel 334 associated with second leg module 385 may also be an omni-directional wheel (e.g., stipple shaded). According to an alternative aspect, the knee wheel 336 associated with second leg module 385 may be at least one omni-directional wheel (see FIG. 1B, references 336*a* and 336*b*) and the foot wheel 334 associated with second leg module 385 may be a standard wheel (see FIG. 1B, e.g., lined, not stipple shaded).

Yet further, in a similar manner, the lower leg assembly 348 of third leg module 390 may include a first leg bracket 350 (e.g., inner, laterally-facing bracket relative to central axis A-A) and a second leg bracket 352 (e.g., outer, laterally-facing bracket relative to the central axis A-A). A foot wheel 354 and a knee wheel 356 may each be positioned between and rotatably coupled to the first leg bracket 350 and the second leg bracket 352. According to alternative aspects, the foot wheel 354 and the knee wheel 356 may each be rotatably coupled to one side of the first leg bracket 350 or the second leg bracket 352. In such alternative aspects, the third leg module 390 may include only one of the first leg bracket 350 or the second leg bracket 352 (e.g., see FIGS. 1A and 1B). According to various aspects, the knee wheel 356 may be referenced as the "knee" wheel as it is positioned at a distal portion (e.g., in the "D" direction of the coordinate axes of FIG. 3B) of the lower leg assembly 348 at pivotable knee joint 358. Similarly, the foot wheel 354 may be referenced as the "foot" wheel as it is positioned at a proximal portion (e.g., in the "P" direction of the coordinate axes of FIG. 3B) of the lower leg assembly 348 at foot joint 360. According to various aspects described herein, the knee wheel 356 associated with third leg module 390 may be an omni-directional wheel (e.g., stipple shaded) and the foot wheel 354 associated with third leg module 390 may be a standard wheel (e.g., lined, not stipple shaded).

Actuatable Leg Modules

According to various embodiments, each leg module 380, 385, 390 may include components arranged to move each respective leg module 380, 385, 390 and/or elements of each leg module 380, 385, 390.

According to various aspects described herein, the upper leg assembly 306 and/or the lower leg assembly 308 of first leg module 380 may include elements actuatable to raise and/or lower the lower leg assembly 308. According to various aspects, the actuatable elements may include a cable system, a linkage system, a hydraulic system, a gear system, motors (e.g., servomotors, stepper motors), and/or the like. Similarly, the upper leg assembly 326 and/or the lower leg assembly 328 of second leg module 385 may include elements actuatable to raise and/or lower the lower leg assembly 328. According to various aspects, the actuatable elements may include a cable system, a linkage system, a hydraulic system, a gear system, motors (e.g., servomotors, stepper motors), and/or the like. Yet further, in a similar manner, the upper leg assembly 346 and/or the lower leg assembly 348 of third leg module 390 may include elements actuatable to raise and/or lower the lower leg assembly 348. According to various aspects, the actuatable elements may include a cable system, a linkage system, a hydraulic system, a gear system, motors (e.g., servomotors, stepper motors), and/or the like. Numerous components arranged to actuate each respective leg module 380, 385, 390 and/or elements of each leg module 380, 385, 390 beyond those described herein should be generally understood and are included within the scope of the present disclosure.

According to various aspects described herein, the upper leg assembly 306 and/or the lower leg assembly 308 of first leg module 380 may define an enclosure to house and/or to mount elements (e.g., motors and/or drive trains as described in FIGS. 2A and 2B herein, electrical wires supplying power and/or control signals to the motors, and/or the like) to selectively raise, lower, and/or power the wheels 314 and/or 316. Similarly, the upper leg assembly 326 and/or the lower leg assembly 328 of second leg module 385 may define an enclosure to house and/or to mount elements (e.g., motors and/or drive trains as described in FIGS. 2A and 2B herein, electrical wires supplying power and/or control signals to the motors, and/or the like) to selectively raise, lower and/or power the wheels 334 and/or 336. Yet further, in a similar manner, the upper leg assembly 346 and/or the lower leg assembly 348 of third leg module 390 may define an enclosure to house and/or to mount elements (e.g., motors and/or drive trains as described in FIGS. 2A and 2B herein, electrical wires supplying power and/or control signals to the motors, and/or the like) to selectively raise, lower and/or power the wheels 354 and/or 356. However, the present disclosure is not limited to such and it should be understood that the elements may be housed, mounted, attached, and/or the like by other means.

Hip Pivot Movements

In view of FIG. 3A, according to various aspects, upper leg assembly 306 of first leg module 380 may be selectively rotatable about hip pivot 322 in a first direction (e.g., clockwise) to raise at least one of the knee wheel 316 or the foot wheel 314 (e.g., with further counter-rotation of the lower leg module 308) off of a surface 364 (e.g., ground, floor, and/or the like) and may be selectively rotatable about the hip pivot 322 in a second direction (e.g., counter-clockwise) to position at least one of the knee wheel 316 or the foot wheel 314 (e.g., with further counter-rotation of the lower leg module 308) in contact with the surface 364. According to further aspects, upper leg assembly 306 may be selectively rotatable about hip pivot 322 in a first direction (e.g., clockwise) to advance the foot wheel 314 from a proximal "P" position relative to axis B-B toward a distal "D" position relative to axis B-B (see FIG. 3A) and may be selectively rotatable about hip pivot 322 in a second direction (e.g., counter-clockwise) to retreat the foot wheel 314 from a distal "D" position relative to axis B-B toward a proximal "P" position relative to axis B-B (see FIG. 3A). According to various aspects, upper leg assembly 306 is rotatable about the hip pivot 322 via a rotating mechanism (e.g., a motor, gears, and/or the like), within the power base 304, coupled to the upper leg assembly 306.

Similarly, the upper leg assembly 326 of second leg module 385 may be selectively rotatable about hip pivot 342 in a first direction (e.g., counter-clockwise) to raise at least one of the knee wheel 336 or the foot wheel 334 (e.g., with further counter-rotation of the lower leg module 328) off of a surface 364 (e.g., ground, floor, and/or the like) and may be selectively rotatable about the hip pivot 342 in a second direction (e.g., clockwise) to position at least one of the knee wheel 336 or the foot wheel 334 (e.g., with further counter-rotation of the lower leg module 328) in contact with the surface 364. According to further aspects, upper leg assembly 326 may be selectively rotatable about hip pivot 342 in a first direction (e.g., counter-clockwise) to advance the foot wheel 334 from a distal "D" position relative to axis B-B toward a proximal "P" position relative to axis B-B (see FIG. 3A) and may be selectively rotatable about hip pivot 342 in a second direction (e.g., clockwise) to retreat the foot wheel 334 from a proximal "P" position relative to axis B-B toward a distal "D" position relative to axis B-B (see FIG. 3A. According to various aspects, upper leg assembly 326 is rotatable about the hip pivot 342 via a rotating mechanism (e.g., a motor, gears, and/or the like), within the power base 304, coupled to the upper leg assembly 326.

Yet further, in a manner similar to first leg module 380 as described above, the upper leg assembly 346 of third leg module 390 may be selectively rotatable about hip pivot 362 (FIG. 1A) in a first direction (e.g., clockwise) to raise at least one of the knee wheel 356 or the foot wheel 354 (e.g., with further counter-rotation of the lower leg module 348) off of a surface 364 (e.g., ground, floor, and/or the like) and may be selectively rotatable about the hip pivot 362 in a second direction (e.g., counter-clockwise) to position at least one of the knee wheel 356 or the foot wheel 354 (e.g., with further counter-rotation of the lower leg module 328) in contact with the surface 364. According to further aspects, upper leg assembly 346 may be selectively rotatable about hip pivot 362 in a first direction (e.g., clockwise) to advance the foot wheel 354 from a proximal "P" position relative to axis B-B toward a distal "D" position relative to axis B-B (see FIG. 3A) and may be selectively rotatable about hip pivot 362 in a second direction (e.g., counter-clockwise) to retreat the foot wheel 334 from a distal "D" position relative to axis B-B toward a proximal "P" position relative to axis B-B (see FIG. 3A). According to various aspects, upper leg assembly 346 is rotatable about the hip pivot 362 via a rotating mechanism (e.g., a motor, gears, and/or the like), within the power base 304, coupled to the upper leg assembly 346.

Knee Joint Movements

Further in view of FIG. 3A, according to various aspects, lower leg assembly 308 of first leg module 380 may be selectively rotatable about knee joint 318 in a first direction (e.g., counter-clockwise) to raise the foot wheel 314 off of a surface 364 (e.g., ground, floor, and/or the like) and may be selectively rotatable about knee joint 318 in a second direction (e.g., clockwise) to position the foot wheel 314 in contact with the surface 364. According to further aspects, lower leg assembly 308 may be selectively rotatable about knee joint 318 in a first direction (e.g., counter-clockwise) while upper leg assembly 306 is selectively rotated about hip pivot 322 in a second direction (e.g., clockwise) to raise at least one of the knee wheel 316 or the foot wheel 314 off of a surface 364 (e.g., ground, floor, and/or the like) or to lower the seat 302 of the wheelchair assembly 300 toward the surface 364. Such rotation of the lower leg assembly 308 about knee joint 318 may enable the first leg bracket 310 and/or the second leg bracket 312 of the lower leg assembly 308 to remain substantially parallel (e.g., to axis C-C depicted in FIG. 3A) to the surface 364 as the at least one of the knee wheel 316 or the foot wheel 314 is raised off of the surface 364 or enable the seat 302 to remain substantially parallel (e.g., to axis D-D depicted in FIG. 3A) to the surface 364 as the seat 302 of the wheelchair assembly 300 is lowered toward the surface 364. In a similar way, lower leg assembly 308 may be selectively rotatable about knee joint 318 in a second direction (e.g., clockwise) while upper leg assembly 306 is selectively rotated about hip pivot 322 in a second direction (e.g., counter-clockwise) to position the at least one of the knee wheel 316 or the foot wheel 314 in contact with the surface 364 or to raise the seat 302 of the wheelchair assembly 300 away from the surface 364. Such rotation of the lower leg assembly 308 about knee joint 318 may enable the first leg bracket 310 and/or the second leg bracket 312 of the lower leg assembly 308 to remain substantially parallel (e.g., to axis C-C depicted in FIG. 3A) to the surface 364 as the at least one of the knee wheel 316 or the foot wheel 314 is positioned in contact with the surface 364 or enable the seat 302 to remain substantially parallel (e.g., to axis D-D depicted in FIG. 3A) to the surface 364 as the seat 302 of the wheelchair assembly 300 is raised away from the surface 364.

Similarly, lower leg assembly 328 of second leg module 385 may be selectively rotatable about knee joint 338 in a first direction (e.g., clockwise) to raise the foot wheel 334 off of a surface 364 (e.g., ground, floor, and/or the like) and may be selectively rotatable about knee joint 338 in a second direction (e.g., counter-clockwise) to position the foot wheel 334 in contact with the surface 364. According to further aspects, lower leg assembly 328 may be selectively rotatable about knee joint 338 in a first direction (e.g., clockwise) while upper leg assembly 326 is selectively rotated about hip pivot 342 in a first direction (e.g., counter-clockwise) to raise at least one of the knee wheel 336 or the foot wheel 334 off of a surface 364 (e.g., ground, floor, and/or the like) or to lower the seat 302 of the wheelchair assembly 300 toward the surface 364. Such rotation of the lower leg assembly 328 about knee joint 338 may enable the first leg bracket 330 and/or the second leg bracket 332 of the lower leg assembly 328 to remain substantially parallel (e.g., to axis C-C depicted in FIG. 3A) to the surface 364 as the at least one of the knee wheel 336 or the foot wheel 334 is raised off of the surface 364 or enable the seat 302 to remain substantially parallel (e.g., to axis D-D depicted in FIG. 3A) to the surface 364 as the seat 302 of the wheelchair assembly 300 is lowered toward the surface 364. In a similar way, lower leg assembly 328 may be selectively rotatable about knee joint 338 in a second direction (e.g., counter-clockwise) while upper leg assembly 326 is selectively rotated about hip pivot 342 in a second direction (e.g., clockwise) to position the at least one of the knee wheel 336 or the foot wheel 334 in contact with the surface 364 or to raise the seat 302 of the wheelchair assembly 300 away from the surface 364. Such rotation of the lower leg assembly 328 about knee joint 338 may enable the first leg bracket 330 and/or the second leg bracket 332 to remain substantially parallel (e.g., to axis C-C depicted in FIG. 3A) to the surface 364 as the at least one of the knee wheel 336 or the foot wheel 334 is positioned in contact with the surface 364 or enable the seat 302 to remain substantially parallel (e.g., to axis D-D depicted in FIG. 3A) to the surface 364 as the seat 302 of the wheelchair assembly 300 is raised away from the surface 364.

Yet further, in a manner similar to first leg module 380 as described above, lower leg assembly 348 of third leg module 390 may be selectively rotatable about knee joint 358 in a first direction (e.g., counter-clockwise) to raise the foot wheel 354 off of a surface 364 (e.g., ground, floor, and/or the like) and may be selectively rotatable about knee joint 358 in a second direction (e.g., clockwise) to position the foot wheel 354 in contact with the surface 364. According to further aspects, lower leg assembly 348 may be selectively rotatable about knee joint 358 in a first direction (e.g., counter-clockwise) while upper leg assembly 346 is selectively rotated about hip pivot 362 in a first direction (e.g., clockwise) to raise at least one of the knee wheel 356 or the foot wheel 354 off of a surface 364 (e.g., ground, floor, and/or the like) or to lower the seat 302 of the wheelchair assembly 300 toward the surface 364. Such rotation of the lower leg assembly 348 about knee joint 358 may enable the first leg bracket 350 and/or the second leg bracket 352 of the lower leg assembly 348 to remain substantially parallel (e.g., to axis C-C depicted in FIG. 3A) to the surface 364 as the at least one of the knee wheel 356 or the foot wheel 354 is raised off of the surface 364 or enable the seat 302 to remain substantially parallel (e.g., to axis D-D depicted in FIG. 3A) to the surface 364 as the seat 302 of the wheelchair assembly 300 is lowered toward the surface 364. In a similar way, lower leg assembly 348 may be selectively rotatable about knee joint 358 in a second direction (e.g., clockwise) while upper leg assembly 346 is selectively rotated about hip pivot 362 in a second direction (e.g., counter clockwise) to position the at least one of the knee wheel 356 or the foot wheel 354 in contact with the surface 364 or to raise the seat 302 of the wheelchair assembly 300 away from the surface 364. Such rotation of the lower leg assembly 348 about knee joint 358 may enable the first leg bracket 350 and/or the second leg bracket 352 to remain substantially parallel (e.g., to axis C-C depicted in FIG. 3A) to the surface 364 as the at least one of the knee wheel 356 or the foot wheel 354 is positioned in contact with the surface 364 or enable the seat 302 to remain substantially parallel (e.g., to axis D-D depicted in FIG. 3A) to the surface 364 as the seat 302 of the wheelchair assembly 300 is raised away from the surface 364.

Driving Wheelchair Assembly Wheels

Figure 11:
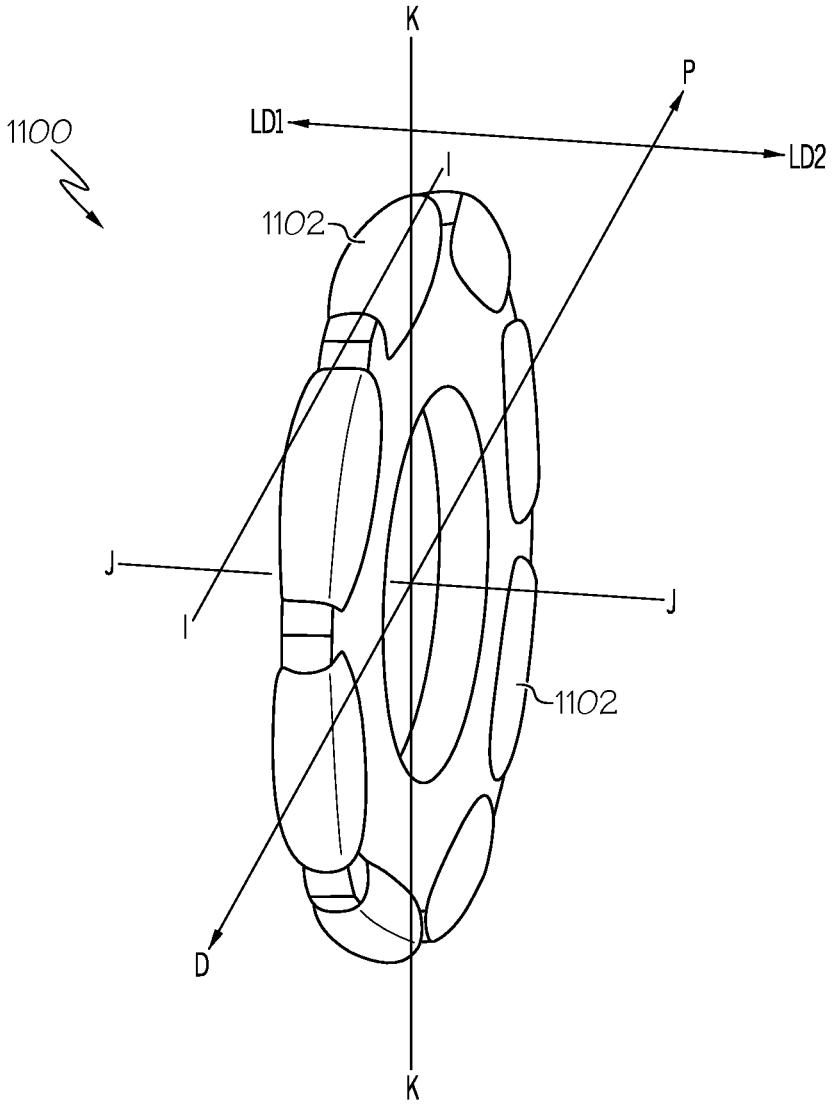
FIG. 11 depicts an illustration of an omni-wheel according to one or more embodiments shown and described herein.

Referring back to FIGS. 2A and 2B, in light of FIG. 3A, employing a drive train having a clutch enables selective driving or powering of a wheelchair assembly 300 including the plurality of leg modules 380, 385, 390. Referring to FIGS. 3A and 3B, the wheels 314 and/or 316 of first leg module 380, the wheels 334 and/or 336 of second leg module 385, and/or the wheels 354 and/or 356 of third leg module 390 may be selectively engaged to drive or power the wheelchair assembly 300 on demand as required to improve maneuverability of the wheelchair assembly 300. Referring to FIG. 3A, according to various aspects described herein, driving or powering a wheel (e.g., a standard wheel, an omni-directional wheel, and/or the like) may refer to rotating the wheel in a first direction (e.g., counter-clockwise) to move or propel the wheelchair assembly 300 forward or distally (e.g., in the "D" direction of the coordinate axes of FIG. 3B), rotating the wheel in a second direction (e.g., clockwise) to move or propel the wheelchair assembly 300 backward or proximally (e.g., in the "P" direction of the coordinate axes of FIG. 3B), rotating a plurality of rollers positioned circumferentially about a wheel (e.g., an omni-wheel as depicted in FIG. 11 herein and/or the like) in a first direction (see FIG. 11, e.g., counter-clockwise about axis I-I that is perpendicular to an axis of the wheel J-J) to move or propel the wheelchair assembly 300 in rightward or a first lateral direction (e.g., in the "LD1" direction of the coordinate axes of FIG. 3B), rotating the plurality of rollers positioned circumferentially about the wheel in a second direction (see FIG. 11, e.g., clockwise about the axis I-I that is perpendicular to the axis of the wheel J-J) to move or propel the wheelchair assembly 300 in leftward or a second lateral direction (e.g., in the "LD2" direction of the coordinate axes of FIG. 3B), rotating the plurality of rollers positioned circumferentially about the wheel in a first direction (see FIG. 11, e.g., counter-clockwise about axis K-K that is perpendicular to its axis of rotation I-I) and then rotating the plurality of rollers positioned circumferentially about the wheel in a first direction (e.g., counter-clockwise) to move or propel the wheelchair assembly 300 in any first general direction (e.g., an "AD1" direction of the coordinate axes of FIG. 3B) between the distal direction (e.g., the "D" direction of the coordinate axes of FIG. 3B) and the first lateral direction (e.g., the "LD1" direction of the coordinate axes of FIG. 3B), rotating the plurality of rollers positioned circumferentially about the wheel in a second direction (see FIG. 11, e.g., clockwise about the axis K-K that is perpendicular to the axis of rotation I-I) and then rotating the plurality of rollers positioned circumferentially about the wheel in a second direction (e.g., clockwise) to move or propel the wheelchair assembly 300 in any second general direction (e.g., an "AD2" direction of the coordinate axes of FIG. 3B) between the distal direction (e.g., the "D" direction of the coordinate axes of FIG. 3B) and the second lateral direction (e.g., the "LD2" direction of the coordinate axes of FIG. 3B), rotating the plurality of rollers positioned circumferentially about the wheel in the second direction (see FIG. 11, e.g., clockwise about the axis K-K that is perpendicular to the axis of rotation I-I) and then rotating the plurality of rollers positioned circumferentially about the wheel in the first direction (e.g., counter-clockwise) to move or propel the wheelchair assembly 300 in any third general direction (e.g., an "AD3" direction of the coordinate axes of FIG. 3B) between a proximal direction (e.g., the "P" direction of the coordinate axes of FIG. 3B) and the first lateral direction (e.g., the "LD1" direction of the coordinate axes of FIG. 3B), rotating the plurality of rollers positioned circumferentially about the wheel in the first direction (see FIG. 11, e.g., counter-clockwise about the axis K-K that is perpendicular to the axis of rotation I-I) and then rotating the plurality of rollers positioned circumferentially about the wheel in a second direction (e.g., clockwise) to move or propel the wheelchair assembly 300 in any fourth general direction (e.g., an "AD4" direction of the coordinate axes of FIG. 3B) between the proximal direction (e.g., the "P" direction of the coordinate axes of FIG. 3B) and the second lateral direction (e.g., the "LD2" direction of the coordinate axes of FIG. 3B), and/or the like. According to various aspects, the circumferential rollers (see FIG. 11, e.g., of an omni-wheel, as described above and herein) may be actively driven to move or propel the wheelchair assembly 300 in the directions of the coordinate axes of FIG. 3B. According to alternative aspects, some of the circumferential rollers may be actively driven while others of the circumferential rollers may be passively driven to move or propel the wheelchair assembly 300 in the directions of the coordinate axes of FIG. 3B. According to further aspects, circumferential rollers (see FIG. 7, e.g., of a mecanum wheel) may be passively driven to move or propel the wheelchair assembly 300 in the directions of the coordinate axes of FIG. 3B. As described in more detail herein, rotating a mecanum wheel in a first direction (e.g., clockwise) while rotating one or more other mecanum wheels in another direction (e.g., clockwise or counterclockwise), in combination, move or propel the wheelchair assembly 300 in the directions of the coordinate axes of FIG. 3B. Similarly, rotating the mecanum wheel in a second direction (e.g., counter-clockwise) while rotating one or more other mecanum wheels in another direction (e.g., clockwise or counterclockwise), in combination, move or propel the wheelchair assembly 300 in the directions of the coordinate axes of FIG. 3B.

Modes of Operation

According to various described embodiments, by selectively raising particular wheels (e.g., via leg modules 380, 385, and/or 390), by selectively lowering particular wheels (e.g., via leg modules 380, 385, and/or 390) and/or by selectively driving particular wheels (e.g., any of the wheels described in FIGS. 3A and 3B above), the same wheelchair assembly 300 (e.g., of FIG. 3A) can be shifted or transitioned, on demand, between a rear-wheel drive ("RWD") mode, a front-wheel drive ("FWD") mode, a mid-wheel drive ("MWD") mode, and/or an omni-wheel drive ("OWD") mode. According to various aspects, the wheelchair assembly 300 may be manually shifted or transitioned between the rear-wheel drive ("RWD") mode, the front-wheel drive ("FWD") mode, the mid-wheel drive ("MWD") mode, and/or the omni-wheel drive ("OWD") mode. According to other aspects, the wheelchair assembly 300 may be automatically shifted or transitioned between the rear-wheel drive ("RWD") mode, the front-wheel drive ("FWD") mode, the mid-wheel drive ("MWD") mode, and/or the omni-wheel drive ("OWD") mode. According to various aspects, the wheelchair assembly 300 may be further shifted or transitioned, on demand (e.g., manually and/or automatically) into a four-wheel drive ("4WD") mode and/or an all-wheel drive ("AWD") mode, as described herein.

Rear-Wheel Drive Operating Mode

As illustrated in FIG. 3A, the wheelchair assembly 300 may include a rear-wheel drive operating mode ("RWD mode"). According to various aspects, the RWD mode may be a standard or default mode of operation. In the RWD mode, the wheelchair assembly 300 may include a first leg module 380, a second leg module 385, and a third leg module 390. In such an aspect, each of the first leg module 380 and the third leg module 390 may include an omni-directional wheel at their respective knee joints 318, 358 and a standard (e.g., bi-directional) wheel at their respective foot joints 320, 360. In the RWD mode, the foot wheel 314 and the knee wheel 316 of the first leg module 380 and the foot wheel 354 and the knee wheel 356 of the third leg module 390 are selectively positioned in contact with a surface 364. According to various aspects, in the RWD mode, the foot wheel 334 and the knee wheel 336 of the second leg module 385 (e.g., including an omni-directional wheel at both its knee joint 338 and its foot joint 340 respectively) may be selectively raised off of the surface 364 (see e.g., FIG. 3A). Such an arrangement may lessen frictional losses during the driving and/or turning of the wheelchair assembly 300.

In view of FIG. 3B, in the RWD mode, the standard wheel as the foot wheel 314 may be driven by a motor (see FIGS. 2A and 2B) associated with first leg module 380 and the standard wheel as the foot wheel 354 may be driven by a motor (see FIGS. 2A and 2B) associated with third leg module 390 to move or propel the wheelchair assembly 300. According to various embodiments, the omni-directional wheel as the knee wheel 316 and/or the omni-directional wheel as the knee wheel 356 may not be driven by a motor (e.g., may operate passively, may act as a caster, and/or the like). According to an alternative aspect, the omni-directional wheel as the knee wheel 316 may be driven by a motor (see FIGS. 2A and 2B) and/or the omni-directional wheel as the knee wheel 356 may be driven by a motor (see FIGS. 2A and 2B). Such an aspect may be referred to as a four-wheel drive operating mode ("4WD mode").

According to yet further aspects, in the RWD mode, the foot wheel 334 and the knee wheel 336 of the second leg module 385 may be selectively positioned in contact with the surface 364. Such an arrangement may increase stability of the wheelchair assembly 300 during the driving and/or turning of the wheelchair assembly 300. According to various aspects, the foot wheel 334 and/or the knee wheel 336 may not be driven by a motor (e.g., may operate passively, may act as a caster, and/or the like). According to an alternative aspect, the foot wheel 334 and/or the knee wheel 336 may be driven by a motor (see FIGS. 2A and 2B). Such an aspect may be referred to as an all-wheel drive operating mode ("AWD mode").

Front-Wheel Drive Operating Mode

Further in view of FIG. 3A, the wheelchair assembly 300 may include a front-wheel drive operating mode ("FWD mode"). According to various aspects, the FWD mode may be a standard or default mode of operation. In the FWD mode, the wheelchair assembly 300 may include a first leg module 380, a second leg module 385, and a third leg module 390. In such an aspect, each of the first leg module 380 and the third leg module 390 may include an omni-directional wheel at their respective knee joints 318, 358 and a standard (e.g., bi-directional) wheel at their respective foot joints 320, 360. In the FWD mode, the foot wheel 314 and the knee wheel 316 of the first leg module 380 and the foot wheel 354 and the knee wheel 356 of the third leg module 390 are selectively positioned in contact with a surface 364. According to various aspects, in the FWD mode, the foot wheel 334 and the knee wheel 336 of the second leg module 385 (e.g., including an omni-directional wheel at both its knee joint 338 and foot joint 340) may be selectively raised off of the surface 364. Such an arrangement may lessen frictional losses during the driving and/or turning of the wheelchair assembly 300.

In view of FIG. 3B, in the FWD mode, the omni-directional wheel as the knee wheel 316 may be driven by a motor (see FIGS. 2A and 2B) associated with first leg module 380 and the omni-directional wheel as the knee wheel 356 may be driven by a motor (see FIGS. 2A and 2B) associated with third leg module 390 to move or propel the wheelchair assembly 300. According to various embodiments, the standard wheel as the foot wheel 314 and/or the standard wheel as the foot wheel 354 may not be driven by a motor (e.g., may operate passively and/or the like). According to an alternative aspect, the standard wheel as the foot wheel 314 may be driven by a motor (see FIGS. 2A and 2B) and/or the standard wheel as the foot wheel 354 may be driven by a motor (see FIGS. 2A and 2B). Again, such an aspect may be referred to as a four-wheel drive operating mode ("4WD mode").

According to yet further aspects, in the FWD mode, the foot wheel 334 and the knee wheel 336 of the second leg module 385 may be selectively positioned in contact with the surface 364. Such an arrangement may increase stability of the wheelchair assembly 300 during the driving and/or turning of the wheelchair assembly 300. According to various aspects, the foot wheel 334 and/or the knee wheel 336 may not be driven by a motor (e.g., may operate passively, may act as a caster, and/or the like). According to an alternative aspect, the foot wheel 334 and/or the knee wheel 336 may be driven by a motor (see FIGS. 2A and 2B). Again, such an aspect may be referred to as an all-wheel drive operating mode ("AWD mode").

Mid-Wheel Drive Operating Mode

Figure 4B:
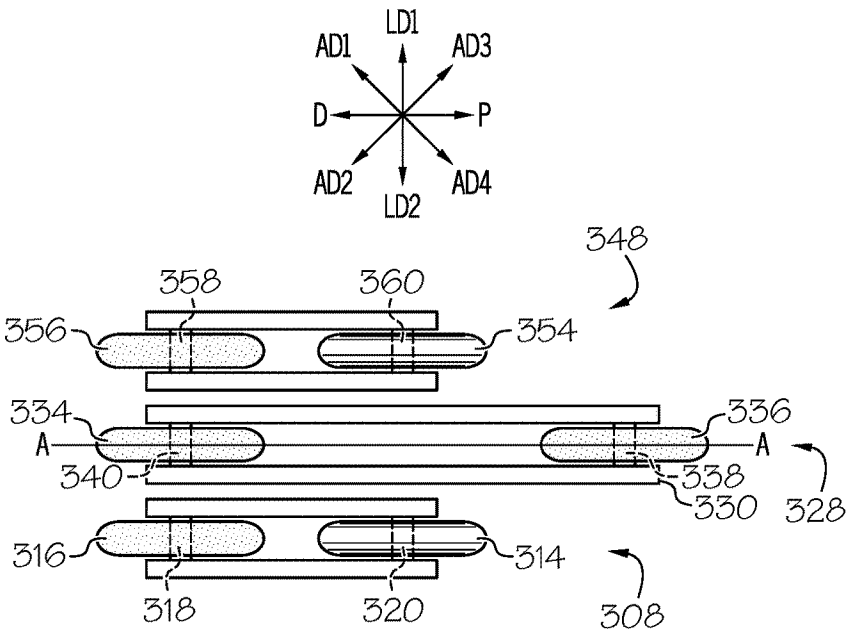
FIG. 4B depicts an illustrative top-down view (e.g., along axis B-B of FIG. 4A) of respective lower leg assemblies associated with a first leg module, a second leg module, and a third leg module in the mid-wheel drive mode configuration according to one or more embodiments shown and described herein.
Figure 4A:
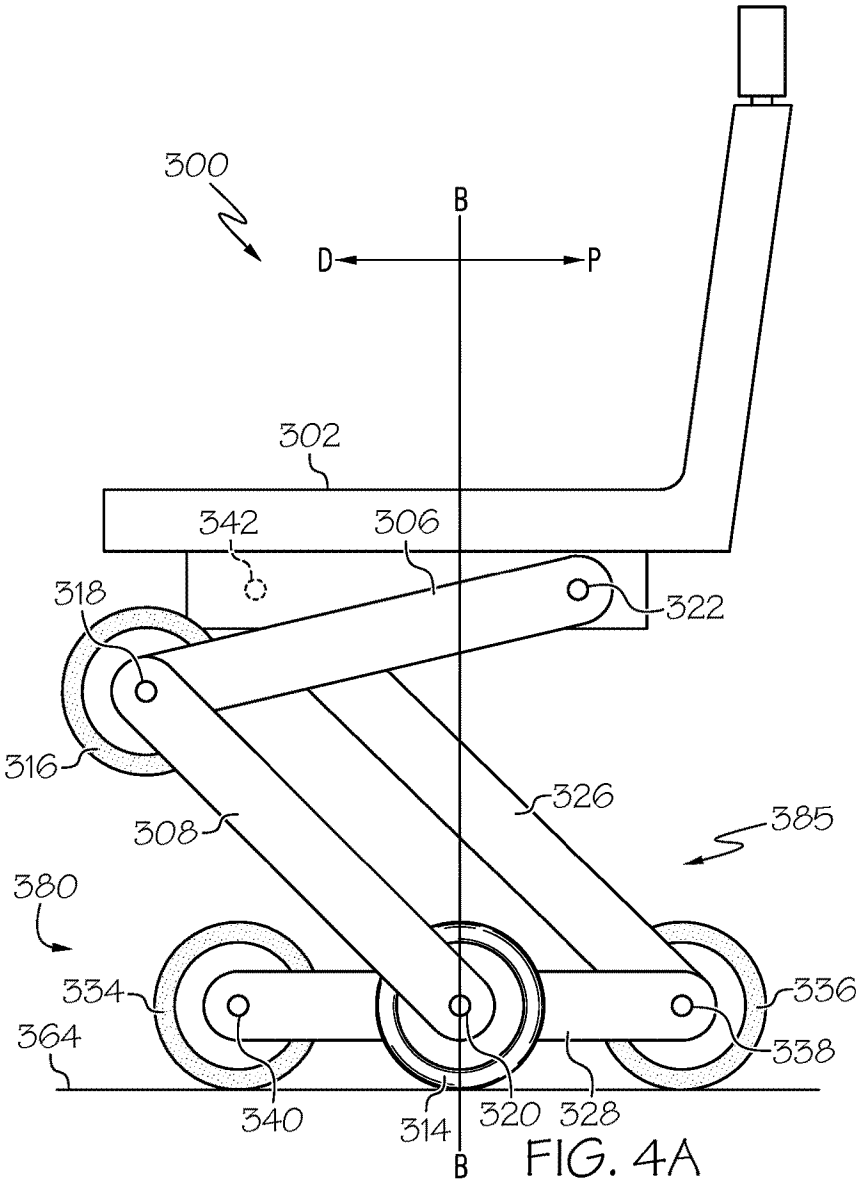
FIG. 4A depicts an illustrative wheelchair assembly having a plurality of leg modules in a mid-wheel drive mode configuration according to one or more embodiments shown and described herein.

As illustrated in FIGS. 4A and 4B, the wheelchair assembly 300 may include a mid-wheel drive operating mode ("MWD mode"). According to various aspects, the MWD mode may be a standard or default mode of operation. In the MWD mode, the wheelchair assembly 300 may include a first leg module 380, a second leg module 385, and a third leg module 390. In such an aspect, each of the first leg module 380 and the third leg module 390 may include an omni-directional wheel 316, 356 at their respective knee joints 318, 358 and a standard wheel 314, 354 at their respective foot joints 320, 360. In the MWD mode, the foot wheel 314 of the first leg module 380 and the foot wheel 354 of the third leg module 390 are selectively positioned in contact with the surface 364. However, in the MWD mode, the upper leg assembly 306 of the first leg module 380 may be rotated about the hip pivot 322 in a first direction (e.g., clockwise) and/or the lower leg assembly 308 of the first leg module 380 may be rotated about the knee joint 318 in a first direction (e.g., clockwise) to raise the knee wheel 316 off of the surface 364 and to advance the foot wheel 314 from a proximal "P" position relative to axis B-B of FIG. 4A toward a distal "D" position. In view of FIG. 4A, according to various aspects, the foot wheel 314 may be advanced distally to a center position or a substantially center position of the wheelchair assembly 300 (e.g., in alignment with axis B-B of FIG. 4A, at or near a center of the seat 302 of the wheelchair assembly 300, at or near a center or a substantially center position between the foot wheel 334 and the knee wheel 336 of the second leg module, and/or the like). Similarly, in the MWD mode, the upper leg assembly 346 of the third leg module 390 may be rotated about the hip pivot 362 in a first direction (e.g., clockwise) and/or the lower leg assembly 348 of the third leg module 390 may also be rotated about knee joint 358 in a first direction (e.g., clockwise) to raise the knee wheel 356 off of the surface 364 and to advance the foot wheel 354 from a proximal "P" position relative to axis B-B of FIG. 4A toward a distal "D" position. Similarly, in view of FIG. 4A, according to various aspects, the foot wheel 354 may be advanced distally to a center position or a substantially center position of the wheelchair assembly 300 (e.g., in alignment with axis B-B of FIG. 4A, beneath the seat 302 of the wheelchair assembly 300, and/or the like). In the MWD mode, the foot wheel 314 of the first leg module 380 may be driven by a motor (see FIGS. 2A and 2B) and the foot wheel 354 of the third leg module 390 may be driven by a motor (see FIGS. 2A and 2B) to move or propel the wheelchair assembly 300.

In the MWD mode, referring again to FIG. 4A, the foot wheel 334 and the knee wheel 336 of the second leg module 385 may be selectively positioned in contact with the surface 364. Such an arrangement, in combination with a centrally positioned foot wheel 314 of the first leg module 380 and a centrally positioned foot wheel 354 of the third leg module 390, may stabilize the wheelchair assembly 300 during the driving and/or turning of the wheelchair assembly 300. Further, according to various aspects, the foot wheel 334 and the knee wheel 336 of the second leg module 385 may both be omni-directional wheels. According to various aspects, the foot wheel 334 and/or the knee wheel 336 of the second leg module may not be driven by a motor (e.g., may operate passively, may act as a caster, and/or the like). In such an aspect, the foot wheel 314 of the first leg module 380 may be driven by a motor (see FIGS. 2A and 2B) and/or the foot wheel 354 of the third leg module 390 may be driven by a motor (see FIGS. 2A and 2B) to steer the wheelchair assembly 300. For example, the foot wheel 314 of the first leg module 380 may rotate in a first direction (e.g. counter-clockwise) and the foot wheel 354 of the third leg module 390 may rotate in a second opposite direction (e.g., clockwise) to steer the wheelchair assembly 300 one way (e.g., right). Similarly, the foot wheel 314 of the first leg module 380 may rotate in a first direction (e.g. clockwise) and the foot wheel 354 of the third leg module 390 may rotate in a second, opposite direction (e.g., counter-clockwise) to steer the wheelchair assembly 300 another, opposite way (e.g. left).

According to an alternative aspect, the foot wheel 334 of the second leg module 385 may be driven by a motor (see FIGS. 2A and 2B) and/or the knee wheel 336 of the second leg module 385 may be driven by a motor (see FIGS. 2A and 2B) to steer the wheelchair assembly 300. Such an aspect may be referred to as a four-wheel drive operating mode ("4WD mode"). Furthermore, according to such an aspect, the foot wheel 334 of the second leg module 385 may be driven by the motor (see FIGS. 2A and 2B) and/or the knee wheel 336 of the second leg module 385 may be driven by the motor (see FIGS. 2A and 2B) to move or propel the wheelchair assembly 300. Again, such an aspect may be referred to as a four-wheel drive operating mode ("4WD mode").

Omni-Wheel Drive Operating Mode

Figure 5B:
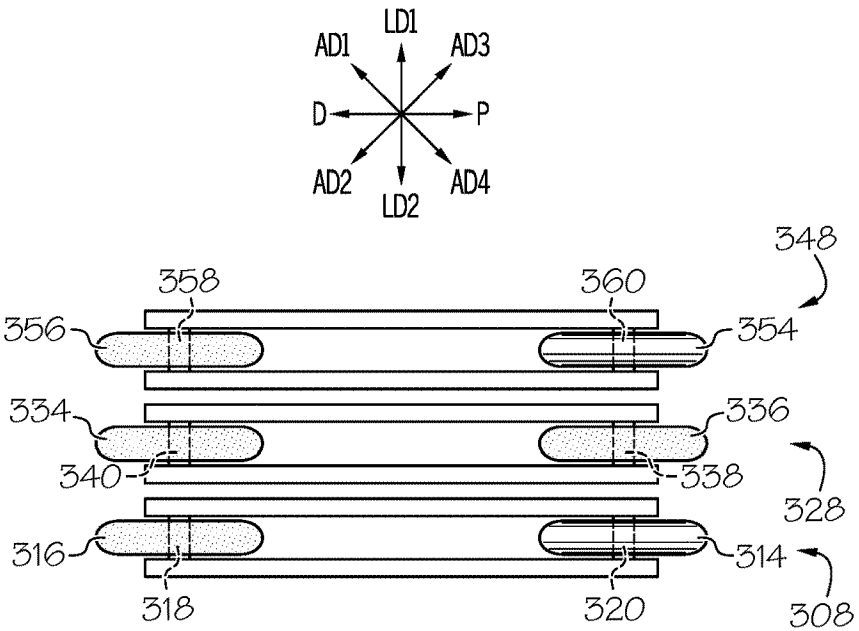
FIG. 5B depicts an illustrative top-down view of respective lower leg assemblies associated with a first leg module, a second leg module, and a third leg module according to one or more embodiments shown and described herein.
Figure 5A:
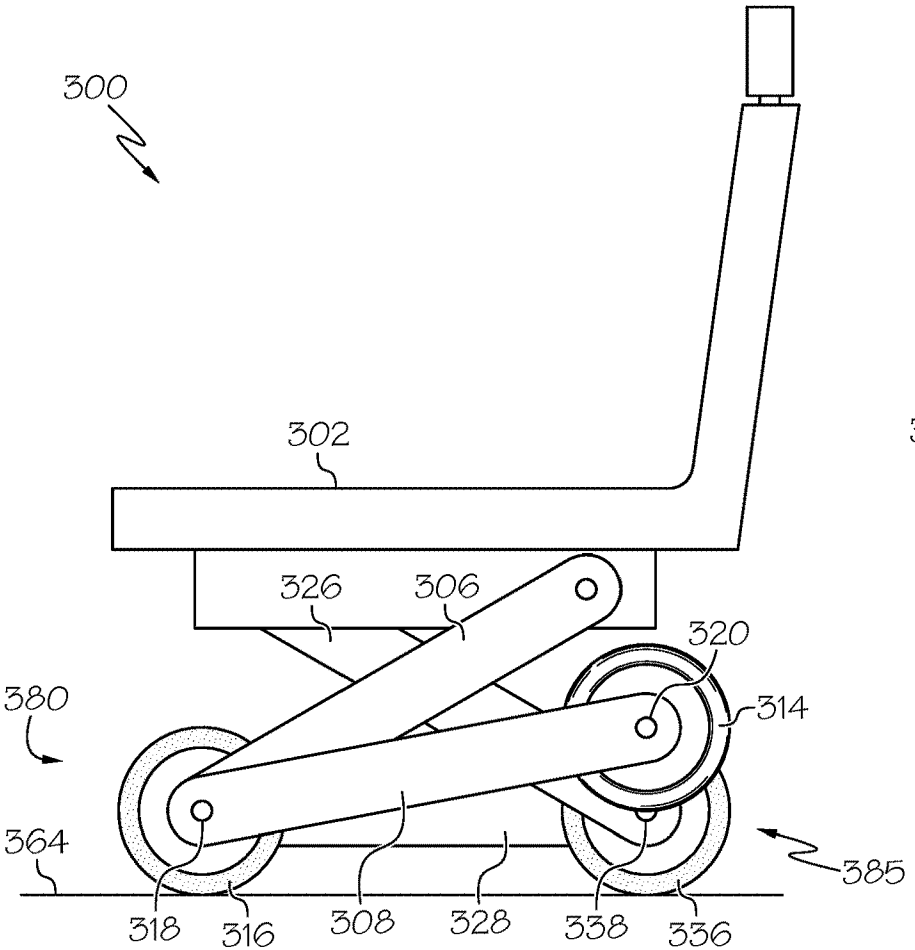
FIG. 5A depicts an illustrative wheelchair assembly having a plurality of leg modules in an omni-wheel drive mode configuration according to one or more embodiments shown and described herein.

As illustrated in FIGS. 5A and 5B, the wheelchair assembly 300 may include an Omni-Wheel Drive operating mode ("OWD mode"). According to various aspects, the OWD mode may be a standard or default mode of operation. According to other aspects, OWD may not be the standard or default mode of operation. In the OWD mode, the wheelchair assembly 300 may include a first leg module 380, a second leg module 385, and a third leg module 390 (not shown). According to such aspects, each of the first leg module 380 and the third leg module 390 may include an omni-directional wheel 316, 356 at their respective knee joints 318, 358 and a standard wheel 314, 354 at their respective foot joints 320, 360. In the OWD mode, the lower leg assembly 308 of the first leg module 380 may be rotated about the knee joint 318 in a first direction (e.g., counter-clockwise) to raise the foot wheel 314 off of the surface 364. Similarly, in the OWD mode, the lower leg assembly 348 of the third leg module 390 may be rotated about the knee joint 358 in a first direction (e.g., counter-clockwise) to raise the foot wheel 354 off of the surface 364. Accordingly, in the OWD mode, the wheel 316 of the first leg module 380 and the wheel 356 of the third leg module 390 are selectively positioned in contact with the surface 364. According to such aspects, the knee wheel 316 may be driven by a motor(s) associated with the first leg module 380 (see FIGS. 2A and 2B) and the knee wheel 356 may be driven by a motor(s) associated with the third leg module 390 (see FIGS. 2A and 2B) to steer the wheelchair assembly 300. Further, according to various aspects, the knee wheel 316 may be driven by a motor(s) associated with the first leg module 380 (see FIGS. 2A and 2B) and the knee wheel 356 may be driven by a motor(s) associated with the third leg module 390 (see FIGS. 2A and 2B) to move or propel the wheelchair assembly 300. According to yet further aspects (e.g., when knee wheel 336 and/or foot wheel 334 are driving wheels), the knee wheel 316 and/or the knee wheel may not be driven by a motor(s) associated with the first leg module 380 and the third leg module 390 respectively (e.g., omni-directional wheels may operate passively, may act as a caster, and/or the like).

Referring again to FIG. 5A, in the OWD mode, the foot wheel 334 and the knee wheel 336 of the second leg module 385 may be selectively positioned in contact with the surface 364. Such an arrangement, in combination with the knee wheel 316 of the first leg module 380 and the knee wheel 356 of the third leg module 390, may stabilize the wheelchair assembly 300 during the driving and/or turning of the wheelchair assembly 300. Further, according to such aspects, the foot wheel 334 and the knee wheel 336 of the second leg module 385 may both be omni-directional wheels. In an alternative embodiment, the foot wheel 334 may be a standard wheel and the knee wheel 336 may be at least one omni-directional wheel (see e.g., FIG. 1B, references 336*a* and 336*b*). In such an aspect, the at least one knee wheel 336 may be selectively positioned in contact with the surface 364 and the lower leg assembly 328 of the second leg module 385 may be rotated about the knee joint 338 in a first direction (e.g., clockwise) to raise the foot wheel 334 off of the surface 364. Further, in such an aspect, the at least one knee wheel 336, in combination with the knee wheel 316 of the first leg module 380 and the knee wheel 356 of the third leg module 390, may stabilize the wheelchair assembly 300 during the driving and/or turning of the wheelchair assembly 300.

Referring to FIGS. 5A and 5B, in the OWD mode, only omni-directional wheels (e.g., 316, 334, 336 and 356 in one aspect, 316, 336*a*, 336*b*, and 356 in an alternative aspect, and/or the like) may be selectively positioned in contact with the surface 364. With only omni-directional wheels positioned in contact with the surface 364, directional movement of the wheelchair assembly 300 is maximized. In such aspects, maneuverability of the wheelchair assembly 300 is improved. For example, referring to FIG. 5B, one or more of the omni-directional wheels 316, 334, 336, and/or 356 may be driven (e.g., by rotating a plurality of circumferential rollers discussed herein) to move the wheelchair assembly in a first lateral direction LD1 (as depicted in the axis of FIG. 5B) and/or a second lateral direction LD2 (as depicted in the axis of FIG. 5B) without proximal and/or distal movement of the wheelchair assembly 300 and/or without substantial proximal and/or distal movement of the wheelchair assembly 300. This enables movement in tight spaces. Lateral movements, utilizing an omni-directional wheel(s), are generally understood and are included within the scope of the present disclosure.

According to various aspects, the foot wheel 334 and/or the knee wheel 336 may be driven by a motor(s) associated with the second leg module 385 (see FIGS. 2A and 2B) to steer the wheelchair assembly 300. Such an aspect may be referred to as a four-wheel drive operating mode ("4WD mode"). Further, according to such an aspect, the foot wheel 334 and/or the knee wheel 336 may be driven by the motor(s) to move or propel the wheelchair assembly 300. Again, such an aspect may be referred to as a four-wheel drive operating mode ("4WD mode"). According to alternative aspects (e.g., when knee wheel 316 and knee wheel 356 are driving wheels), the foot wheel 334 and/or the knee wheel 336 of the second leg module 385 may not be driven by a motor(s) (e.g., omni-directional wheels may operate passively, may act as a caster, and/or the like). According to such aspects, the knee wheel 316 of the first leg module 380 may rotate in a first direction (e.g. counter-clockwise) and the knee wheel 356 of the third leg module 390 may rotate in a second opposite direction (e.g., clockwise) to steer the wheelchair assembly 300 one way. Similarly, the knee wheel 316 of the first leg module 380 may rotate in a first direction (e.g. clockwise) and the foot wheel 356 of the third leg module 390 may rotate in a second, opposite direction (e.g., counter-clockwise) to steer the wheelchair assembly 300 another, opposite way.

Driving Mode Maneuverability

Figure 6A:
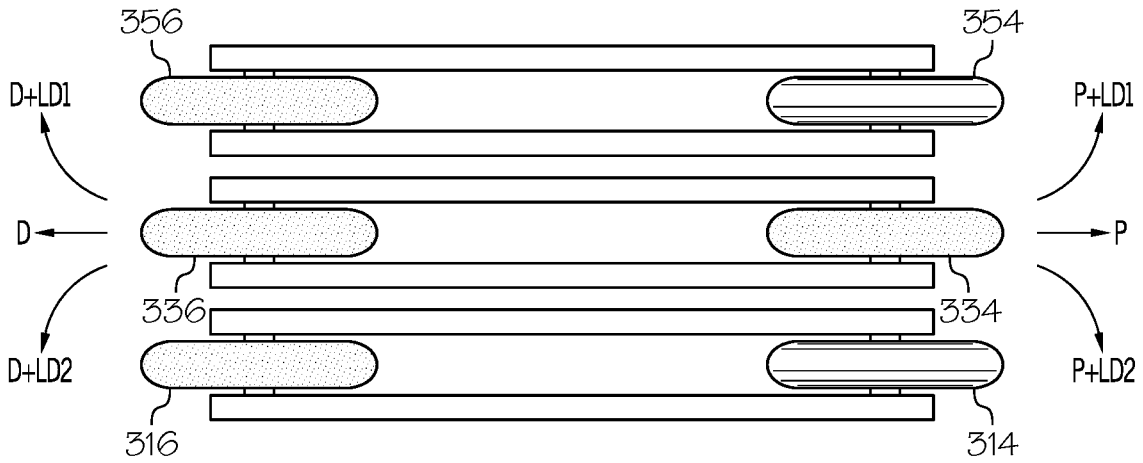
FIG. 6A depicts an illustration of maneuverability options associated with the rear-wheel drive mode configuration, the front-wheel drive mode configuration, and the mid-wheel drive mode configuration according to one or more embodiments shown and described herein.
Figure 6B:
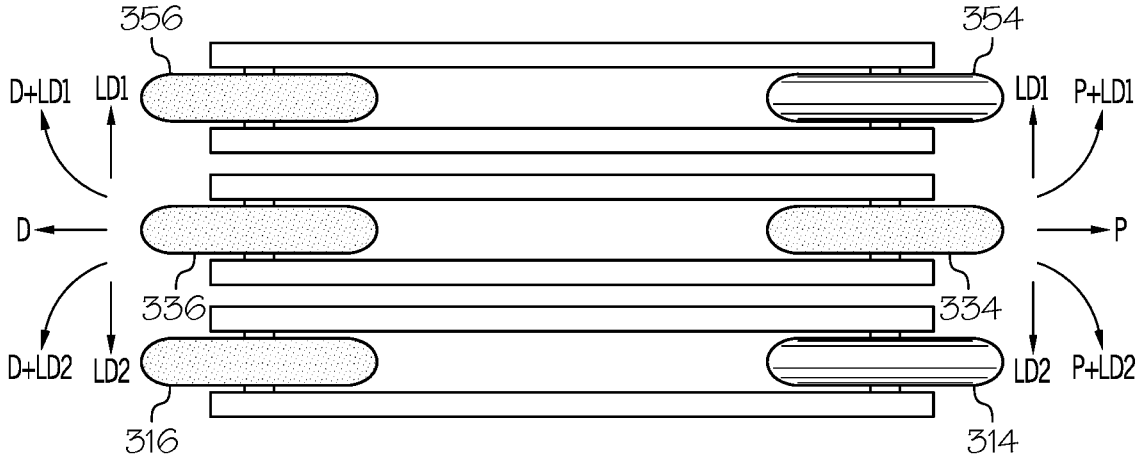
FIG. 6B depicts an illustration of maneuverability options associated with the omni-wheel drive mode configuration according to one or more embodiments shown and described herein.

FIG. 6A illustrates maneuverability options associated with the RWD mode, the FWD mode, and the MWD mode as described herein. With respect to the RWD mode, since the foot wheel 314 and the foot wheel 354 are driving standard wheels, the wheelchair assembly 300 movements include a distal movement (e.g., in the "D" direction as depicted in FIG. 6A), a proximal movement (e.g., in the "P" direction as depicted in FIG. 6A), a combination of distal and lateral movement (e.g., in the "D+LD1" direction and/or the "D+LD2" direction as depicted in FIG. 6A), and/or a combination of proximal and lateral movement (e.g., in the "P+LD1" direction and/or the "P+LD2" direction as depicted in FIG. 6A). In the RWD mode, since standard wheels 314, 354 are in contact with the surface, a pure lateral movement (e.g., in the "LD1" and/or the "LD2" direction as depicted in FIG. 6B) sans distal or proximal movement is not possible. Next, with respect to FWD mode, despite the knee wheel 316 and the knee wheel 356 being driving omni-directional wheels, the wheelchair assembly 300 movements include a distal movement (e.g., in the "D" direction as depicted in FIG. 6A), a proximal movement (e.g., in the "P" direction as depicted in FIG. 6A), a combination of distal and lateral movement (e.g., in the "D+LD1" direction and/or the "D+LD2" direction as depicted in FIG. 6A), and/or a combination of proximal and lateral movement (e.g., in the "P+LD1" direction and/or the "P+LD2" direction as depicted in FIG. 6A). In the FWD mode, since standard wheels 314, 354 are in contact with the surface, a pure lateral movement (e.g., in the "LD1" and/or the "LD2" direction as depicted in FIG. 6B) sans distal or proximal movement is not possible. Similarly, with respect to MWD mode, since the foot wheel 314 and the foot wheel 354 are driving standard wheels, the wheelchair assembly 300 movements include a distal movement (e.g., in the "D" direction as depicted in FIG. 6A), a proximal movement (e.g., in the "P" direction as depicted in FIG. 6A), a combination of distal and lateral movement (e.g., in the "D+LD1" direction and/or the "D+LD2" direction as depicted in FIG. 6A), and/or a combination of proximal and lateral movement (e.g., in the "P+LD1" direction and/or the "P+LD2" direction as depicted in FIG. 6A). In the MWD mode, despite movement of the standard wheels 314, 354 distally (see FIG. 4A) the standard wheels 314, 354 remain in contact with the surface. As such, in the MWD mode, a pure lateral movement (e.g., in the "LD1" and/or the "LD2" direction as depicted in FIG. 6B) sans distal or proximal movement is not possible.

FIG. 6B illustrates increased maneuverability options associated with the OWD mode as described herein. In one embodiment (see FIG. 5A), with respect to the OWD mode, since the foot wheel 314 and the foot wheel 354 are raised off of the surface 364, a pure lateral movement (e.g., in the "LD1" and/or the "LD2" direction as depicted in FIG. 6B) sans substantial distal or proximal movement is possible. According to such aspects, any of the knee wheels 316, 336, 356 and/or the foot wheel 334 may be driving omni-directional wheels such that wheelchair assembly 300 movements include a distal movement (e.g., in the "D" direction as depicted in FIG. 6B), a proximal movement (e.g., in the "P" direction as depicted in FIG. 6B), a combination of distal and lateral movement (e.g., in the "D+LD1" direction and/or the "D+LD2" direction as depicted in FIG. 6B), a combination of proximal and lateral movement (e.g., in the "P+LD1" direction and/or the "P+LD2" direction as depicted in FIG. 6B) a pure first lateral movement (e.g., in the "LD1" direction as depicted in FIG. 6B), and/or a pure second lateral movement (e.g., in the "LD2" direction as depicted in FIG. 6B). In an alternative embodiment (see e.g., FIG. 1B), with respect to the OWD mode, since the foot wheel 314, the foot wheel 334, and the foot wheel 354 are raised off of the surface 364, a pure lateral movement (e.g., in the "LD1" and/or "LD2" direction as depicted in FIG. 6B) sans substantial distal or proximal movement is possible. According to such aspects, the knee wheels 316, 336*a*, 336*b* and/or 356 may be driving omni-directional wheels such that wheelchair assembly 300 movements include a distal movement (e.g., in the "D" direction as depicted in FIG. 6B), a proximal movement (e.g., in the "P" direction as depicted in FIG. 6B), a combination of distal and lateral movement (e.g., in the "D+LD1" direction and/or the "D+LD2" direction as depicted in FIG. 6B), a combination of proximal and lateral movement (e.g., in the "P+LD1" direction and/or the "P+LD2" direction as depicted in FIG. 6B), a pure first lateral movement (e.g., in the "LD1" direction as depicted in FIG. 6B), and/or a pure second lateral movement (e.g., in the "LD2" direction as depicted in FIG. 6B).

Standard Wheels

According to various aspects described herein, a standard wheel may include any wheel configured to move in a forward or distal "D" direction and/or a reverse or proximal "P" direction (e.g., a uni-directional wheel, a bi-directional wheel, or the like). Standard wheels, as utilized herein, generally do not move in a lateral direction (e.g., in an "LD1" or "LD2" direction depicted herein) without overcoming frictional forces between the standard wheel and a surface.

Omni-Directional Wheels

According to various aspects described herein, an omni-directional wheel may include a mecanum wheel, an omni-wheel, a caster, and/or the like. An omni-directional wheel enables omni-directional movement of the wheelchair assembly as described herein.

Mecanum Wheels

Figure 7:
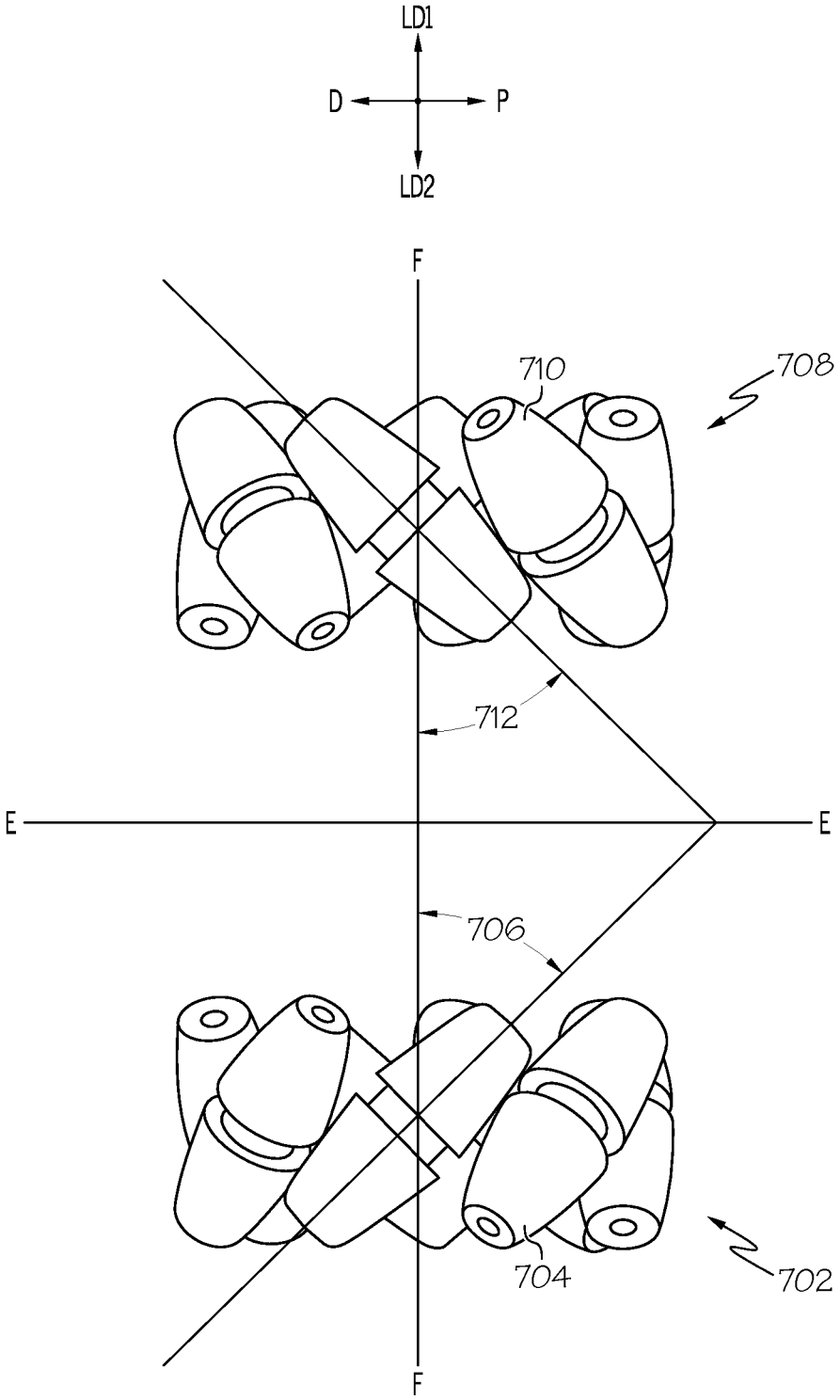
FIG. 7 depicts an illustrative top-down view of two mecanum wheels according to one or more embodiments shown and described herein.

FIG. 7 illustrates a top-down view of example mecanum wheels 702, 708. The first mecanum wheel 702 includes a plurality of rollers 704 rotatably coupled at an angle 706 (e.g., 45°), relative to axis F-F, around a circumference of the first mecanum wheel 702. Each of the plurality of rollers 704 translate a portion of the rotational force of the first mecanum wheel 702 to a normal force perpendicular to the first mecanum wheel 702 direction. For example, with respect to the first mecanum wheel 702 a portion of a forward or distal "D" force is translated to an inward or first lateral "LD1" force and a portion of a reverse or proximal "P" force is translated to a second lateral "LD2" force. Similarly, the second mecanum wheel 708 includes a plurality of rollers 710 rotatably coupled at an angle 712 (e.g., 45°), relative to axis F-F, around a circumference of the second mecanum wheel 708. Each of the plurality of rollers 710 translate a portion of the rotational force of the second mecanum wheel 708 to a normal force perpendicular to the second mecanum wheel 708 direction. For example, with respect to second mecanum wheel 708 a portion of a forward or distal "D" force is translated to an inward or second lateral "LD2" force and a portion of a reverse or proximal "P" force is translated to a first lateral "LD1" force. In view of FIG. 7, the second mecanum wheel 708 is a mirror version, about axis E-E, of the first mecanum wheel 702. According to various aspects, in view of FIG. 7, mecanum wheels 702, 708 may each include a plurality of rollers rotatably coupled at a different angle (i.e., other than 45°) relative to axis F-F. Similarly, in such an aspect, the second mecanum wheel 708 is a mirror version, about axis E-E, of the first mecanum wheel 702. One or more pairs of mecanum wheels may be utilized to realize desired movements of a wheelchair assembly.

According to various aspects described herein, a combination of mecanum wheels may be positioned and rotatable to produce a resulting force vector to move a wheelchair assembly coupled thereto in a desired direction. More specifically each mecanum wheel may rotate in a certain direction and/or with a certain speed to move the wheelchair assembly in a desired direction.

Figure 8:
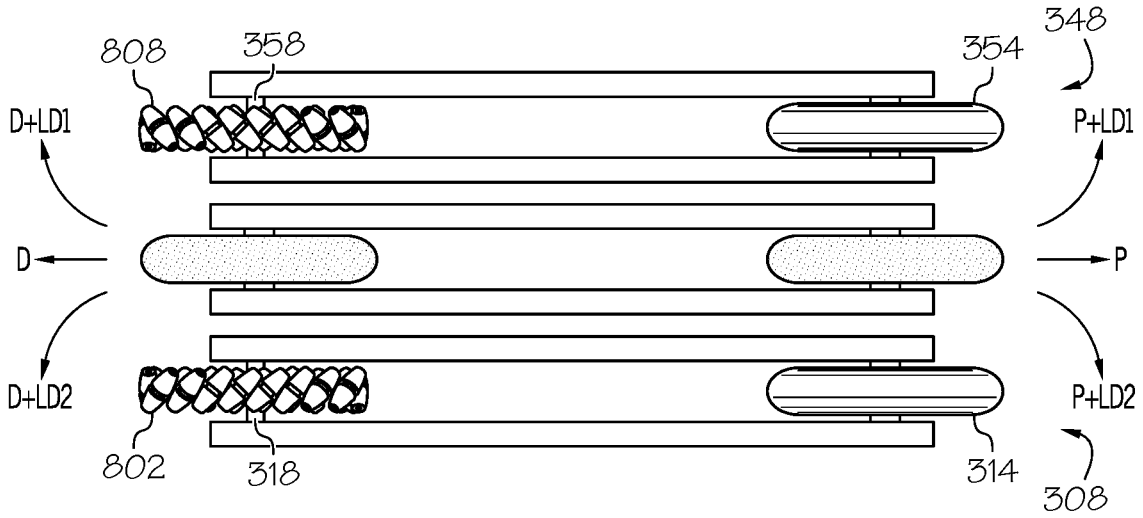
FIG. 8 depicts an illustrative top-down view of the respective lower leg assemblies of FIG. 3B, where a mecanum wheel is positioned as the knee wheel of the lower leg assembly of the first leg module and the lower leg assembly of the third leg module, as well as associated maneuverability options according to one or more embodiments shown and described herein.

FIG. 8, for example, illustrates a first mecanum wheel 802 positioned at knee joint 318 of the lower leg assembly 308 and a second mecanum wheel 808 positioned at knee joint 358 of lower leg assembly 348. As discussed herein, in RWD mode, since the foot wheel 314 and the foot wheel 354 are driven to propel the wheelchair assembly, the first mecanum wheel 802 and the second mecanum wheel 808 may not be driven by a motor (e.g., may operate passively, may act as a caster, and/or the like). Alternatively, in the RWD mode, the first mecanum wheel 802 and the second mecanum wheel 808 may also be driven. According to such an aspect, to realize "D" movement, the first mecanum wheel 802 and the second mecanum wheel 808 may rotate in a forward or distal "D" direction at an equal speed to aid the foot wheels 314, 354 (e.g., rotating in a forward or distal "D" direction) in propelling/driving the wheelchair assembly in the "D" direction. Alternatively, to realize "D+LD1" movement, the first mecanum wheel 802 may rotate in a forward or distal "D" direction at a first speed and the second mecanum wheel 808 may rotate in a forward or distal "D" direction at a second speed slower than the first speed to aid the foot wheel 314 (e.g., rotating in a forward or distal "D" direction at a third speed) and the foot wheel 354 (e.g., rotating in a forward or distal "D" direction at a fourth speed slower than the third speed) in propelling/driving the wheelchair assembly in the "D+LD1" direction. Alternatively, to realize "D+LD2" movement, the first mecanum wheel 802 may rotate in a forward or distal "D" direction at a first speed and the second mecanum wheel 808 may rotate in a forward or distal "D" direction at a second speed faster than the first speed to aid the foot wheel 314 (e.g., rotating in a forward or distal "D" direction at a third speed) and the foot wheel 354 (e.g., rotating in a forward or distal "D" direction at a fourth speed slower than the third speed) in propelling/driving the wheelchair assembly in the "D+LD2" direction. Alternatively, to realize "P" movement, the first mecanum wheel 802 and the second mecanum wheel 808 may rotate in a reverse or proximal "P" direction at an equal speed to aid the foot wheels 314, 354 (e.g., rotating in a reverse or proximal "P" direction) in propelling/driving the wheelchair assembly in the "P" direction. Alternatively, to realize "P+LD1" movement, the first mecanum wheel 802 may rotate in a reverse or proximal "P" direction at a first speed and the second mecanum wheel 808 may rotate in a reverse or proximal "P" direction at a second speed slower than the first speed to aid the foot wheel 314 (e.g., rotating in a reverse or proximal "P" direction at a third speed) and the foot wheel 354 (e.g., rotating in reverse or proximal "P" direction at a fourth speed slower than the third speed) in propelling/driving the wheelchair assembly in the "P+LD1" direction. Alternatively, to realize "P+LD2" movement, the first mecanum wheel 802 may rotate in a reverse or proximal "P" direction at a first speed and the second mecanum wheel 808 may rotate in reverse or proximal "P" direction at a second speed faster than the first speed to aid the foot wheel 314 (e.g., rotating in reverse or proximal "P" direction at a third speed) and the foot wheel 354 (e.g., rotating in reverse or proximal "P" direction at a fourth speed faster than the third speed) in propelling/driving the wheelchair assembly in the "P+LD2" direction. Notably, in FWD mode, the first mecanum wheel 802 and the second mecanum wheel 808 may similarly drive the wheelchair assembly in the "D", "D+LD1", "D+LD2", "P", "P+LD1" and "P+LD2" directions, as discussed herein, while the foot wheels 314, 354 rotate in a passive manner.

Figure 9A:
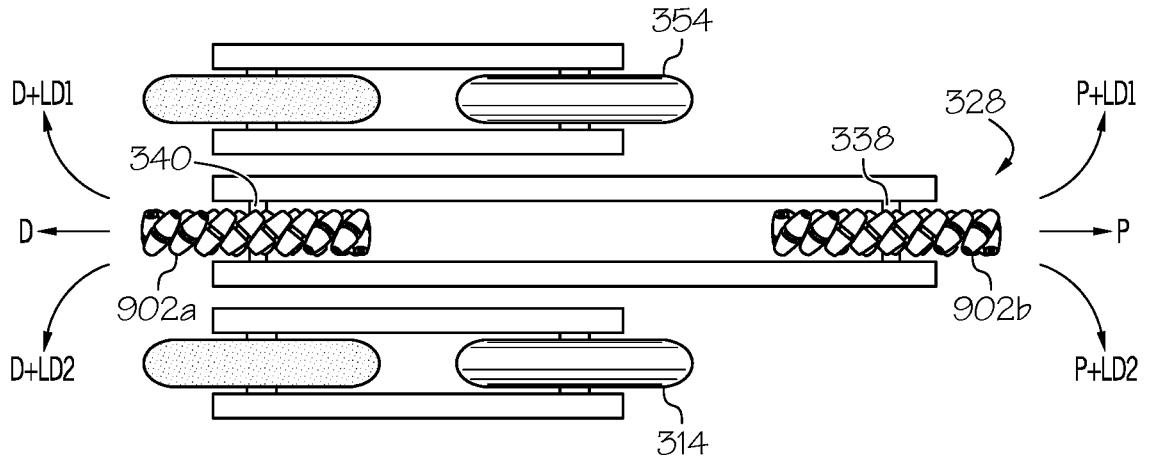
FIG. 9A depicts an illustrative top-down view of the respective lower leg assemblies of FIG. 4B where a mecanum wheel is positioned as the knee wheel and as the foot wheel of the lower leg assembly of the second leg module, as well as associated maneuverability options according to one or more embodiments shown and described herein.

FIG. 9A, as another example, illustrates a first mecanum wheel 902*b* positioned at knee joint 338 of the lower leg assembly 328 and a first mecanum wheel 902*a* positioned at foot joint 340 of lower leg assembly 328. As discussed herein, in MWD mode, since the foot wheel 314 and the foot wheel 354 are driven to propel the wheelchair assembly, neither the first mecanum wheel 902*b* at knee joint 338 nor the first mecanum wheel 902*a* at foot joint 340 may be driven (e.g., may operate passively, may act as a caster, and/or the like). For example, to realize "D" movement the foot wheel 314 and the foot wheel 354 may rotate in a forward or distal "D" direction at an equal speed to propel/drive the wheelchair assembly in the "D" direction while the first mecanum wheel 902*b* at knee joint 338 and the first mecanum wheel 902*a* at foot joint 340 operate passively. Alternatively, to realize "D+LD1" movement, the first mecanum wheel 902*a* positioned at foot joint 340 may rotate in a forward or distal "D" direction and the first mecanum wheel 902*b* positioned at knee joint 338 may operate passively to aid the foot wheel 314 (e.g., rotating in a forward or distal "D" direction at a first speed) and the foot wheel 354 (e.g., rotating in a forward or distal "D" direction at a second speed slower than the first speed) in propelling/driving the wheelchair assembly in the "D+LD1" direction. Alternatively, to realize "D+LD2" movement, the first mecanum wheel 902*a* positioned at foot joint 340 may operate passively and the first mecanum wheel 902*b* positioned at knee joint 338 may rotate in a forward or distal "D" direction to aid the foot wheel 314 (e.g., rotating in a forward or distal "D" direction at a first speed) and the foot wheel 354 (e.g., rotating in a forward or distal "D" direction at a second speed faster than the first speed) in propelling/driving the wheelchair assembly in the "D+LD2" direction. Alternatively, to realize "P" movement the foot wheel 314 and the foot wheel 354 may rotate in a reverse or proximal "P" direction at an equal speed to propel/drive the wheelchair assembly in the "P" direction while the first mecanum wheel 902*b* at knee joint 338 and the first mecanum wheel 902*a* at foot joint 340 operate passively. Alternatively, to realize "P+LD1" movement, the first mecanum wheel 902*a* positioned at foot joint 340 may rotate in reverse or proximal "P" direction and the first mecanum wheel 902*b* positioned at knee joint 338 may operate passively to aid the foot wheel 314 (e.g., rotating in a reverse or proximal "P" direction at a first speed) and the foot wheel 354 (e.g., rotating in a reverse or proximal "P" direction at a second speed slower than the first speed) in propelling/driving the wheelchair assembly in the "P+LD1" direction. Alternatively, to realize "P+LD2" movement, the first mecanum wheel 902*a* positioned at foot joint 340 may operate passively and the first mecanum wheel 902*b* positioned at knee joint 338 may rotate in a reverse or proximal "P" direction to aid the foot wheel 314 (e.g., rotating in a reverse or proximal "P" direction at a first speed) and the foot wheel 354 (e.g., rotating in a reverse or proximal "P" direction at a second speed faster than the first speed) in propelling/driving the wheelchair assembly in the "P+LD2" direction.

In view of FIG. 9A, according to an alternative aspect, both the first mecanum wheel 902*b* positioned at knee joint 338 of the lower leg assembly 328 and a first mecanum wheel 902*a* positioned at foot joint 340 of lower leg assembly 328 may be substituted with 908*b* and 908*a* respectively (mirror versions of 902*b* and 902*a*, similar to FIG. 7). In such an aspect (not shown), to realize "D" movement the foot wheel 314 and the foot wheel 354 may rotate in a forward or distal "D" direction at an equal speed to propel/drive the wheelchair assembly in the "D" direction while the second mecanum wheel 908*b* at knee joint 338 and the second mecanum wheel 908*a* at foot joint 340 operate passively. Alternatively, to realize "D+LD1" movement, the second mecanum wheel 908*a* positioned at foot joint 340 may operate passively and the second mecanum wheel 908*b* positioned at knee joint 338 may rotate in a forward or distal "D" direction to aid the foot wheel 314 (e.g., rotating in a forward or distal "D" direction at a first speed) and the foot wheel 354 (e.g., rotating in a forward or distal "D" direction at a second speed slower than the first speed) in propelling/driving the wheelchair assembly in the "D+LD1" direction. Alternatively, to realize "D+LD2" movement, the second mecanum wheel 908*a* positioned at foot joint 340 may rotate in a forward or distal "D" direction and the second mecanum wheel 908*b* positioned at knee joint 338 may operate passively to aid the foot wheel 314 (e.g., rotating in a forward or distal "D" direction at a first speed) and the foot wheel 354 (e.g., rotating in a forward or distal "D" direction at a second speed faster than the first speed) in propelling/driving the wheelchair assembly in the "D+LD2" direction. Alternatively, to realize "P" movement the foot wheel 314 and the foot wheel 354 may rotate in a reverse or proximal "P" direction at an equal speed to propel/drive the wheelchair assembly in the "P" direction while the second mecanum wheel 908*b* at knee joint 338 and the second mecanum wheel 908*a* at foot joint 340 operate passively. Alternatively, to realize "P+LD1" movement, the second mecanum wheel 908*a* positioned at foot joint 340 may operate passively and the second mecanum wheel 908*b* positioned at knee joint 338 may rotate in reverse or proximal "P" direction to aid the foot wheel 314 (e.g., rotating in a reverse or proximal "P" direction at a first speed) and the foot wheel 354 (e.g., rotating in a reverse or proximal "P" direction at a second speed slower than the first speed) in propelling/driving the wheelchair assembly in the "P+LD1" direction. Alternatively, to realize "P+LD2" movement, the second mecanum wheel 908*a* positioned at foot joint 340 may rotate in a reverse or proximal "P" direction and the second mecanum wheel 908*b* positioned at knee joint 338 may operate passively to aid the foot wheel 314 (e.g., rotating in a reverse or proximal "P" direction at a first speed) and the foot wheel 354 (e.g., rotating in a reverse or proximal "P" direction at a second speed faster than the first speed) in propelling/driving the wheelchair assembly in the "P+LD2" direction.

Figure 9B:
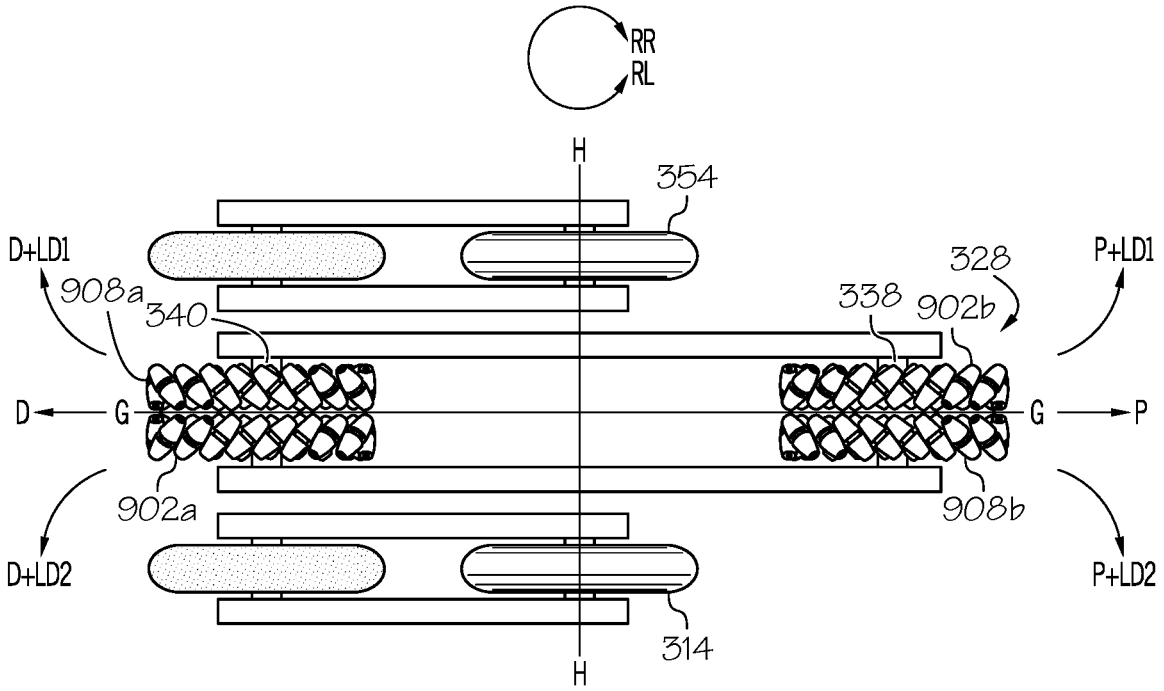
FIG. 9B depicts an illustrative top-down view of the respective lower leg assemblies of FIG. 4B, where two mecanum wheels are positioned as the knee wheel and two mecanum wheels are positioned as the foot wheel of the lower leg assembly of the second leg module, as well as associated maneuverability options according to one or more embodiments shown and described herein.

FIG. 9B, as another example, illustrates a first mecanum wheel 902*b* and a second mecanum wheel 908*b* positioned at knee joint 338 of the lower leg assembly 328 as well as a first mecanum wheel 902*a* and a second mecanum wheel 908*a* positioned at foot joint 340 of lower leg assembly 328. In view of FIG. 9B, the mecanum wheels 902*a*, 902*b*, 908*a*, 908*b* are positioned such that they mirror each other not only about the G-G axis as depicted in FIG. 9B, but also about the H-H axis as depicted in FIG. 9B. According to such an aspect, each of the mecanum wheels may be selectively driven. According to such an aspect, to realize "D" movement, the first mecanum wheel 902*b* and the second mecanum wheel 908*b* at the knee joint 338 as well as the first mecanum wheel 902*a* and the second mecanum wheel 908*a* at the foot joint 340 may rotate in a forward or distal "D" direction all at an equal speed to aid the foot wheels 314, 354 (e.g., rotating in a forward or distal "D" direction) in propelling/driving the wheelchair assembly in the "D" direction. Alternatively, to realize "D+LD1" movement, the first mecanum wheel 902*a* at the foot joint 340 and the second mecanum wheel 908*b* at the knee joint 338 may rotate in a forward or distal "D" direction at a first speed and the second mecanum wheel 908*a* at the foot joint 340 and the first mecanum wheel 902*b* at the knee joint 338 may rotate in a forward or distal "D" direction at a second speed slower than the first speed to aid the foot wheel 314 (e.g., rotating in a forward or distal "D" direction at a third speed) and the foot wheel 354 (e.g., rotating in a forward or distal "D" direction at a fourth speed slower than the third speed) in propelling/driving the wheelchair assembly in the "D+LD1" direction. Alternatively, to realize "D+LD2" movement, the second mecanum wheel 908*a* at the foot joint 340 and the first mecanum wheel 902*b* at the knee joint 338 may rotate in a forward or distal "D" direction at a first speed and the first mecanum wheel 902*a* at the foot joint 340 and the second mecanum wheel 908*b* at the knee joint 338 may rotate in a forward or distal "D" direction at a second speed slower than the first speed to aid the foot wheel 314 (e.g., rotating in a forward or distal "D" direction at a third speed) and the foot wheel 354 (e.g., rotating in a forward or distal "D" direction at a fourth speed faster than the third speed) in propelling/driving the wheelchair assembly in the "D+LD2" direction. Alternatively, to realize "P" movement, the first mecanum wheel 902*b* and the second mecanum wheel 908*b* at the knee joint 338 as well as the first mecanum wheel 902*a* and the second mecanum wheel 908*a* at the foot joint 340 may rotate in a reverse or proximal "P" direction all at an equal speed to aid the foot wheels 314, 354 (e.g., rotating in a reverse or proximal "P" direction) in propelling/driving the wheelchair assembly in the "P" direction. Alternatively, to realize "P+LD1" movement, the first mecanum wheel 902*a* at the foot joint 340 and the second mecanum wheel 908*b* at the knee joint 338 may rotate in a reverse or proximal "P" direction at a first speed and the second mecanum wheel 908*a* at the foot joint 340 and the first mecanum wheel 902*b* at the knee joint 338 may rotate in a reverse or proximal "P" direction at a second speed slower than the first speed to aid the foot wheel 314 (e.g., rotating in a reverse or proximal "P" direction at a third speed) and the foot wheel 354 (e.g., rotating in a reverse or proximal "P" direction at a fourth speed slower than the third speed) in propelling/driving the wheelchair assembly in the "P+LD1" direction. Alternatively, to realize "P+LD2" movement, the second mecanum wheel 908*a* at the foot joint 340 and the first mecanum wheel 902*b* at the knee joint 338 may rotate in a reverse or proximal "P" direction at a first speed and the first mecanum wheel 902*a* at the foot joint 340 and the second mecanum wheel 908*b* at the knee joint 338 may rotate in a reverse or proximal "P" direction at a second speed slower than the first speed to aid the foot wheel 314 (e.g., rotating in a reverse or proximal "P" direction at a third speed) and the foot wheel 354 (e.g., rotating in a reverse or proximal "P" direction at a fourth speed faster than the third speed) in propelling/driving the wheelchair assembly in the "P+LD2" direction. Furthermore, in the MWD mode, the wheelchair assembly 300 is able to rotate or turn, in place, with a minimal or zero turning radius. To realize rotation in a first direction (e.g., rotate right RR) the first mecanum wheel 902*a* at the foot joint 340 and the second mecanum wheel 908*b* at the knee joint 338 may rotate in a forward or distal "D" direction at a first speed and the second mecanum wheel 908*a* at the foot joint 340 and the first mecanum wheel 902*b* at the knee joint 338 may rotate in a reverse or proximal "P" direction at a second speed equal to the first speed while the foot wheel 314 rotates in a forward or distal "D" direction at a third speed and the foot wheel 354 rotates in a reverse or proximal "P" direction at a fourth speed equal to the third speed to rotate the wheelchair assembly 300, in place, in the first direction (e.g. rotate right RR). Similarly, to realize rotation in a second direction (e.g., rotate left RL) the first mecanum wheel 902*a* at the foot joint 340 and the second mecanum wheel 908*b* at the knee joint 338 may rotate in a reverse or proximal "P" direction at a first speed and the second mecanum wheel 908*a* at the foot joint 340 and the first mecanum wheel 902*b* at the knee joint 338 may rotate in a forward or distal "D" direction at a second speed equal to the first speed while the foot wheel 314 rotates in a reverse or proximal "P" direction at a third speed and the foot wheel 354 rotates in a forward or distal "D" direction at a fourth speed equal to the third speed to rotate the wheelchair assembly 300, in place, in the second direction (e.g. rotate left RL).

Figure 9C:
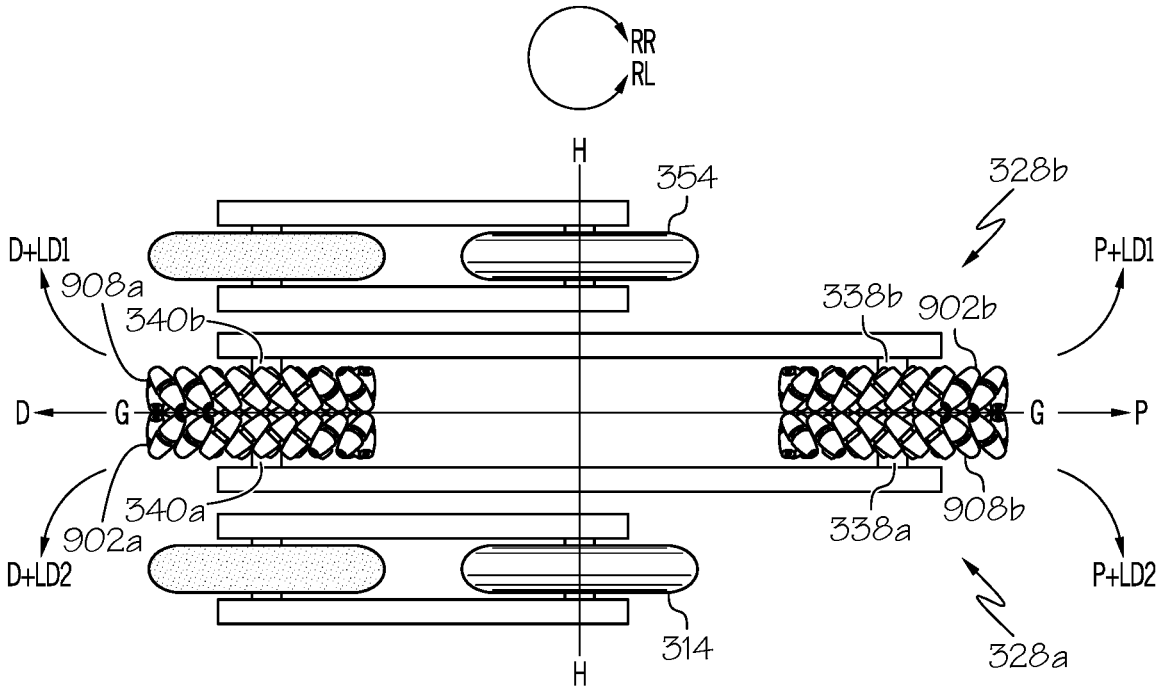
FIG. 9C depicts an illustrative top-down view of the respective lower leg assemblies of FIG. 9B, where the second leg module is alternatively separated into two leg modules, each having a mecanum wheel as its knee wheel and its foot wheel, to provide four separate leg modules, as well as associated maneuverability options according to one or more embodiments shown and described herein.

In view of FIG. 9C, according to an alternative aspect, the lower leg assembly 328 of FIG. 9B including the first mecanum wheel 902*a* and the second mecanum wheel 908*a* positioned at foot joint 340 and the first mecanum wheel 902*b* and the second mecanum wheel 908*b* positioned at knee joint 338 may be separated into a lower leg assembly 328*a* (e.g., including the first mecanum wheel 902*a* at foot joint 340*a* and the second mecanum wheel 908*b* at knee joint 338*a*) and a lower leg assembly 328*b* (e.g., including the second mecanum wheel 908*a* at foot joint 340*b* and the first mecanum wheel 902*b* at knee joint 338*b*). In such an aspect, the lower leg assembly 328*a* may be part of a leg module 385*a* and the lower leg assembly 328*b* may be part of separate leg module 385*b*. Stated differently, embodiments including four leg modules 380, 385*a*, 385*b*, and 390 are contemplated by the present disclosure. Embodiments including more than four leg modules are also contemplated. However, at some point system inefficiencies (e.g., weight of additional leg modules/components, drag/friction resulting from contact of additional wheels with a surface, and/or the like) may effectively limit or constrain the desired number of leg modules of a wheelchair assembly.

Figure 10:
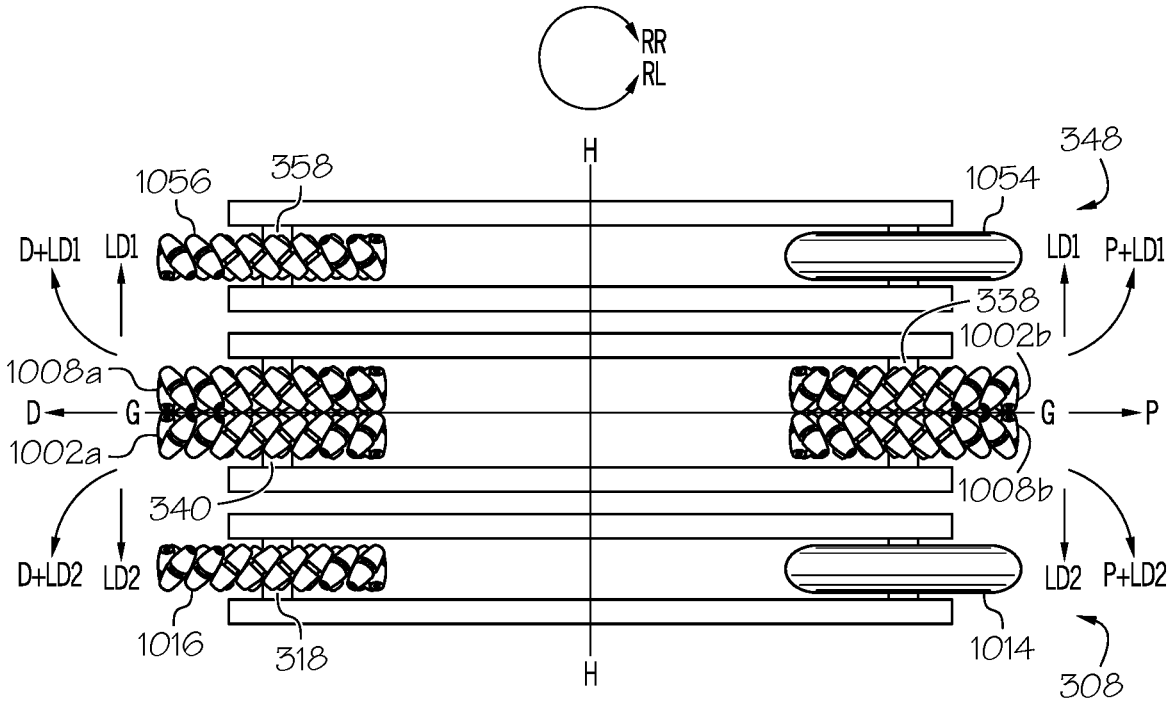
FIG. 10 depicts an illustrative top-down view of the respective lower leg assemblies of FIG. 5B, where a mecanum wheel is positioned as the knee wheel of the lower leg assembly of the first leg module and the lower leg assembly of the third leg module, and where two mecanum wheels are positioned as the knee wheel and two mecanum wheels are positioned as the foot wheel of the lower leg assembly of the second leg module, as well as associated maneuverability options according to one or more embodiments shown and described herein.

As discussed herein, in OWD mode, the wheelchair assembly 300 may be driven in some embodiments by an omni-directional foot wheel (see FIG. 5B, e.g., foot wheel 334 at foot joint 340) and an omni-directional knee wheel (see FIG. 5B, e.g., knee wheel 336 at knee joint 338). FIG. 10, as another example, substitutes the foot wheel 334 at foot joint 340 of the lower leg assembly 328 with a first mecanum wheel 1002*a* and a second mecanum wheel 1008*a* and substitutes the knee wheel 336 at knee joint 338 of the lower leg assembly 328 with a first mecanum wheel 1002*b* and a second mecanum wheel 1008*b*. In view of FIG. 10, similar to FIGS. 9B and 9C, the mecanum wheels are positioned such that they mirror each other not only about the G-G axis as depicted in FIG. 10, but also about the H-H axis as depicted in FIG. 10. According to such an aspect, each of the mecanum wheels may be selectively driven to propel or move the wheelchair assembly 300. The wheelchair assembly 300 may be further driven by mecanum wheel 1016 (e.g., an omni-directional knee wheel) of the lower leg assembly 308 and mecanum wheel 1056 (e.g., an omni-directional knee wheel) of the lower leg assembly 348. As previously discussed, in the OWD mode, only omni-directional wheels are in contact with the surface 364 (e.g., the foot wheel 1014 of the lower leg assembly 308 and the foot wheel 1054 of the lower leg assembly 348 are selectively raised off of the surface 364).

Referring to FIG. 10, according to various aspects, the wheelchair assembly 300 may be driven by the mecanum wheel 1016 and the mecanum wheel 1056 while the first mecanum wheel 1002*a* and the second mecanum wheel 1008*a* at foot joint 340 and the first mecanum wheel 1002*b* and the second mecanum wheel 1008*b* at knee joint 338 operate passively (e.g., may act as a caster, and/or the like). According to such an aspect, to realize "D" movement, the mecanum wheel 1016 and the mecanum wheel 1056 may rotate in a forward or distal "D" direction at an equal speed to propel/drive the wheelchair assembly 300 in the "D" direction. Alternatively, to realize "D+LD1" movement, the mecanum wheel 1016 may rotate in a forward or distal "D" direction at a first speed and the mecanum wheel 1056 may rotate in a forward or distal "D" direction at a second speed slower than the first speed to propel/drive the wheelchair assembly 300 in the "D+LD1" direction. Alternatively, to realize "D+LD2" movement, the mecanum wheel 1016 may rotate in a forward or distal "D" direction at a first speed and the second mecanum wheel 1056 may rotate in a forward or distal "D" direction at a second speed faster than the first speed to propel/drive the wheelchair assembly 300 in the "D+LD2" direction. Alternatively, to realize "P" movement, the mecanum wheel 1016 and the mecanum wheel 1056 may rotate in a reverse or proximal "P" direction at an equal speed to propel/drive the wheelchair assembly 300 in the "P" direction. Alternatively, to realize "P+LD1" movement, the mecanum wheel 1016 may rotate in a reverse or proximal "P" direction at a first speed and the mecanum wheel 1056 may rotate in a reverse or proximal "P" direction at a second speed slower than the first speed to propel/drive the wheelchair assembly 300 in the "P+LD1" direction. Alternatively, to realize "P+LD2" movement, the mecanum wheel 1016 may rotate in a reverse or proximal "P" direction at a first speed and the mecanum wheel 1056 may rotate in reverse or proximal "P" direction at a second speed faster than the first speed to propel/drive the wheelchair assembly 300 in the "P+LD2" direction.

Still referring to FIG. 10, according to various aspects, the wheelchair assembly 300 may be driven by the first mecanum wheel 1002*a* and the second mecanum wheel 1008*a* at foot joint 340 and the first mecanum wheel 1002*b* and the second mecanum wheel 1008*b* at knee joint 338 while the mecanum wheel 1016 and the mecanum wheel 1056 operate passively (e.g., may act as a caster, and/or the like). According to such an aspect, to realize "D" movement, the first mecanum wheel 1002*a* and the second mecanum wheel 1008*a* at the foot joint 340 as well as the first mecanum wheel 1002*b* and the second mecanum wheel 1008*b* at the knee joint 338 may rotate in a forward or distal "D" direction at an equal speed to propel/drive the wheelchair assembly 300 in the "D" direction. Alternatively, to realize "D+LD1" movement, the first mecanum wheel 1002*a* at the foot joint 340 and the second mecanum wheel 1008*b* at the knee joint 338 may rotate in a forward or distal "D" direction at a first speed and the second mecanum wheel 1008*a* at the foot joint 340 and the first mecanum wheel 1002*b* at the knee joint 338 may rotate in a forward or distal "D" direction at a second speed slower than the first speed to propel/drive the wheelchair assembly 300 in the "D+LD1" direction. Alternatively, to realize "D+LD2" movement, the second mecanum wheel 1008*a* at the foot joint 340 and the first mecanum wheel 1002*b* at the knee joint 338 may rotate in a forward or distal "D" direction at a first speed and the first mecanum wheel 1002*a* at the foot joint 340 and the second mecanum wheel 1008*b* at the knee joint 338 may rotate in a forward or distal "D" direction at a second speed slower than the first speed to propel/drive the wheelchair assembly 300 in the "D+LD2" direction. Alternatively, to realize "P" movement, the first mecanum wheel 1002*b* and the second mecanum wheel 1008*b* at the knee joint 338 as well as the first mecanum wheel 1002*a* and the second mecanum wheel 1008*a* at the foot joint 340 may rotate in a reverse or proximal "P" direction at an equal speed to propel/drive the wheelchair assembly in the "P" direction. Alternatively, to realize "P+LD1" movement, the first mecanum wheel 1002*a* at the foot joint 340 and the second mecanum wheel 1008*b* at the knee joint 338 may rotate in a reverse or proximal "P" direction at a first speed and the second mecanum wheel 1008*a* at the foot joint 340 and the first mecanum wheel 1002*b* at the knee joint 338 may rotate in a reverse or proximal "P" direction at a second speed slower than the first speed to propel/drive the wheelchair assembly 300 in the "P+LD1" direction. Alternatively, to realize "P+LD2" movement, the second mecanum wheel 1008*a* at the foot joint 340 and the first mecanum wheel 1002*b* at the knee joint 338 may rotate in a reverse or proximal "P" direction at a first speed and the first mecanum wheel 1002*a* at the foot joint 340 and the second mecanum wheel 1008*b* at the knee joint 338 may rotate in a reverse or proximal "P" direction at a second speed slower than the first speed to propel/drive the wheelchair assembly 300 in the "P+LD2" direction. More specifically, since only omni-directional wheels (e.g., mecanum wheels) are in contact with the surface 364, LD1 and LD2 movement may also be realized. To realize LD1 movement, the first mecanum wheel 1002 at the foot joint 340 and the first mecanum wheel 1002*b* at the knee joint 338 may rotate in a forward or distal "D" direction at a first speed while the second mecanum wheel 1008*a* at the foot joint 340 and the second mecanum wheel 1008*b* at the knee joint 338 rotate in a reverse or proximal "P" direction at a second speed equal to the first speed to propel/drive the wheelchair assembly 300 in the LD1 direction. Alternatively, to realize LD2 movement, the first mecanum wheel 1002*a* at the foot joint 340 and the first mecanum wheel 1002*b* at the knee joint 338 may rotate in a reverse or proximal "P" direction at a first speed while the second mecanum wheel 1008*a* at the foot joint 340 and the second mecanum wheel 1008*b* at the knee joint 338 rotate in a forward or distal "D" direction at a second speed equal to the first speed to propel/drive the wheelchair assembly 300 in the LD2 direction. Furthermore, in such an aspect, the wheelchair assembly 300 is able to rotate or turn, in place, with a minimal or zero turning radius. To realize rotation in a first direction (e.g., rotate right RR) the first mecanum wheel 1002*a* at the foot joint 340 and the second mecanum wheel 1008*b* at the knee joint 338 may rotate in a forward or distal "D" direction at a first speed and the second mecanum wheel 1008*a* at the foot joint 340 and the first mecanum wheel 1002*b* at the knee joint 338 may rotate in a reverse or proximal "P" direction at a second speed equal to the first speed to rotate the wheelchair assembly 300, in place, in the first direction (e.g. rotate right RR). Similarly, to realize rotation in a second direction (e.g., rotate left RL) the first mecanum wheel 1002*a* at the foot joint 340 and the second mecanum wheel 1008*b* at the knee joint 338 may rotate in a reverse or proximal "P" direction at a first speed and the second mecanum wheel 1008*a* at the foot joint 340 and the first mecanum wheel 1002*b* at the knee joint 338 may rotate in a forward or distal "D" direction at a second speed equal to the first speed to rotate the wheelchair assembly 300, in place, in the second direction (e.g. rotate left RL).

Still referring to FIG. 10, according to various aspects, the wheelchair assembly 300 may be driven by the first mecanum wheel 1002*a* and the second mecanum wheel 1008*a* at foot joint 340, the first mecanum wheel 1002*b* and the second mecanum wheel 1008*b* at knee joint 338, the mecanum wheel 1016, and the mecanum wheel 1056. According to such an aspect, to realize "D" movement, the first mecanum wheel 1002*a* and the second mecanum wheel 1008*a* at the foot joint 340, the first mecanum wheel 1002*b* and the second mecanum wheel 1008*b* at the knee joint 338, the mecanum wheel 1016, and the mecanum wheel 1056 may rotate in a forward or distal "D" direction at an equal speed to propel/drive the wheelchair assembly 300 in the "D" direction. Alternatively, to realize "D+LD1" movement, the first mecanum wheel 1002*a* at the foot joint 340, the second mecanum wheel 1008*b* at the knee joint 338, and the mecanum wheel 1016 may rotate in a forward or distal "D" direction at a first speed and the second mecanum wheel 1008*a* at the foot joint 340, the first mecanum wheel 1002*b* at the knee joint 338, and the mecanum wheel 1056 may rotate in a forward or distal "D" direction at a second speed slower than the first speed to propel/drive the wheelchair assembly 300 in the "D+LD1" direction. In another aspect, to realize "D+LD1" movement, the first mecanum wheel 1002*a* at the foot joint 340 and the second mecanum wheel 1008*b* at the knee joint 338 may rotate in a forward or distal "D" direction at a first speed and the second mecanum wheel 1008*a* at the foot joint 340 and the first mecanum wheel 1002*b* at the knee joint 338 may rotate in a forward or distal "D" direction at a second speed slower than the first speed while the mecanum wheel 1016 and mecanum wheel 1056 rotate in a forward or distal "D" direction at an equal speed to propel/drive the wheelchair assembly 300 in the "D+LD1" direction. Alternatively, to realize "D+LD2" movement, the second mecanum wheel 1008*a* at the foot joint 340, the first mecanum wheel 1002*b* at the knee joint 338, and the mecanum wheel 1056 may rotate in a forward or distal "D" direction at a first speed and the first mecanum wheel 1002*a* at the foot joint 340, the second mecanum wheel 1008*b* at the knee joint 338, and the mecanum wheel 1016 may rotate in a forward or distal "D" direction at a second speed slower than the first speed to propel/drive the wheelchair assembly 300 in the "D+LD2" direction. In another aspect, to realize "D+LD2" movement, the second mecanum wheel 1008*a* at the foot joint 340 and the first mecanum wheel 1002*b* at the knee joint 338 may rotate in a forward or distal "D" direction at a first speed and the first mecanum wheel 1002*a* at the foot joint 340 and the second mecanum wheel 1008*b* at the knee joint 338 may rotate in a forward or distal "D" direction at a second speed slower than the first speed while the mecanum wheel 1016 and mecanum wheel 1056 rotate in a forward or distal "D" direction at an equal speed to propel/drive the wheelchair assembly 300 in the "D+LD2" direction. Alternatively, to realize "P" movement, the first mecanum wheel 1002*b* and the second mecanum wheel 1008*b* at the knee joint 338, the first mecanum wheel 1002*a* and the second mecanum wheel 1008*a* at the foot joint 340, the mecanum wheel 1016 and the mecanum wheel 1056 may rotate in a reverse or proximal "P" direction at an equal speed to propel/drive the wheelchair assembly in the "P" direction. Alternatively, to realize "P+LD1" movement, the first mecanum wheel 1002*a* at the foot joint 340, the second mecanum wheel 1008*b* at the knee joint 338, and the mecanum wheel 1016 may rotate in a reverse or proximal "P" direction at a first speed and the second mecanum wheel 1008*a* at the foot joint 340, the first mecanum wheel 1002*b* at the knee joint 338, and the mecanum wheel 1056 may rotate in a reverse or proximal "P" direction at a second speed slower than the first speed to propel/drive the wheelchair assembly 300 in the "P+LD1" direction. In another aspect, to realize "P+LD1" movement, the first mecanum wheel 1002*a* at the foot joint 340 and the second mecanum wheel 1008*b* at the knee joint 338 may rotate in a reverse or proximal "P" direction at a first speed and the second mecanum wheel 1008*a* at the foot joint 340 and the first mecanum wheel 1002*b* at the knee joint 338 may rotate in a reverse or proximal "P" direction at a second speed slower than the first speed while the mecanum wheel 1016 and the mecanum wheel 1056 rotate in a reverse or proximal "P" direction at an equal speed to propel/drive the wheelchair assembly 300 in the "P+LD1" direction. Alternatively, to realize "P+LD2" movement, the second mecanum wheel 1008*a* at the foot joint 340, the first mecanum wheel 1002*b* at the knee joint 338, and the mecanum wheel 1056 may rotate in a reverse or proximal "P" direction at a first speed and the first mecanum wheel 1002*a* at the foot joint 340, the second mecanum wheel 1008*b* at the knee joint 338, and the mecanum wheel 1016 may rotate in a reverse or proximal "P" direction at a second speed slower than the first speed to propel/drive the wheelchair assembly 300 in the "P+LD2" direction. In another aspect, to realize "P+LD2" movement, the second mecanum wheel 1008*a* at the foot joint 340 and the first mecanum wheel 1002*b* at the knee joint 338 may rotate in a reverse or proximal "P" direction at a first speed and the first mecanum wheel 1002*a* at the foot joint 340 and the second mecanum wheel 1008*b* at the knee joint 338 may rotate in a reverse or proximal "P" direction at a second speed slower than the first speed while the mecanum wheel 1016 and the mecanum wheel 1056 rotate in a reverse or proximal "P" direction at an equal speed to propel/drive the wheelchair assembly 300 in the "P+LD2" direction. Again, since only omni-directional wheels (e.g., mecanum wheels) are in contact with the surface 364, LD1 and LD2 movement may also be realized. To realize LD1 movement, the first mecanum wheel 1002*a* at the foot joint 340, the first mecanum wheel 1002*b* at the knee joint 338, and the mecanum wheel 1016 may rotate in a forward or distal "D" direction at a first speed while the second mecanum wheel 1008*a* at the foot joint 340, the second mecanum wheel 1008*b* at the knee joint 338, and the mecanum wheel 1056 rotate in a reverse or proximal "P" direction at a second speed equal to the first speed to propel/drive the wheelchair assembly 300 in the LD1 direction. Alternatively, to realize LD2 movement, the first mecanum wheel 1002*a* at the foot joint 340, the first mecanum wheel 1002*b* at the knee joint 338, and the mecanum wheel 1016 may rotate in a reverse or proximal "P" direction at a first speed while the second mecanum wheel 1008*a* at the foot joint 340, the second mecanum wheel 1008*b* at the knee joint 338, and the mecanum wheel 1056 rotate in a forward or distal "D" direction at a second speed equal to the first speed to propel/drive the wheelchair assembly 300 in the LD2 direction. Furthermore, in such an aspect, the wheelchair assembly 300 is able to rotate or turn, in place, with a minimal or zero turning radius. To realize rotation in a first direction (e.g., rotate right RR) the first mecanum wheel 1002*a* at the foot joint 340 and the second mecanum wheel 1008*b* at the knee joint 338 may rotate in a forward or distal "D" direction at a first speed and the second mecanum wheel 1008*a* at the foot joint 340 and the first mecanum wheel 1002*b* at the knee joint 338 may rotate in a reverse or proximal "P" direction at a second speed equal to the first speed while the mecanum wheel 1016 rotates in a forward or distal "D" direction at a third speed and the mecanum wheel 1056 rotates in a reverse or proximal "P" direction at a fourth speed equal to the third speed to rotate the wheelchair assembly 300, in place, in the first direction (e.g. rotate right RR). Similarly, to realize rotation in a second direction (e.g., rotate left RL) the first mecanum wheel 1002*a* at the foot joint 340 and the second mecanum wheel 1008*b* at the knee joint 338 may rotate in a reverse or proximal "P" direction at a first speed and the second mecanum wheel 1008*a* at the foot joint 340 and the first mecanum wheel 1002*b* at the knee joint 338 may rotate in a forward or distal "D" direction at a second speed equal to the first speed while the mecanum wheel 1016 rotates in a reverse or proximal "P" direction at a third speed and the mecanum wheel 1056 rotates in a forward or distal "D" direction at a fourth speed equal to the third speed to rotate the wheelchair assembly 300, in place, in the second direction (e.g. rotate left RL).

Still referring to FIG. 10, according to an alternative aspect herein, the first mecanum wheel 1002*a* and the second mecanum wheel 1008*a* at the foot joint 340 may be selectively raised off of the surface 364. In such an aspect, only omni-directional wheels would remain in contact with the surface 364. According to such an aspect, to realize "D" movement, the first mecanum wheel 1002*b* and the second mecanum wheel 1008*b* at the knee joint 338, the mecanum wheel 1016, and the mecanum wheel 1056 may rotate in a forward or distal "D" direction at an equal speed to propel/drive the wheelchair assembly 300 in the "D" direction. Alternatively, to realize "D+LD1" movement, the mecanum wheel 1016 and the second mecanum wheel 1008*b* at the knee joint 338 may rotate in a forward or distal "D" direction at a first speed and the mecanum wheel 1056 and the first mecanum wheel 1002*b* at the knee joint 338 may rotate in a forward or distal "D" direction at a second speed slower than the first speed to propel/drive the wheelchair assembly 300 in the "D+LD1" direction. Alternatively, to realize "D+LD2" movement, the mecanum wheel 1056 and the first mecanum wheel 1002*b* at the knee joint 338 may rotate in a forward or distal "D" direction at a first speed and the mecanum wheel 1016 and the second mecanum wheel 1008*b* at the knee joint 338 may rotate in a forward or distal "D" direction at a second speed slower than the first speed to propel/drive the wheelchair assembly 300 in the "D+LD2" direction. Alternatively, to realize "P" movement, the first mecanum wheel 1002*b* and the second mecanum wheel 1008*b* at the knee joint 338, the mecanum wheel 1016, and the mecanum wheel 1056 may rotate in a reverse or proximal "P" direction at an equal speed to propel/drive the wheelchair assembly in the "P" direction. Alternatively, to realize "P+LD1" movement, the mecanum wheel 1016 and the second mecanum wheel 1008*b* at the knee joint 338 may rotate in a reverse or proximal "P" direction at a first speed and the mecanum wheel 1056 and the first mecanum wheel 1002*b* at the knee joint 338 may rotate in a reverse or proximal "P" direction at a second speed slower than the first speed to propel/drive the wheelchair assembly 300 in the "P+LD1" direction. Alternatively, to realize "P+LD2" movement, the mecanum wheel 1056 and the first mecanum wheel 1002*b* at the knee joint 338 may rotate in a reverse or proximal "P" direction at a first speed and the mecanum wheel 1016 and the second mecanum wheel 1008*b* at the knee joint 338 may rotate in a reverse or proximal "P" direction at a second speed slower than the first speed to propel/drive the wheelchair assembly 300 in the "P+LD2" direction. Yet again, since only omni-directional wheels (e.g., mecanum wheels) are in contact with the surface 364, LD1 and LD2 movement may also be realized. To realize LD1 movement, the mecanum wheel 1016 and the first mecanum wheel 1002*b* at the knee joint 338 may rotate in a forward or distal "D" direction at a first speed while the mecanum wheel 1056 and the second mecanum wheel 1008*b* at the knee joint 338 rotate in a reverse or proximal "P" direction at a second speed equal to the first speed to propel/drive the wheelchair assembly 300 in the LD1 direction. Alternatively, to realize LD2 movement, the mecanum wheel 1016 and the first mecanum wheel 1002*b* at the knee joint 338 may rotate in a reverse or proximal "P" direction at a first speed while the mecanum wheel 1056 and the second mecanum wheel 1008*b* at the knee joint 338 rotate in a forward or distal "D" direction at a second speed equal to the first speed to propel/drive the wheelchair assembly 300 in the LD2 direction. Furthermore, in such an aspect, the wheelchair assembly 300 is able to rotate or turn, in place, with a minimal or zero turning radius. To realize rotation in a first direction (e.g., rotate right RR) the mecanum wheel 1016 and the second mecanum wheel 1008*b* at the knee joint 338 may rotate in a forward or distal "D" direction at a first speed and the mecanum wheel 1056 and the first mecanum wheel 1002*b* at the knee joint 338 may rotate in a reverse or proximal "P" direction at a second speed equal to the first speed to rotate the wheelchair assembly 300, in place, in the first direction (e.g. rotate right RR). Similarly, to realize rotation in a second direction (e.g., rotate left RL) the mecanum wheel 1016 and the second mecanum wheel 1008*b* at the knee joint 338 may rotate in a reverse or proximal "P" direction at a first speed and the mecanum wheel 1056 and the first mecanum wheel 1002*b* at the knee joint 338 may rotate in a forward or distal "D" direction at a second speed equal to the first speed to rotate the wheelchair assembly 300, in place, in the second direction (e.g. rotate left RL). Notably, the movements of such an aspect similarly apply to an embodiment where the first mecanum wheel 1002*a* and the second mecanum wheel 1008*a* at the foot joint 340 are substituted with a standard wheel (e.g., see FIG. 1B).

Viewing FIG. 10 in light of FIG. 9C as described above, it should be understood that the lower leg assembly 328 of FIG. 10 including the first mecanum wheel 1002*a* and the second mecanum wheel 1008*a* positioned at foot joint 340 and the first mecanum wheel 1002*b* and the second mecanum wheel 1008*b* positioned at knee joint 338 may be separated into a lower leg assembly 328*a* (e.g., including the first mecanum wheel 1002*a* at foot joint 340*a* and the second mecanum wheel 1008*b* at knee joint 338*a*) and a lower leg assembly 328*b* (e.g., including the second mecanum wheel 1008*a* at foot joint 340*b* and the first mecanum wheel 1002*b* at knee joint 338*b*). In such an aspect, the lower leg assembly 328*a* may be part of a leg module 385*a* and the lower leg assembly 328*b* may be part of separate leg module 385*b*. Stated differently, embodiments including four leg modules 380, 385*a*, 385*b*, and 390 are contemplated by the present disclosure. Embodiments including more than four leg modules are also contemplated.

Omni-Wheels

An omni-directional wheel, as referenced herein, may alternatively include an omni-wheel 1100 as illustrated in FIG. 11. In view of FIG. 11, an omni-wheel 1100 may include a plurality of rollers 1102 rotatably coupled around a circumference of the omni-wheel 1100. Each of the plurality of rollers 1102 may be coupled to the circumference of the omni-wheel 1100 such that an axis of rotation of each roller 1102 (e.g., axis I-I) is perpendicular to the axis of rotation of the omni-wheel (e.g., axis J-J). According to various aspects described herein, rotation of the plurality of rollers 1102 (e.g., passively, driven via motor(s) and/or drive shaft(s) coupled to each roller, and/or the like) permit movement of the omni-wheel 1100 (e.g., and components coupled thereto) in a first lateral "LD1" direction and a second lateral "LD2" direction, as depicted in FIG. 11. The plurality of rollers 1102 are also rotatable about the axis of rotation of the omni-wheel (e.g., axis J-J) to realize movement in a distal "D" direction and a proximal "P" direction, as depicted in FIG. 11. According to various embodiments, each roller 1102 may be selectively and independently driven (e.g., via motor(s), drive shaft(s), and/or the like) to move in the first lateral "LD1" direction and the second lateral "LD2" direction as depicted in FIG. 11. According to other embodiments, each roller may not be selectively and independently driven (e.g., may operate passively, may act as a caster, and/or the like) to move in the first lateral "LD1" direction and the second lateral "LD2" direction as depicted in FIG. 11. According to further embodiments, some of the rollers 1102 may be selectively and independently driven while other of the rollers 1102 may not be selectively and independently driven to move in the first lateral "LD1" direction and the second lateral "LD2" direction. According to alternative aspects, the each roller 1102 may be selectively rotatable (e.g., at any angle) about an axis (e.g., axis K-K) perpendicular to its axis of rotation (e.g., axis I-I) to mimic a mecanum wheel (e.g., see FIG. 7), to mimic a caster (e.g., active or passive) and/or to realize movement in any selectable direction.

Figure 12:
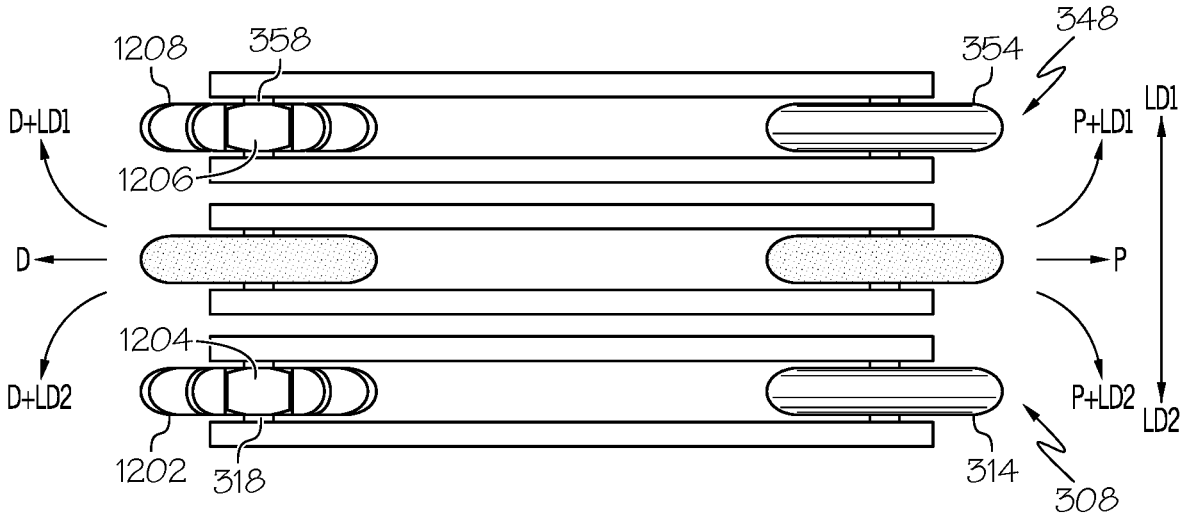
FIG. 12 depicts an illustrative top-down view of the respective lower leg assemblies of FIG. 3B, where an omni-wheel is positioned as the knee wheel of the lower leg assembly of the first leg module and the lower leg assembly of the third leg module, as well as associated maneuverability options according to one or more embodiments shown and described herein.

FIG. 12, for example, illustrates a first omni-wheel 1202 positioned at knee joint 318 of the lower leg assembly 308 and a second omni-wheel 1208 positioned at knee joint 358 of lower leg assembly 348. As discussed herein, in RWD mode, since the foot wheel 314 and the foot wheel 354 are driven to propel the wheelchair assembly, the first omni-wheel 1202 and the second omni-wheel 1208 may not be driven by a motor (e.g., may operate passively, may act as a caster, and/or the like). Alternatively, in the RWD mode, the first omni-wheel 1202 and the second omni-wheel 1208 may also be driven. According to such an aspect, to realize "D" movement, the first omni-wheel 1202 and the second omni-wheel 1208 may rotate in a forward or distal "D" direction at an equal speed to aid the foot wheels 314, 354 (e.g., rotating in a forward or distal "D" direction) in propelling/driving the wheelchair assembly in the "D" direction. In such an aspect, first rollers 1204 of the first omni-wheel 1202 and second rollers 1206 of the second omni-wheel 1208 may not rotate. Alternatively, to realize "D+LD1" movement, the first rollers 1204 of the first omni-wheel 1202 may rotate in an "LD1" direction and the second rollers 1206 of the second omni-wheel 1208 may rotate in an "LD1" direction to aid the foot wheel 314 (e.g., rotating in a forward or distal "D" direction at a first speed) and the foot wheel 354 (e.g., rotating in a forward or distal "D" direction at a second speed slower than the first speed) in propelling/driving the wheelchair assembly in the "D+LD1" direction. In such an aspect, the first omni-wheel 1202 may rotate in a forward or distal "D" direction at a third speed and the second omni-wheel 1208 may rotate in a forward or distal "D" direction at a fourth speed slower than the third speed to further aid the foot wheel 314 and the foot wheel 354 in propelling/driving the wheelchair assembly in the "D+LD1" direction. Alternatively, to realize "D+LD2" movement, the first rollers 1204 of the first omni-wheel 1202 may rotate in an "LD2" direction and the second rollers 1206 of the second omni-wheel 1208 may rotate in an "LD2" direction to aid the foot wheel 314 (e.g., rotating in a forward or distal "D" direction at a first speed) and the foot wheel 354 (e.g., rotating in a forward or distal "D" direction at a second speed faster than the first speed) in propelling/driving the wheelchair assembly in the "D+LD1" direction. In such an aspect, the first omni-wheel 1202 may rotate in a forward or distal "D" direction at a third speed and the second omni-wheel 1208 may rotate in a forward or distal "D" direction at a fourth speed faster than the third speed to further aid the foot wheel 314 and the foot wheel 354 in propelling/driving the wheelchair assembly in the "D+LD2" direction. Alternatively, to realize "P" movement, the first omni-wheel 1202 and the second omni-wheel 1208 may rotate in a reverse or proximal "P" direction at an equal speed to aid the foot wheels 314, 354 (e.g., rotating in a reverse or proximal "P" direction) in propelling/driving the wheelchair assembly in the "P" direction. In such an aspect, first rollers 1204 of the first omni-wheel 1202 and second rollers 1206 of the second omni-wheel 1208 may not rotate. Alternatively, to realize "P+LD1" movement, the first rollers 1204 of the first omni-wheel 1202 may rotate in an "LD2" direction and the second rollers 1206 of the second omni-wheel 1208 may rotate in an "LD2" direction to aid the foot wheel 314 (e.g., rotating in a reverse or proximal "P" direction at a first speed) and the foot wheel 354 (e.g., rotating in a reverse or proximal "P" direction at a second speed slower than the first speed) in propelling/driving the wheelchair assembly in the "P+LD1" direction. In such an aspect, the first omni-wheel 1202 may rotate in a reverse or proximal "P" direction at a third speed and the second omni-wheel 1208 may rotate in a reverse or proximal "P" direction at a fourth speed slower than the third speed to further aid the foot wheel 314 and the foot wheel 354 in propelling/driving the wheelchair assembly in the "P+LD1" direction. Alternatively, to realize "P+LD2" movement, the first rollers 1204 of the first omni-wheel 1202 may rotate in an "LD1" direction and the second rollers 1206 of the second omni-wheel 1208 may rotate in an "LD1" direction to aid the foot wheel 314 (e.g., rotating in a reverse or proximal "P" direction at a first speed) and the foot wheel 354 (e.g., rotating in a reverse or proximal "P" direction at a second speed faster than the first speed) in propelling/driving the wheelchair assembly in the "P+LD2" direction. In such an aspect, the first omni-wheel 1202 may rotate in a reverse or proximal "P" direction at a third speed and the second omni-wheel 1208 may rotate in a reverse or proximal "P" direction at a fourth speed faster than the third speed to further aid the foot wheel 314 and the foot wheel 354 in propelling/driving the wheelchair assembly in the "P+LD1" direction. Notably, in FWD mode, the first omni-wheel 1202 and the second omni-wheel 1208 may similarly drive the wheelchair assembly in the "D", "D+LD1", "D+LD2", "P", "P+LD1" and "P+LD2" directions, as discussed herein, while the foot wheels 314, 354 rotate in a passive manner.

Figure 13:
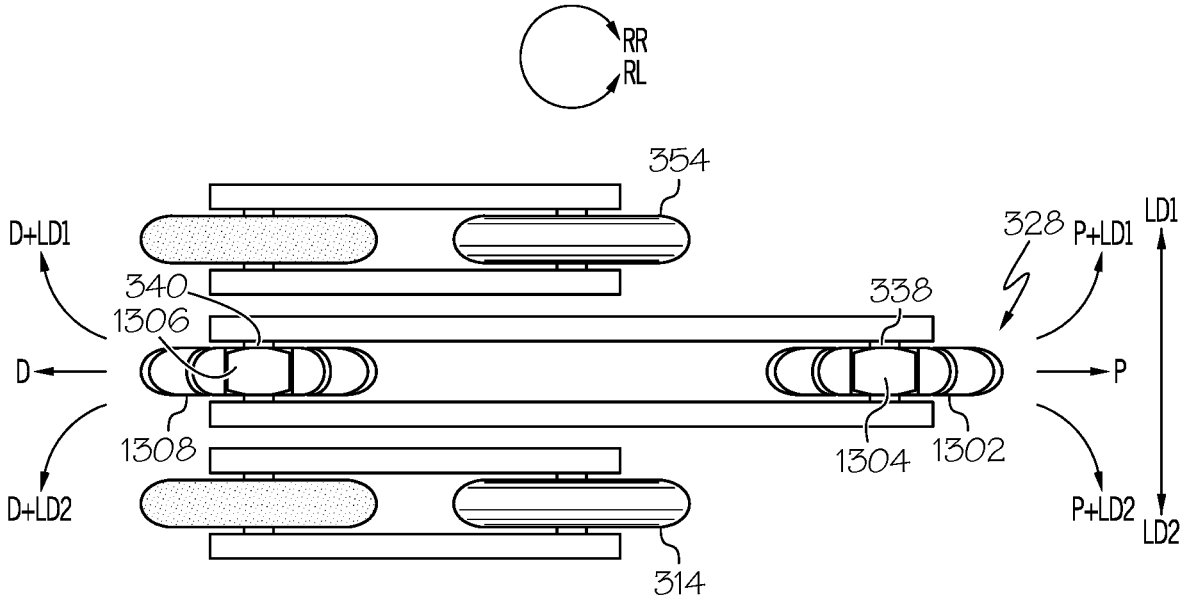
FIG. 13 depicts an illustrative top-down view of the respective lower leg assemblies of FIG. 4B, where an omni-wheel is positioned as the knee wheel and the foot wheel of the lower leg assembly of the second leg module, as well as associated maneuverability options according to one or more embodiments shown and described herein.

FIG. 13, as another example, illustrates a first omni-wheel 1302 positioned at knee joint 338 of the lower leg assembly 328 and a second omni-wheel 1308 positioned at foot joint 340 of lower leg assembly 328. As discussed herein, in MWD mode, since the foot wheel 314 and the foot wheel 354 are driven to propel the wheelchair assembly, neither the first omni-wheel 1302 nor the second omni-wheel 1308 may be driven (e.g., may operate passively, may act as a caster, and/or the like). For example, to realize "D" movement the foot wheel 314 and the foot wheel 354 may rotate in a forward or distal "D" direction at an equal speed to propel/drive the wheelchair assembly in the "D" direction while the first omni-wheel 1302 and the second omni-wheel 1308 operate passively. Alternatively, in the MWD mode, the first omni-wheel 1302 and the second omni-wheel 1308 may also be driven. According to such an aspect, to realize "D" movement, the first omni-wheel 1302 and the second omni-wheel 1308 may rotate in a forward or distal "D" direction at an equal speed to aid the foot wheels 314, 354 (e.g., rotating in a forward or distal "D" direction) in propelling/driving the wheelchair assembly in the "D" direction. In such an aspect, first rollers 1304 of the first omni-wheel 1302 and second rollers 1306 of the second omni-wheel 1308 may not rotate. Alternatively, to realize "D+LD1" movement, the first rollers 1304 of the first omni-wheel 1302 may rotate in an "LD2" direction and the second rollers 1306 of the second omni-wheel 1308 may rotate in an "LD1" direction to aid the foot wheel 314 (e.g., rotating in a forward or distal "D" direction at a first speed) and the foot wheel 354 (e.g., rotating in a forward or distal "D" direction at a second speed slower than the first speed) in propelling/driving the wheelchair assembly in the "D+LD1" direction. In such an aspect, the first omni-wheel 1302 and the second omni-wheel 1308 may rotate in a forward or distal "D" direction at a third speed to further aid the foot wheel 314 and the foot wheel 354 in propelling/driving the wheelchair assembly in the "D+LD1" direction. Alternatively, to realize "D+LD2" movement, the first rollers 1304 of the first omni-wheel 1302 may rotate in an "LD1" direction and the second rollers 1306 of the second omni-wheel 1308 may rotate in an "LD2" direction to aid the foot wheel 314 (e.g., rotating in a forward or distal "D" direction at a first speed) and the foot wheel 354 (e.g., rotating in a forward or distal "D" direction at a second speed faster than the first speed) in propelling/driving the wheelchair assembly in the "D+LD2" direction. In such an aspect, the first omni-wheel 1302 and the second omni-wheel 1308 may rotate in a forward or distal "D" direction at a third speed to further aid the foot wheel 314 and the foot wheel 354 in propelling/driving the wheelchair assembly in the "D+LD2" direction. Alternatively, to realize "P" movement the foot wheel 314 and the foot wheel 354 may rotate in a reverse or proximal "P" direction at an equal speed to propel/drive the wheelchair assembly in the "P" direction while the first omni-wheel 1302 and the second omni-wheel 1308 operate passively. Alternatively, in the MWD mode, the first omni-wheel 1302 and the second omni-wheel 1308 may also be driven. According to such an aspect, to realize "P" movement, the first omni-wheel 1302 and the second omni-wheel 1308 may rotate in a reverse or proximal "P" direction at an equal speed to aid the foot wheels 314, 354 (e.g., rotating in a reverse or proximal "P" direction) in propelling/driving the wheelchair assembly in the "P" direction. In such an aspect, first rollers 1304 of the first omni-wheel 1302 and second rollers 1306 of the second omni-wheel 1308 may not rotate. Alternatively, to realize "P+LD1" movement, the first rollers 1304 of the first omni-wheel 1302 may rotate in an "LD1" direction and the second rollers 1306 of the second omni-wheel 1308 may rotate in an "LD2" direction to aid the foot wheel 314 (e.g., rotating in a reverse or proximal "P" direction at a first speed) and the foot wheel 354 (e.g., rotating in a reverse or proximal "P" direction at a second speed slower than the first speed) in propelling/driving the wheelchair assembly in the "P+LD1" direction. In such an aspect, the first omni-wheel 1302 and the second omni-wheel 1308 may rotate in a reverse or proximal "P" direction at a third speed to further aid the foot wheel 314 and the foot wheel 354 in propelling/driving the wheelchair assembly in the "P+LD1" direction. Alternatively, to realize "P+LD2" movement, the first rollers 1304 of the first omni-wheel 1302 may rotate in an "LD2" direction and the second rollers 1306 of the second omni-wheel 1308 may rotate in an "LD1" direction to aid the foot wheel 314 (e.g., rotating in a reverse or proximal "P" direction at a first speed) and the foot wheel 354 (e.g., rotating in a reverse or proximal "P" direction at a second speed faster than the first speed) in propelling/driving the wheelchair assembly in the "P+LD2" direction. In such an aspect, the first omni-wheel 1302 and the second omni-wheel 1308 may rotate in a reverse or proximal "P" direction at a third speed to further aid the foot wheel 314 and the foot wheel 354 in propelling/driving the wheelchair assembly in the "P+LD2" direction.

Furthermore, in the MWD mode, the wheelchair assembly 300 is able to rotate or turn, in place, with a minimal or zero turning radius. To realize rotation in a first direction (e.g., rotate right RR) the first rollers 1304 of the first omni-wheel 1302 may rotate in an "LD2" direction at a first speed and the second rollers 1306 of the second omni-wheel 1308 may rotate in an "LD1" direction at a second speed equal to the first speed while the foot wheel 314 rotates in a forward or distal "D" direction at a third speed and the foot wheel 354 rotates in a reverse or proximal "P" direction at a fourth speed equal to the third speed to rotate the wheelchair assembly 300, in place, in the first direction (e.g. rotate right RR). Similarly, to realize rotation in a second direction (e.g., rotate left RL) the first rollers 1304 of the first omni-wheel 1302 may rotate in an "LD1" direction at a first speed and the second rollers 1306 of the second omni-wheel 1308 may rotate in an "LD2" direction at a second speed equal to the first speed while the foot wheel 314 rotates in a reverse or proximal "P" direction at a third speed and the foot wheel 354 rotates in a forward or distal "D" direction at a fourth speed equal to the third speed to rotate the wheelchair assembly 300, in place, in the second direction (e.g. rotate left RL).

Figure 14:
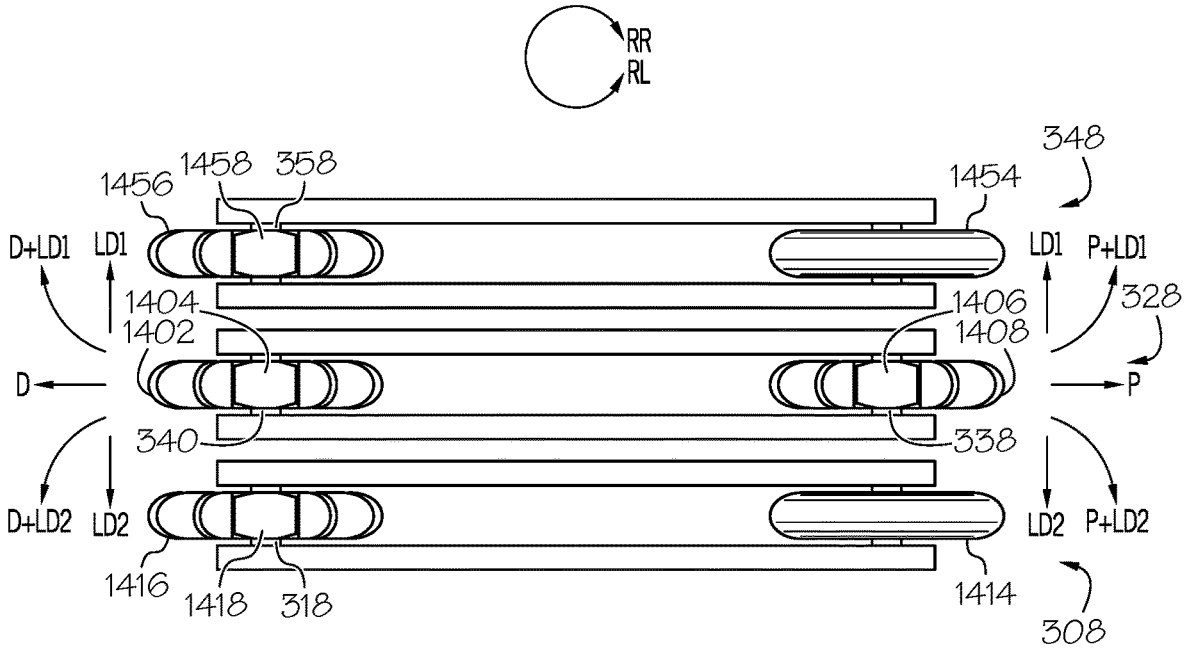
FIG. 14 depicts an illustrative top-down view of the respective lower leg assemblies of FIG. 5B, where an omni-wheel is positioned as the knee wheel of the lower leg assembly of the first leg module and the lower leg assembly of the third leg module, and where an omni-wheel is positioned as the knee wheel and the foot wheel of the lower leg assembly of the second leg module, as well as associated maneuverability options according to one or more embodiments shown and described herein.

As discussed herein, in OWD mode, the wheelchair assembly 300 may be driven in some embodiments by an omni-directional foot wheel (see FIG. 5B, e.g., foot wheel 334 at foot joint 340) and an omni-directional knee wheel (see FIG. 5B, e.g., knee wheel 336 at knee joint 338). FIG. 14, as another example, substitutes that foot wheel 334 at foot joint 340 of the lower leg assembly 328 with a first omni-wheel 1402 and substitutes that knee wheel 336 at knee joint 338 of the lower leg assembly 328 with a second omni-wheel 1408. According to such an aspect, each of the omni-wheels 1402, 1408 may be selectively driven to propel or move the wheelchair assembly 300. The wheelchair assembly 300 may be further driven by a third omni-wheel 1416 at knee joint 318 of the lower leg assembly 308 and fourth omni-wheel 1456 at knee joint 358 of the lower leg assembly 348. As previously discussed, in the OWD mode, only omni-directional wheels (e.g., omni-wheels 1402, 1408, 1416, and 1456) are in contact with the surface 364 (e.g., the foot wheel 1414 of the lower leg assembly 308 and the foot wheel 1454 of the lower leg assembly 348 are selectively raised off of the surface 364).

Referring to FIG. 14, according to various aspects, the wheelchair assembly 300 may be driven by the third omni-wheel 1416 at knee joint 318 and the fourth omni-wheel 1456 at knee joint 358 while the first omni-wheel 1402 at foot joint 340 and the second omni-wheel 1408 at knee joint 338 operate passively (e.g., may act as a caster, and/or the like). According to such an aspect, to realize "D" movement, the third omni-wheel 1416 and the fourth omni-wheel 1456 may rotate in a forward or distal "D" direction at an equal speed to propel/drive the wheelchair assembly 300 in the "D" direction. In such an aspect, third rollers 1418 of the third omni-wheel 1416 and the fourth rollers 1458 of the fourth omni-wheel 1456 may not rotate. Alternatively, to realize "D+LD1" movement, the third omni-wheel 1416 may rotate in a forward or distal "D" direction at a first speed and the fourth omni-wheel 1456 may rotate in a forward or distal "D" direction at a second speed slower than the first speed to propel/drive the wheelchair assembly 300 in the "D+LD1" direction. In such an aspect, the third rollers 1418 of the third omni-wheel 1416 and the fourth rollers 1458 of the fourth omni-wheel 1456 may rotate in an "LD1" direction to aid the third omni-wheel 1416 and the fourth omni-wheel 1456 in propelling/driving the wheelchair assembly 300 in the "D+LD1" direction. Alternatively, to realize "D+LD2" movement, the third omni-wheel 1416 may rotate in a forward or distal "D" direction at a first speed and the fourth omni-wheel 1456 may rotate in a forward or distal "D" direction at a second speed faster than the first speed to propel/drive the wheelchair assembly 300 in the "D+LD2" direction. In such an aspect, the third rollers 1418 of the third omni-wheel 1416 and the fourth rollers 1458 of the fourth omni-wheel 1456 may rotate in an "LD2" direction to aid the third omni-wheel 1416 and the fourth omni-wheel 1456 in propelling/driving the wheelchair assembly 300 in the "D+LD2" direction. Alternatively, to realize "P" movement, the third omni-wheel 1416 and the fourth omni-wheel 1456 may rotate in a reverse or proximal "P" direction at an equal speed to propel/drive the wheelchair assembly 300 in the "P" direction. In such an aspect, third rollers 1418 of the third omni-wheel 1416 and the fourth rollers 1458 of the fourth omni-wheel 1456 may not rotate. Alternatively, to realize "P+LD1" movement, the third omni-wheel 1416 may rotate in a reverse or proximal "P" direction at a first speed and the fourth omni-wheel 1456 may rotate in a reverse or proximal "P" direction at a second speed slower than the first speed to propel/drive the wheelchair assembly 300 in the "P+LD1" direction. In such an aspect, the third rollers 1418 of the third omni-wheel 1416 and the fourth rollers 1458 of the fourth omni-wheel 1456 may rotate in an "LD2" direction to aid the third omni-wheel 1416 and the fourth omni-wheel 1456 in propelling/driving the wheelchair assembly 300 in the "P+LD1" direction. Alternatively, to realize "P+LD2" movement, the third omni-wheel 1416 may rotate in a reverse or proximal "P" direction at a first speed and the fourth omni-wheel 1456 may rotate in reverse or proximal "P" direction at a second speed faster than the first speed to propel/drive the wheelchair assembly 300 in the "P+LD2" direction. In such an aspect, the third rollers 1418 of the third omni-wheel 1416 and the fourth rollers 1458 of the fourth omni-wheel 1456 may rotate in an "LD1" direction to aid the third omni-wheel 1416 and the fourth omni-wheel 1456 in propelling/driving the wheelchair assembly 300 in the "P+LD2" direction. More specifically, since only omni-directional wheels (e.g., omni-wheels) are in contact with the surface 364, LD1 and LD2 movement may also be realized. To realize LD1 movement, the third rollers 1418 of the third omni-wheel 1416 and the fourth rollers 1458 of the fourth omni-wheel 1456 may rotate in an "LD1" direction to propel/drive the wheelchair assembly 300 in the "LD1" direction. In such an aspect, the first rollers 1404 of the first omni-wheel 1402 and the second rollers 1406 of the second omni-wheel 1408 may rotate passively in the LD1 direction. Alternatively, to realize LD2 movement, the third rollers 1418 of the third omni-wheel 1416 and the fourth rollers 1458 of the fourth omni-wheel 1456 may rotate in an "LD2" direction to propel/drive the wheelchair assembly 300 in the "LD2" direction. In such an aspect, the first rollers 1404 of the first omni-wheel 1402 and the second rollers 1406 of the second omni-wheel 1408 may rotate passively in the LD2 direction.

Still referring to FIG. 14, according to various aspects, the wheelchair assembly 300 may be driven by the first omni-wheel 1402 at foot joint 340 and the second omni-wheel 1408 at knee joint 338 while the third omni-wheel 1416 and the fourth omni-wheel 1456 operate passively (e.g., may act as a caster, and/or the like). According to such an aspect, to realize "D" movement, the first omni-wheel 1402 as well as the second omni-wheel 1408 may rotate in a forward or distal "D" direction at an equal speed to propel/drive the wheelchair assembly 300 in the "D" direction. In such an aspect, first rollers 1404 of the first omni-wheel 1402 and the second rollers 1406 of the second omni-wheel 1408 may not rotate. Alternatively, to realize "D+LD1" movement, the first omni-wheel 1402 and the second omni-wheel 1408 may rotate in a forward or distal "D" direction while the first rollers 1404 of the first omni-wheel 1402 rotate in an "LD1" direction and the second rollers 1406 of the second omni-wheel 1408 rotate in an "LD2" direction to propel/drive the wheelchair assembly 300 in the "D+LD1" direction. Alternatively, to realize "D+LD2" movement, the first omni-wheel 1402 and the second omni-wheel 1408 may rotate in a forward or distal "D" direction while the first rollers 1404 of the first omni-wheel 1402 rotate in an "LD2" direction and the second rollers 1406 of the second omni-wheel 1408 rotate in an "LD1" direction to propel/drive the wheelchair assembly 300 in the "D+LD2" direction. Alternatively, to realize "P" movement, the first omni-wheel 1402 and the second omni-wheel 1408 may rotate in a reverse or proximal "P" direction at an equal speed to propel/drive the wheelchair assembly in the "P" direction. In such an aspect, first rollers 1404 of the first omni-wheel 1402 and the second rollers 1406 of the second omni-wheel 1408 may not rotate. Alternatively, to realize "P+LD1" movement, the first omni-wheel 1402 and the second omni-wheel 1408 may rotate in a reverse or proximal "P" direction while the first rollers 1404 of the first omni-wheel 1402 rotate in an "LD2" direction and the second rollers 1406 of the second omni-wheel 1408 rotate in an "LD1" direction to propel/drive the wheelchair assembly 300 in the "P+LD1" direction. Alternatively, to realize "P+LD2" movement, the first omni-wheel 1402 and the second omni-wheel 1408 may rotate in a reverse or proximal "P" direction while the first rollers 1404 of the first omni-wheel 1402 rotate in an "LD1" direction and the second rollers 1406 of the second omni-wheel 1408 rotate in an "LD2" direction to propel/drive the wheelchair assembly 300 in the "P+LD2" direction. More specifically, since only omni-directional wheels (e.g., omni-wheels) are in contact with the surface 364, LD1 and LD2 movement may also be realized. To realize LD1 movement, the first rollers 1404 of the first omni-wheel 1402 and the second rollers 1406 of the second omni-wheel 1408 may rotate in an "LD1" direction to propel/drive the wheelchair assembly 300 in the "LD1" direction. In such an aspect, the third rollers 1418 of the third omni-wheel 1416 and the fourth rollers 1458 of the fourth omni-wheel 1456 may rotate passively in the LD1 direction. Alternatively, to realize LD2 movement, the first rollers 1404 of the first omni-wheel 1402 and the second rollers 1406 of the second omni-wheel 1408 may rotate in an "LD2" direction to propel/drive the wheelchair assembly 300 in the "LD2" direction. In such an aspect, the third rollers 1418 of the third omni-wheel 1416 and the fourth rollers 1458 of the fourth omni-wheel 1456 may rotate passively in the LD2 direction. Furthermore, in such an aspect, the wheelchair assembly 300 is able to rotate or turn, in place, with a minimal or zero turning radius. To realize rotation in a first direction (e.g., rotate right RR) the first rollers 1404 of the first omni-wheel 1402 may rotate in an "LD1" direction at a first speed and the second rollers 1406 of the second omni-wheel 1408 may rotate in an "LD2" direction at a second speed equal to the first speed to rotate the wheelchair assembly 300, in place, in the first direction (e.g. rotate right RR). Similarly, to realize rotation in a second direction (e.g., rotate left RL) the first rollers 1404 of the first omni-wheel 1402 may rotate in an "LD2" direction at a first speed and the second rollers 1406 of the second omni-wheel 1408 may rotate in an "LD1" direction at a second speed equal to the first speed to rotate the wheelchair assembly 300, in place, in the second direction (e.g. rotate left RL).

Still referring to FIG. 14, according to various aspects, the wheelchair assembly 300 may be driven by the first omni-wheel 1402 at foot joint 340, the second omni-wheel 1408 at knee joint 338, the third omni-wheel 1416 at knee joint 318, and/or the fourth omni-wheel 1456 at knee joint 358. According to such an aspect, to realize "D" movement, the first omni-wheel 1402, the second omni-wheel 1408, the third omni-wheel 1416, and/or the fourth omni-wheel 1456 may rotate in a forward or distal "D" direction at an equal speed to propel/drive the wheelchair assembly 300 in the "D" direction. In such an aspect, the first rollers 1404 of the first omni-wheel 1402, the second rollers 1406 of the second omni-wheel 1408, the third rollers 1418 of the third omni-wheel 1416 and/or the fourth rollers 1458 of the fourth omni-wheel 1456 may not rotate. Alternatively, to realize "D+LD1" movement, the first omni-wheel 1402, the second omni-wheel 1408, the third omni-wheel 1416 and/or the fourth omni-wheel 1456 may rotate in a forward or distal "D" direction while the first rollers 1404 of the first omni-wheel 1402, the third rollers 1418 of the third omni-wheel 1416, and/or the fourth rollers 1458 of the fourth omni-wheel 1456 rotate in the "LD1" direction and the second rollers 1406 of the second omni-wheel 1408 rotate in the "LD2" direction to propel/drive the wheelchair assembly 300 in the "D+LD1" direction. Alternatively, to realize "D+LD2" movement, the first omni-wheel 1402, the second omni-wheel 1408, the third omni-wheel 1416 and/or the fourth omni-wheel 1456 may rotate in a forward or distal "D" direction while the first rollers 1404 of the first omni-wheel 1402, the third rollers 1418 of the third omni-wheel 1416, and/or the fourth rollers 1458 of the fourth omni-wheel 1456 rotate in the "LD2" direction and the second rollers 1406 of the second omni-wheel 1408 rotate in the "LD1" direction to propel/drive the wheelchair assembly 300 in the "D+LD2" direction. Alternatively, to realize "P" movement, the first omni-wheel 1402, the second omni-wheel 1408, the third omni-wheel 1416, and/or the fourth omni-wheel 1456 may rotate in a reverse or proximal "P" direction at an equal speed to propel/drive the wheelchair assembly 300 in the "P" direction. In such an aspect, the first rollers 1404 of the first omni-wheel 1402, the second rollers 1406 of the second omni-wheel 1408, the third rollers 1418 of the third omni-wheel 1416 and/or the fourth rollers 1458 of the fourth omni-wheel 1456 may not rotate. Alternatively, to realize "P+LD1" movement, the first omni-wheel 1402, the second omni-wheel 1408, the third omni-wheel 1416 and/or the fourth omni-wheel 1456 may rotate in a reverse or proximal "P" direction while the first rollers 1404 of the first omni-wheel 1402, the third rollers 1418 of the third omni-wheel 1416, and/or the fourth rollers 1458 of the fourth omni-wheel 1456 rotate in the "LD2" direction and the second rollers 1406 of the second omni-wheel 1408 rotate in the "LD1" direction to propel/drive the wheelchair assembly 300 in the "P+LD1" direction. Alternatively, to realize "P+LD2" movement, the first omni-wheel 1402, the second omni-wheel 1408, the third omni-wheel 1416 and/or the fourth omni-wheel 1456 may rotate in a reverse or proximal "P" direction while the first rollers 1404 of the first omni-wheel 1402, the third rollers 1418 of the third omni-wheel 1416, and/or the fourth rollers 1458 of the fourth omni-wheel 1456 rotate in the "LD1" direction and the second rollers 1406 of the second omni-wheel 1408 rotate in the "LD2" direction to propel/drive the wheelchair assembly 300 in the "P+LD2" direction. Again, since only omni-directional wheels (e.g., omni-wheels) are in contact with the surface 364, LD1 and LD2 movement may also be realized. To realize LD1 movement, the first rollers 1404 of the first omni-wheel 1402, the second rollers 1406 of the second omni-wheel 1408, the third rollers 1418 of the third omni-wheel 1416 and/or the fourth rollers 1458 of the fourth omni-wheel 145 may rotate in an "LD1" direction to propel/drive the wheelchair assembly 300 in the "LD1" direction. Alternatively, to realize LD2 movement, the first rollers 1404 of the first omni-wheel 1402, the second rollers 1406 of the second omni-wheel 1408, the third rollers 1418 of the third omni-wheel 1416 and/or the fourth rollers 1458 of the fourth omni-wheel 145 may rotate in an "LD2" direction to propel/drive the wheelchair assembly 300 in the "LD2" direction. Furthermore, in such an aspect, the wheelchair assembly 300 is able to rotate or turn, in place, with a minimal or zero turning radius. To realize rotation in a first direction (e.g., rotate right RR) the first rollers 1404 of the first omni-wheel 1402 may rotate in an "LD1" direction at a first speed and the second rollers 1406 of the second omni-wheel 1408 may rotate in an "LD2" direction at a second speed equal to the first speed while the third rollers 1418 of the third omni-wheel 1416 rotate in the "LD1" direction and the fourth rollers 1458 of the fourth omni-wheel 1456 rotate in the "LD1" direction to rotate the wheelchair assembly 300, in place, in the first direction (e.g. rotate right RR). Similarly, to realize rotation in a second direction (e.g., rotate left RL) the first rollers 1404 of the first omni-wheel 1402 may rotate in an "LD2" direction at a first speed and the second rollers 1406 of the second omni-wheel 1408 may rotate in an "LD1" direction at a second speed equal to the first speed while the third rollers 1418 of the third omni-wheel 1416 rotate in the "LD2" direction and the fourth rollers 1458 of the fourth omni-wheel 1456 rotate in the "LD2" direction to rotate the wheelchair assembly 300, in place, in the second direction (e.g. rotate left RL).

Still referring to FIG. 14, according to an alternative aspect herein, the first omni-wheel 1402 at the foot joint 340 may be selectively raised off of the surface 364. In such an aspect, only omni-directional wheels would remain in contact with the surface 364. According to such an aspect, to realize "D" movement, the second omni-wheel 1408, the third omni-wheel 1416, and/or the fourth omni-wheel 1456 may rotate in a forward or distal "D" direction at an equal speed to propel/drive the wheelchair assembly 300 in the "D" direction. In such an aspect, the second rollers 1406 of the second omni-wheel 1408, the third rollers 1418 of the third omni-wheel 1416 and/or the fourth rollers 1458 of the fourth omni-wheel 1456 may not rotate. Alternatively, to realize "D+LD1" movement, the second omni-wheel 1408, the third omni-wheel 1416 and/or the fourth omni-wheel 1456 may rotate in a forward or distal "D" direction while the third rollers 1418 of the third omni-wheel 1416 and/or the fourth rollers 1458 of the fourth omni-wheel 1456 rotate in the "LD1" direction and the second rollers 1406 of the second omni-wheel 1408 rotate in the "LD2" direction to propel/drive the wheelchair assembly 300 in the "D+LD1" direction. Alternatively, to realize "D+LD2" movement, the second omni-wheel 1408, the third omni-wheel 1416 and/or the fourth omni-wheel 1456 may rotate in a forward or distal "D" direction while the third rollers 1418 of the third omni-wheel 1416 and/or the fourth rollers 1458 of the fourth omni-wheel 1456 rotate in the "LD2" direction and the second rollers 1406 of the second omni-wheel 1408 rotate in the "LD1" direction to propel/drive the wheelchair assembly 300 in the "D+LD2" direction. Alternatively, to realize "P" movement, the second omni-wheel 1408, the third omni-wheel 1416, and/or the fourth omni-wheel 1456 may rotate in a reverse or proximal "P" direction at an equal speed to propel/drive the wheelchair assembly 300 in the "P" direction. In such an aspect, the second rollers 1406 of the second omni-wheel 1408, the third rollers 1418 of the third omni-wheel 1416 and/or the fourth rollers 1458 of the fourth omni-wheel 1456 may not rotate. Alternatively, to realize "P+LD1" movement, the second omni-wheel 1408, the third omni-wheel 1416 and/or the fourth omni-wheel 1456 may rotate in a reverse or proximal "P" direction while the third rollers 1418 of the third omni-wheel 1416 and/or the fourth rollers 1458 of the fourth omni-wheel 1456 rotate in the "LD2" direction and the second rollers 1406 of the second omni-wheel 1408 rotate in the "LD1" direction to propel/drive the wheelchair assembly 300 in the "P+LD1" direction. Alternatively, to realize "P+LD2" movement, the second omni-wheel 1408, the third omni-wheel 1416 and/or the fourth omni-wheel 1456 may rotate in a reverse or proximal "P" direction while the third rollers 1418 of the third omni-wheel 1416 and/or the fourth rollers 1458 of the fourth omni-wheel 1456 rotate in the "LD1" direction and the second rollers 1406 of the second omni-wheel 1408 rotate in the "LD2" direction to propel/drive the wheelchair assembly 300 in the "P+LD2" direction. Yet again, since only omni-directional wheels (e.g., omni-wheels) are in contact with the surface 364, LD1 and LD2 movement may also be realized. To realize LD1 movement, the second rollers 1406 of the second omni-wheel 1408 the third rollers 1418 of the third omni-wheel 1416 and/or the fourth rollers 1458 of the fourth omni-wheel 145 may rotate in an "LD1" direction to propel/drive the wheelchair assembly 300 in the "LD1" direction. Alternatively, to realize LD2 movement, the second rollers 1406 of the second omni-wheel 1408, the third rollers 1418 of the third omni-wheel 1416 and/or the fourth rollers 1458 of the fourth omni-wheel 145 may rotate in an "LD2" direction to propel/drive the wheelchair assembly 300 in the "LD2" direction. Furthermore, in such an aspect, the wheelchair assembly 300 is able to rotate or turn, in place, with a minimal or zero turning radius. To realize rotation in a first direction (e.g., rotate right RR) the third rollers 1418 of the third omni-wheel 1416 and the fourth rollers 1458 of the fourth omni-wheel 1456 may rotate in the "LD1" direction at a first speed and the second rollers 1406 of the second omni-wheel 1408 may rotate in an "LD2" direction at a second speed equal to the first speed to rotate the wheelchair assembly 300, in place, in the first direction (e.g. rotate right RR). Similarly, to realize rotation in a second direction (e.g., rotate left RL) the third rollers 1418 of the third omni-wheel 1416 and the fourth rollers 1458 of the fourth omni-wheel 1456 may rotate in the "LD2" direction at a first speed and the second rollers 1406 of the second omni-wheel 1408 may rotate in an "LD1" direction at a second speed equal to the first speed to rotate the wheelchair assembly 300, in place, in the second direction (e.g. rotate left RL). Notably, the movements of such an aspect similarly apply an embodiment where the first omni-wheel 1402 at the foot joint 340 is substituted with a standard wheel (e.g., see FIG. 1B).

Casters

An omni-directional wheel, as referenced herein, may alternatively be a caster. According to various aspects, a caster may include a passive caster or an active caster. A passive caster may be configured to operate and/or move passively in response to an externally generated force (e.g., a force generated by another drive wheels as described herein). An active caster may be configured to operate and/or move in response to a force generated by the active caster itself. More specifically, the caster may include a motor that drives a wheel of the active caster and/or a motor that rotates a driving direction of the caster. At least in light of FIGS. 8-10 (e.g., disclosing mecanum wheel embodiments) and FIGS. 12-14 (e.g., disclosing omni-wheel embodiments) herein, it should be understood that a passive caster and/or an active caster may similarly be utilized as an omni-directional wheel (e.g., as knee wheel 316, as knee wheel 336, as knee wheel 356, and/or as foot wheel 334, and/or the like) to realize the various directional movements disclosed herein.

Raising and Lowering Functionality

As described herein, the various leg modules (e.g., 380, 385, 390 and/or the like) may further raise and/or lower various components (e.g., seat 302, power base 304, and/or the like) of the wheelchair assembly 300 to a desired height as well as balance or support or stabilize the various components at that desired height. Accordingly, the various leg modules (e.g., 380, 385, 390 and/or the like) are able to provide yet a further convenience to the wheelchair assembly 300 user. FIG. 1A for example illustrates a wheelchair assembly 300, including three leg modules, in a raised position. In the raised positon, the upper leg assemblies (e.g., 306, 326, 346 herein) rotate about their respective hip pivots (e.g., 322, 342, 362 herein) and the respective lower leg assemblies (e.g., 308, 328, 348 herein) rotate about their respective knee pivots (e.g., 318, 228, 358 herein) to raise and support wheelchair components (e.g., seat 302, power base 304, and/or the like) to a height corresponding to such a raised position. As illustrated in FIG. 1A, the knee wheel of each leg module (e.g., 380, 385, 390 and/or the like) is positioned out of contact with the surface while the foot wheel of each leg module (e.g., 380, 385, 390 and/or the like) is positioned in contact with the surface. In light of FIG. 1A, it should be understood that any vertical position (e.g., a lower position, a higher position, and/or the like) may be a default position for the wheelchair assembly 300. According to one aspect, the default position is one where each foot wheel (e.g., 314, 334, 354 herein) and each knee wheel (e.g., 316, 336, 356 herein) associated with each leg module (e.g., 380, 385, 390 herein) is in contact with a surface (e.g., ground, floor and/or the like).

Drive Mode Transitions

As disclosed herein, the wheelchair assembly 300 of the present disclosure is capable of transitioning between a RWD mode, a FWD mode, a MWD mode, and an OWD mode. For example, it may not be practical and/or efficient for to utilize an OWD mode as a default mode of operation. Although OWD mode may offer increased maneuverability, omni-directional wheels (e.g. mecanum wheels, omni-wheels, casters, and/or the like) may not operate or function sufficiently well on an uneven surface (e.g., ground, floor, and/or the like). Furthermore, such omni-directional wheels may not be energy efficient and may exhibit undesired characteristics during use (e.g., noise, system drag, vibrations, less efficient on rough terrain, and/or the like). As such, according to various aspects, it may be desirable utilize OWD mode when confronted with various obstacles (e.g., pure lateral movement necessary, a need to move closer to or away from a wall, and/or the like) and utilize RWD mode and/or FWD mode as the default mode of operation. Similarly, according to various aspects, it may be desirable to utilize MWD mode when confronted with various obstacles (e.g., a tight turn around area) and utilize RWD mode and/or FWD mode as a default mode of operation. For example, in view of FIG. 3A, one leg module (e.g., second leg module 385) may be positioned out of contact with the surface such that undesired characteristics associated with omni-directional wheels are minimized.

According to various aspects, a wheelchair assembly 300 may default to a RWD mode or a FWD mode of operation as described herein. In response to a user command (e.g., via a control panel, a control interface, a joystick, and/or the like) a control device (FIG. 15 herein) may transition the wheelchair assembly 300 from the RWD mode or the FWD mode configuration to an MWD mode configuration. More specifically, in view of FIG. 3A, the control device may cause the upper leg assembly 326 of the second leg module 385 may rotate (e.g., clockwise) about hip pivot 342 while the lower leg assembly 328 rotates (e.g., counter-clockwise) about knee joint 338 until the foot wheel 334 and the knee wheel 336 are positioned in contact with a surface 364. Further, in such an aspect, the control device may cause the upper leg assembly 306 of the first leg module 380 and the upper leg assembly 346 of the third leg module 390 to simultaneously rotate (e.g., clockwise) about respective hip pivots (e.g., 322, 362) to raise the knee wheel 316 and the knee wheel 356 off of the surface 364 while the lower leg assembly 308 of the first leg module 380 and the lower leg assembly 348 of the third leg module 390 simultaneously rotate (e.g., counter-clockwise) about respective knee pivots (e.g., 318, 356) and to advance the foot wheel 314 and the foot wheel 354 to a central location under the seat 302 (e.g., at/near a center of gravity) of the wheelchair assembly (e.g., see FIG. 4A).

According to some aspects, the wheelchair assembly may return to its default mode of operation (e.g., RWD mode, FWD mode, and/or the like) before transitioning to another mode of operation. In such an aspect, in response to a user command, the control device may reverse the leg module movements described above to return the wheelchair assembly to the RWD mode or the FWD mode prior to transitioning to another mode of operation. In other aspects, the wheelchair assembly 300 may transition to another mode of operation on demand without returning to its default mode of operation. For example, the wheelchair assembly may transition from a MWD mode of operation directly to an OWD mode of operation. In view of FIG. 4A, in response to a user command, the control device may cause the upper leg assembly 306 of the first leg module 380 and the upper leg assembly 346 of the third leg module 390 to simultaneously rotate (e.g., counter-clockwise) about respective hip pivots (e.g., 322, 362) to lower the knee wheel 316 and the knee wheel 356 in contact with the surface 364. Further in such an aspect, the control device may cause the lower leg assembly 308 of the first leg module 380 and the lower leg assembly 348 of the third leg module 390 simultaneously rotate (e.g., clockwise) about respective knee pivots (e.g., 318, 356) to retreat the foot wheel 314 and the foot wheel 354 to a proximal position. In addition, once the foot wheel 314 and the foot wheel 354 are at the proximal position, the control device may cause the lower leg assembly 308 of the first leg module 380 and the lower leg assembly 348 of the third leg module 390 to simultaneously rotate (e.g., counter-clockwise) about respective knee pivots (e.g., 318, 356) to raise the foot wheel 314 and the foot wheel 354 off of the surface (see e.g., FIG. 5A). Notably, according to an alternative embodiment, the control device may further cause the lower leg assembly 328 of the second leg module 385 to simultaneously rotate (e.g. clockwise) about its knee joint 338 to raise its foot wheel 334 off of the surface 364.

According to various aspects, since it may not be desirable to stay in OWD mode (e.g., not as energy efficient, more drag, noisy, less efficient on rough terrain, and/or the like), in response to a user command, the control device reverse the leg module movements described above to return the wheelchair assembly to the MWD mode. Alternatively, in response to a user command, the control device may directly transition the wheelchair assembly 300 to a default mode of operation (e.g., RWD mode or FWD mode) from the OWD mode. In such an aspect, the control device may cause the lower leg assembly 308 of the first leg module 380 and the lower leg assembly 348 of the third leg module 390 to simultaneously rotate (e.g., clockwise) about respective knee pivots (e.g., 318, 356) to lower the foot wheel 314 and the foot wheel 354 in contact with the surface. Further, the control device may cause the upper leg assembly 326 of the second leg module 385 to rotate (e.g., counter-clockwise) about hip pivot 342 while the lower leg assembly 328 rotates (e.g., clockwise) about knee joint 338 until the foot wheel 334 and the knee wheel 336 are positioned out of contact with a surface 364 (see e.g., FIG. 3A). Alternatively, in embodiments where the foot wheel 334 has also been raised off of the surface, the control device may further cause the upper leg assembly 326 of the second leg module 385 to rotate (e.g., counter-clockwise) about hip pivot 342 while the lower leg assembly 328 rotates (e.g., clockwise) about knee joint 338 until the knee wheel 336 is also positioned out of contact with the surface 364 (see e.g., FIG. 3A). Notably, in response to a user command, the control device may reverse the leg module movements described above to transition the wheelchair assembly 300 from a default mode of operation (e.g., RWD mode, FWD mode, and/or the like) to the OWD mode.

Control Devices and User Interfaces

Figure 15:
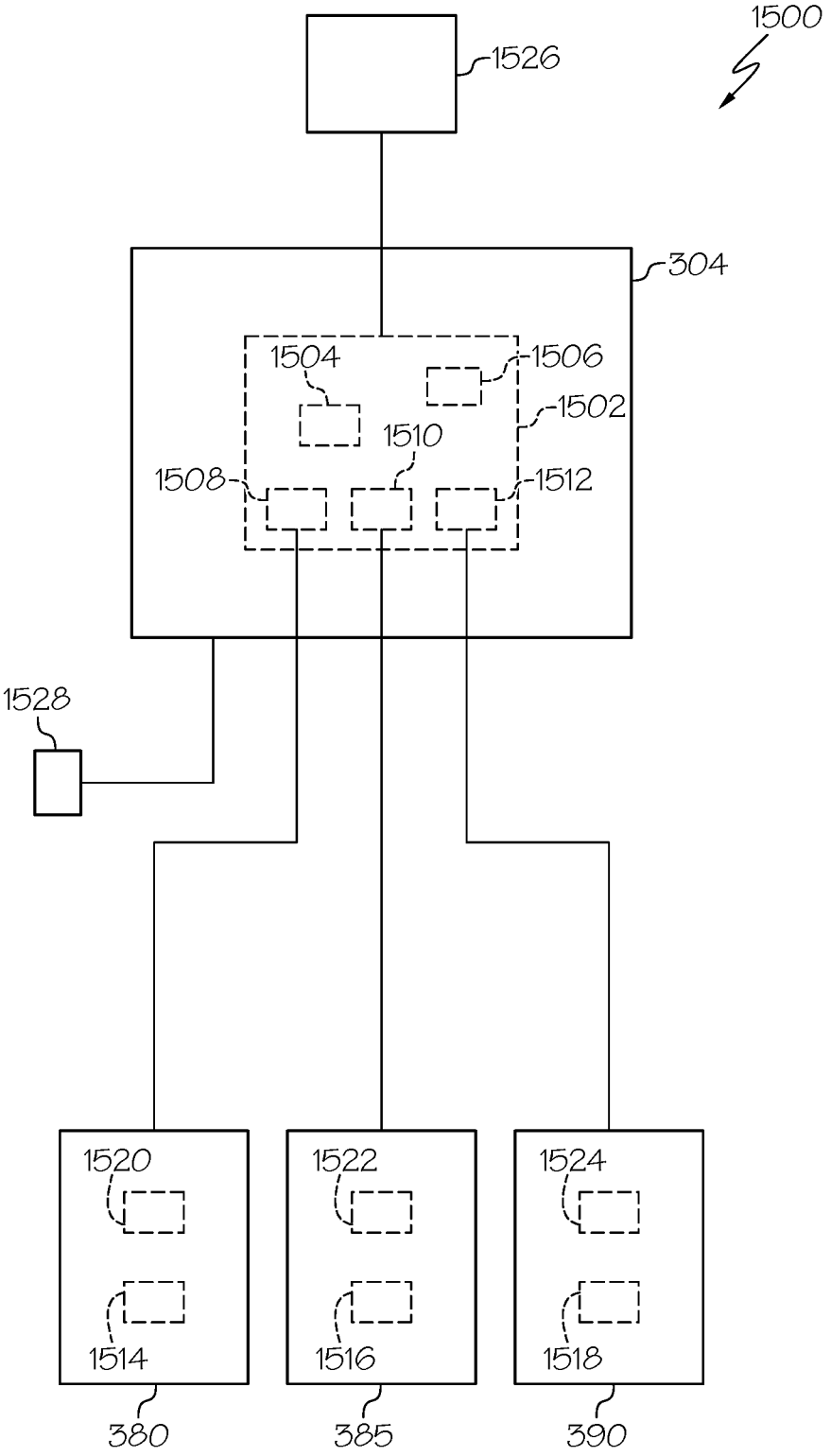
FIG. 15 depicts a block diagram of an illustrative control system to control the leg modules according to one or more embodiments shown and described herein.

FIG. 15 depicts a block diagram of an illustrative control system 1500 to control the leg modules as described herein. In particular, the various embodiments disclosed herein may utilize a control device 1502 positioned within the power base 304 to control the various leg modules 380, 385, 390 as described herein. According to various aspects, the control device 1502 may include a processor 1504, a storage device 1506 storing executable programs to control the various leg modules as described herein, a plurality of motor and/or actuator controllers (e.g., a first motor and/or actuator controller 1508, a second motor and/or actuator controller 1510, a third motor and/or actuator controller 1512) to control a plurality of motors coupled to and/or integrated within the leg modules (e.g. first motor 1514, a second motor 1516, a third motor 1518) to drive the wheelchair assembly 300 via the various leg modules as described herein and/or a plurality of actuators (e.g., a first actuator 1520, a second actuator 1522, a third actuator 1524) to actuate the various leg modules as described herein, and/or the like. More specifically, the control device 1502 may be configured and/or programmed to perform the various transitions described herein between and amongst various modes of operation including the RWD mode, the FWD mode, the MWD mode and/or the OWD mode. According to various aspects, the control device 1502 may be configured and/or programmed to perform the various transitions described herein in response to a user command (e.g., a control input) received via a user interface 1526 (e.g., a control panel, a control interface, a joystick, a virtual reality headset, and/or the like). The control device 1502 may be further configured and/or programmed to perform the various transitions described herein in response to a signal received from one or more sensors 1528 positioned on the wheelchair assembly. For example, an optical or proximity sensor positioned on the wheelchair assembly may detect a close proximity to a wall and send a signal to the control device 1502 to avoid the wheelchair user from getting stuck on the wall. In response, the control device 1502 may automatically transition the wheelchair assembly to an OWD mode of operation to laterally move the wheelchair assembly away from the wall. Alternatively, the control device may prompt a user (e.g., via the user interface 1526) to manually transition the wheelchair assembly to the OWD mode of operation to laterally move the wheelchair assembly 300 away from the wall.

It should now be understood that the systems and methods described herein are suitable for transitioning a wheelchair assembly, including a plurality of leg modules, between various modes of operation. The plurality of leg modules may include driven and/or non-driven wheels, including standard wheels or omni-directional wheels, selectively positioned in ground contact based on the selected mode of operation. Transitions between the various modes of operation may increase the efficiency and/or the maneuverability of the wheelchair assembly.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A wheelchair assembly, comprising:

a control device;

a power base; and a plurality of leg modules coupled to the power base, wherein the plurality of leg modules include a first leg module, a second leg module, and a third leg module;

wherein each of the first leg module, the second leg module, and the third leg module comprise:

an upper leg assembly;

a lower leg assembly including a knee joint and a foot joint, wherein the lower leg assembly is rotatably coupled to the upper leg assembly at the knee joint;

a knee wheel located at the knee joint of the lower leg assembly, wherein the knee wheel comprises an omni-directional wheel, and wherein the knee wheel is selectively drivable; and a foot wheel located at the foot joint of the lower leg assembly, wherein the foot wheel is selectively drivable;

wherein the control device, based on a selectable mode of operation, controls at least one of the upper leg assembly or the lower leg assembly associated with each respective leg module to selectively position at least one of the knee wheel or the foot wheel associated with each respective leg module relative to a surface.

2. The wheelchair assembly of claim 1, wherein each foot wheel comprises an omni-directional wheel or a standard wheel.

3. The wheelchair assembly of claim 1, wherein the omni-directional wheel comprises a mecanum wheel, an omni-wheel, or a caster.

4. The wheelchair assembly of claim 1, wherein the lower leg assembly associated with each respective leg module further includes at least one motor to selectively drive the omni-directional knee wheel and the foot wheel associated with each respective leg module.

5. The wheelchair assembly of claim 4, wherein the lower leg assembly associated with each respective leg module further includes at least one drive train to selectively drive at least one of the omni-directional knee wheel or the foot wheel associated with each respective leg module.

6. The wheelchair assembly of claim 1, wherein the control device controls each of the first leg module, the second leg module, and the third leg module independently based on the selectable mode of operation.

7. The wheelchair assembly of claim 1, wherein the control device controls at least two of the first leg module, the second leg module, or the third leg module simultaneously based on the selectable mode of operation.

8. The wheelchair assembly of claim 1, wherein the selectable mode of operation comprises a front-wheel drive (FWD) mode, and wherein in the FWD mode:

the omni-directional knee wheel and the foot wheel of the first leg module are positioned in contact with the surface; and the omni-directional knee wheel and the foot wheel of the third leg module are positioned in contact with the surface; and wherein the omni-directional knee wheel of the first leg module and the omni-directional knee wheel of the third leg module are selectively drivable to move the wheelchair assembly.

9. The wheelchair assembly of claim 8, wherein in the FWD mode, the omni-directional knee wheel and the foot wheel of the second leg module are positioned out of contact with the surface.

10. The wheelchair assembly of claim 1, wherein the selectable mode of operation comprises a mid-wheel drive (MWD) mode, and wherein in the MWD mode:

the omni-directional knee wheel and the foot wheel of the second leg module are positioned in contact with the surface;

the omni-directional knee wheel of the first leg module is positioned out of contact with the surface while the foot wheel of the first leg module is positioned in contact with the surface at a central position relative to the omni-directional knee wheel and the foot wheel of the second leg module; and the omni-directional knee wheel of the third leg module is positioned out of contact with the surface while the foot wheel of the third leg module is positioned in contact with the surface at the central position relative to the omni-directional knee wheel and the foot wheel of the second leg module;

wherein the foot wheel of the first leg module and the foot wheel of the third leg module are selectively drivable to move the wheelchair assembly.

11. The wheelchair assembly of claim 10, wherein the foot wheel of the second leg module comprises an omni-directional wheel, and wherein the omni-directional knee wheel and the foot wheel of the second leg module are selectively drivable to move the wheelchair assembly.

12. The wheelchair assembly of claim 1, wherein the selectable mode of operation comprises an omni-wheel drive (OWD) mode, and wherein in the OWD mode:

the omni-directional knee wheel of the first leg module is positioned in contact with the surface while the foot wheel of the first leg module is positioned out of contact with the surface;

the omni-directional knee wheel of the third leg module is positioned in contact with the surface while the foot wheel of the third leg module is positioned out of contact with the surface; and at least the omni-directional knee wheel of the second leg module is positioned in contact with the surface;

wherein the omni-directional knee wheel of the first leg module, the omni-directional knee wheel of the second leg module, and the omni-directional knee wheel of the third leg module are selectively drivable to move the wheelchair assembly.

13. The wheelchair assembly of claim 12, wherein the foot wheel of the second leg module comprises an omni-directional wheel, wherein the omni-directional foot wheel of the second leg module is positioned in contact with the surface, and wherein the omni-directional foot wheel of the second leg module is further selectively drivable to move the wheelchair assembly.

14. The wheelchair assembly of claim 13, wherein the foot wheel of the second leg module is positioned out of contact with the surface.

15. A leg module of a wheelchair assembly, comprising:

an upper leg assembly;

a lower leg assembly including a knee joint and a foot joint, wherein the lower leg assembly is rotatably coupled to the upper leg assembly at the knee joint;

a knee wheel located at the knee joint of the lower leg assembly, wherein the knee wheel comprises an omni-directional wheel, and wherein the knee wheel is selectively drivable; and a foot wheel located at the foot joint of the lower leg assembly, wherein the foot wheel is selectively drivable;

wherein at least one of the upper leg assembly or the lower leg assembly associated with the leg module is controllable, based on a selectable mode of operation, to selectively position at least one of the omni-directional knee wheel or the foot wheel associated with the leg module relative to a surface, the selectable mode of operation comprising a front-wheel drive (FWD) mode, a mid-wheel drive (MWD) mode, and an omni-wheel drive (OWD) mode.

16. The leg module of claim 15, wherein the foot wheel comprises an omni-directional wheel or a standard wheel.

17. The leg module of claim 15, wherein the lower leg assembly further includes at least one motor and at least one drive train to selectively drive at least one of the omni-directional knee wheel or the foot wheel.

18. A system, comprising:

a control device;

a power base; and a plurality of leg modules coupled to the power base, wherein the plurality of leg modules include a first leg module, a second leg module, and a third leg module;

wherein each of the first leg module, the second leg module, and the third leg module comprise:

an upper leg assembly;

a lower leg assembly including a knee joint and a foot joint, wherein the lower leg assembly is rotatably coupled to the upper leg assembly at the knee joint;

a knee wheel located at the knee joint of the lower leg assembly, wherein the knee wheel comprises an omni-directional wheel, and wherein the knee wheel is selectively drivable; and a foot wheel located at the foot joint of the lower leg assembly, wherein the foot wheel is selectively drivable;

wherein the control device controls at least one of the first leg module, the second leg module, or the third leg module, either independently or simultaneously, to transition the system between a front-wheel drive (FWD) mode configuration, a mid-wheel drive (MWD) mode configuration, and an omni-wheel drive (OWD) mode configuration.

19. The system of claim 18, further comprising a sensor, wherein the control device controls the at least one of the first leg module, the second leg module, or the third leg module to transition the system in response to a signal received from the sensor.

* * * * *